US011434548B2

(12) United States Patent
Oishi et al.

(10) Patent No.: US 11,434,548 B2
(45) Date of Patent: Sep. 6, 2022

(54) FREE-CUTTING COPPER ALLOY AND METHOD FOR PRODUCING FREE-CUTTING COPPER ALLOY

(71) Applicant: MITSUBISHI MATERIALS CORPORATION, Tokyo (JP)

(72) Inventors: Keiichiro Oishi, Osaka (JP); Kouichi Suzaki, Osaka (JP); Shinji Tanaka, Osaka (JP); Takayuki Oka, Osaka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 16/482,913

(22) PCT Filed: Feb. 21, 2018

(86) PCT No.: PCT/JP2018/006245
§ 371 (c)(1),
(2) Date: Aug. 1, 2019

(87) PCT Pub. No.: WO2019/035226
PCT Pub. Date: Feb. 21, 2019

(65) Prior Publication Data

US 2020/0165706 A1 May 28, 2020

(30) Foreign Application Priority Data

Aug. 15, 2017 (WO) ..... PCT/JP2017/029369
Aug. 15, 2017 (WO) ..... PCT/JP2017/029371
(Continued)

(51) Int. Cl.
*C22C 9/04* (2006.01)
*C22F 1/00* (2006.01)
*C22F 1/08* (2006.01)

(52) U.S. Cl.
CPC ..... *C22C 9/04* (2013.01); *C22F 1/002* (2013.01); *C22F 1/08* (2013.01)

(58) Field of Classification Search
None
See application file for complete search history.

(56) References Cited

U.S. PATENT DOCUMENTS 4,055,445 A 10/1977 Pops
5,865,910 A 2/1999 Bhargava
(Continued)

FOREIGN PATENT DOCUMENTS

CA 2582972 A1 4/2006
EP 1045041 A1 10/2000
(Continued)

OTHER PUBLICATIONS

JP2013104071 machine translation (Year: 2021).*
(Continued)

*Primary Examiner* — Robert S Jones, Jr.
*Assistant Examiner* — Jiangtian Xu
(74) *Attorney, Agent, or Firm* — Merchant & Gould P.C.

(57) ABSTRACT

This free-cutting copper alloy comprises 75.4-78.7% Cu, 3.05-3.65% Si, 0.10-0.28% Sn, 0.05-0.14% P, and at least 0.005% to less than 0.020% Pb, with the remainder comprising Zn and inevitable impurities. The composition satisfies the following relations: $76.5 \leq f1 = Cu + 0.8 \times Si - 8.5 \times Sn + P \leq 80.3$; $60.7 \leq f2 = Cu - 4.6 \times Si - 0.7 \times Sn - P \leq 62.1$; and $0.25 \leq f7 = P/Sn \leq 1.0$. The area percentage (%) of respective constituent phases satisfies the following relations: $28 \leq \kappa \leq 67$; $0 \leq \gamma \leq 1.0$; $0 \leq \beta \leq 0.2$; $0 \leq \mu \leq 1.5$; $97.4 \leq f3 = \alpha + \kappa$; $99.4 \leq f4 = \alpha + \kappa + \gamma + \mu$; $0 \leq f5 = \gamma + \mu \leq 2.0$; and $30 \leq f6 = \kappa + 6 \times \gamma^{1/2} + 0.5 \times \mu \leq 70$. The long side of the γ phase is at most 40 μm, the long side of the μ phase is at most 25 μm, and κ phase is present in α phase.

13 Claims, 3 Drawing Sheets

(30) Foreign Application Priority Data

| | | |
|---|---|---|
| Aug. 15, 2017 | (WO) | PCT/JP2017/029373 |
| Aug. 15, 2017 | (WO) | PCT/JP2017/029374 |
| Aug. 15, 2017 | (WO) | PCT/JP2017/029376 |

(56) References Cited

U.S. PATENT DOCUMENTS

| | | | |
|---|---|---|---|
| 2002/0159912 | A1 | 10/2002 | Oishi |
| 2007/0062615 | A1 | 3/2007 | Oishi |
| 2007/0169854 | A1 | 7/2007 | Oishi |
| 2007/0169855 | A1 | 7/2007 | Oishi |
| 2009/0297390 | A1 | 12/2009 | Hidenobu et al. |
| 2013/0276938 | A1 | 10/2013 | Oishi |
| 2013/0315660 | A1 | 11/2013 | Oishi |
| 2013/0319581 | A1 | 12/2013 | Oishi |
| 2014/0251488 | A1 | 9/2014 | Oishi et al. |
| 2016/0068931 | A1 | 3/2016 | Xu et al. |
| 2017/0062615 | A1 | 3/2017 | Wang |
| 2017/0211169 | A1 | 7/2017 | Hanaoka et al. |

FOREIGN PATENT DOCUMENTS

| | | | | |
|---|---|---|---|---|
| EP | 2634275 | A1 | | 9/2013 |
| JP | 07-508560 | A | | 9/1995 |
| JP | 2000-119774 | A | | 4/2000 |
| JP | 2000-119775 | A | | 4/2000 |
| JP | 2004-263301 | A | | 9/2004 |
| JP | 2008-516081 | A | | 5/2008 |
| JP | 2008-214760 | | | 9/2008 |
| JP | 2009-509031 | A | | 3/2009 |
| JP | 2013-104071 | A | | 5/2013 |
| JP | 2013104071 | | * | 5/2013 |
| JP | H2013104071 | | * | 5/2013 |
| JP | 2016-511792 | A | | 4/2016 |
| WO | 94/01591 | A1 | | 1/1994 |
| WO | 2006/016442 | A1 | | 2/2006 |
| WO | 2006/016624 | A2 | | 2/2006 |
| WO | 2007/034571 | A1 | | 3/2007 |
| WO | 2008/081947 | A1 | | 7/2008 |
| WO | 2012/057055 | A1 | | 5/2012 |
| WO | 2013/065830 | A1 | | 5/2013 |
| WO | 2015/166998 | A1 | | 11/2015 |
| WO | 2018/034280 | A1 | | 2/2018 |
| WO | 2018/034281 | A1 | | 2/2018 |
| WO | 2018/034282 | A1 | | 2/2018 |
| WO | 2018/034283 | A1 | | 2/2018 |
| WO | 2018/034284 | A1 | | 2/2018 |
| WO | 2019/035224 | A1 | | 2/2019 |
| WO | 2019/035225 | A1 | | 2/2019 |

OTHER PUBLICATIONS

Office Action issued in Indian Patent Application 201917005548 dated Jan. 6, 2021.
Office Action issued in U.S. Appl. No. 16/324,684 dated Dec. 22, 2020.
Extended European Search Report issued in co-pending application 18846602.3 completed on Jun. 15, 2020 and dated Jun. 26, 2020.
Office Action issued in co-pending related U.S. Appl. No. 16/325,029 dated Oct. 27, 2020.
International Search Report issued in application PCT/JP2018/006245 dated May 15, 2018.
International Search Report issued in application PCT/JP2017/029369 dated Nov. 7, 2017.
International Search Report issued in application PCT/JP2017/029376 dated Nov. 7, 2017.
Office Action issued in Japanese patent application No. 2017-567267 dated Apr. 3, 2018, (Machine translation obtained by Global Dossier on Dec. 14, 2018).
International Search Report issued in application PCT/JP2017/029371 dated Nov. 7, 2017.
Office Action issued in Japanese patent application No. 2 017-567265 dated Apr. 3, 2018, (Machine translation obtained by Global Dossier on Dec. 14, 2018).
International Search Report issued in application PCT/JP2017/029374 dated Nov. 7, 2017.
Office Action issued in Japanese patent application No. 2017-567262 dated Apr. 10, 2018 (Machine translation obtained by Global Dossier on Dec. 13, 2018).
International Search Report issued in application PCT/JP2017/029373 dated Nov. 7, 2017.
International Search Report issued in application PCT/JP2018/006203 dated May 15, 2018.
International Search Report issued in application PCT/JP2018/006218 dated May 15, 2018.
Office Action issued in Japanese patent application No. 2018-530923 dated Aug. 7, 2018 (Machine translation obtained by Global Dossier on May 8, 2019).
Opposition issued in Japanese patent application No. 2017-567267 on Mar. 5, 2019 (w/machine translation).
Opposition issued in Japanese patent application No. 2017-567265 on Mar. 27, 2019 (w/machine translation).
Opposition issued in Japanese patent application No. 2017-567266 on Mar. 27, 2019 (w/machine translation).
Genjiro Mima, Masaharu Hasegawa, Journal of the Japan Copper and Brass ResearchAssociation, 2 (1963), p. 62-77 (w/partial translation).
JCBAT204 : 2005 "Lead-less free-cutting brass bar", Japan Copper and Brass Association technical standard (w/machine translation).
Office Action issued in co-pending U.S. Appl. No. 16/274,622 dated Aug. 26, 2019.

* cited by examiner

FREE-CUTTING COPPER ALLOY AND METHOD FOR PRODUCING FREE-CUTTING COPPER ALLOY

This is a National Phase Application in the United States of International Patent Application No. PCT/JP2018/006245 filed Feb. 21, 2018, which claims priority on International Patent Application Nos. PCT/JP2017/029369, PCT/JP2017/029371, PCT/JP2017/029373, PCT/JP2017/029374, and PCT/JP2017/029376, filed Aug. 15, 2017. The entire disclosures of the above patent applications are hereby incorporated by reference.

TECHNICAL FIELD

The present invention relates to a free-cutting copper alloy having excellent corrosion resistance, high strength, high-temperature strength, good ductility and impact resistance, in which the lead content is significantly reduced, and a method of manufacturing the free-cutting copper alloy. In particular, the present invention relates to a free-cutting copper alloy used in devices such as faucets, valves, or fittings for drinking water consumed by a person or an animal every day as well as valves, fittings, pressure vessels and the like for electrical uses, automobiles, machines, and industrial plumbing used in various harsh environments, and a method of manufacturing the free-cutting copper alloy.

Priority is claimed on PCT International Patent Application Nos. PCT/JP2017/29369, PCT/JP2017/29371, PCT/JP2017/29373, PCT/JP2017/29374, and PCT/JP2017/29376, filed on Aug. 15, 2017, the content of which is incorporated herein by reference.

BACKGROUND ART

Conventionally, as a copper alloy that is used in devices for drinking water and valves, fittings, pressure vessels and the like for electrical uses, automobiles, machines, and industrial plumbing, a Cu—Zn—Pb alloy including 56 to 65 mass % of Cu, 1 to 4 mass % of Pb, and a balance of Zn (so-called free-cutting brass), or a Cu—Sn—Zn—Pb alloy including 80 to 88 mass % of Cu, 2 to 8 mass % of Sn, 2 to 8 mass % of Pb, and a balance of Zn (so-called bronze: gunmetal) was generally used.

However, recently, Pb's influence on a human body or the environment is a concern, and a movement to regulate Pb has been extended in various countries. For example, a regulation for reducing the Pb content in drinking water supply devices to be 0.25 mass % or lower has come into force from January, 2010 in California, the United States and from January, 2014 across the United States. It is said that a regulation for limiting the amount of Pb to about 0.05 mass % will come into force in the near future considering its influence on infants and the like. In countries other than the United States, a movement of the regulation has become rapid, and the development of a copper alloy material corresponding to the regulation of the Pb content has been required.

In addition, in other industrial fields such as automobiles, machines, and electrical and electronic apparatuses industries, for example, in ELV Directives and RoHS Directives of the Europe, free-cutting copper alloys are exceptionally allowed to contain 4 mass % Pb. However, as in the field of drinking water, strengthening of regulations on Pb content including elimination of exemptions has been actively discussed.

Under the trend of the strengthening of the regulations on Pb in free-cutting copper alloys, copper alloys that includes Bi or Se having a machinability improvement function instead of Pb, or Cu—Zn alloys including a high concentration of Zn in which the amount of β phase is increased to improve machinability have been proposed.

For example, Patent Document 1 discloses that corrosion resistance is insufficient with mere addition of Bi instead of Pb, and proposes a method of slowly cooling a hot extruded rod to 180° C. after hot extrusion and further performing a heat treatment thereon in order to reduce the amount of β phase to isolate β phase.

In addition, Patent Document 2 discloses a method of improving corrosion resistance by adding 0.7 to 2.5 mass % of Sn to a Cu—Zn—Bi alloy to precipitate γ phase of a Cu—Zn—Sn alloy.

However, the alloy including Bi instead of Pb as disclosed in Patent Document 1 has a problem in corrosion resistance. In addition, Bi has many problems in that, for example, Bi may be harmful to a human body as with Pb, Bi has a resource problem because it is a rare metal, and Bi embrittles a copper alloy material. Further, even in cases where β phase is isolated to improve corrosion resistance by performing slow cooling or a heat treatment after hot extrusion as disclosed in Patent Documents 1 and 2, corrosion resistance is not improved at all in a harsh environment.

In addition, even in cases where γ phase of a Cu—Zn—Sn alloy is precipitated as disclosed in Patent Document 2, this γ phase has inherently lower corrosion resistance than α phase, and corrosion resistance is not improved at all in a harsh environment. In addition, in Cu—Zn—Sn alloys, γ phase including Sn has a low machinability improvement function, and thus it is also necessary to add Bi having a machinability improvement function.

On the other hand, regarding copper alloys including a high concentration of Zn, β phase has a lower machinability function than Pb. Therefore, such copper alloys cannot be replacement for free-cutting copper alloys including Pb. In addition, since the copper alloy includes a large amount of β phase, corrosion resistance, in particular, dezincification corrosion resistance or stress corrosion cracking resistance is extremely poor. In addition, these copper alloys have a low strength, in particular, under high temperature (for example, about 150° C.), and thus cannot realize a reduction in thickness and weight, for example, in automobile components used under high temperature near the engine room when the sun is blazing, or in valves and plumbing used under high temperature and high pressure. Further, for example, pressure vessels, valves, and plumbing relating to high pressure hydrogen have low tensile strength and thus can be used only under low normal operation pressure.

Further, Bi embrittles copper alloy, and when a large amount of β phase is contained, ductility deteriorates. Therefore, copper alloy including Bi or a large amount of β phase is not appropriate for components for automobiles or machines, or electrical components or for materials for drinking water supply devices such as valves. Regarding brass including γ phase in which Sn is added to a Cu—Zn alloy, Sn cannot improve stress corrosion cracking, strength under normal temperature and high temperature is low, and impact resistance is poor. Therefore, the brass is not appropriate for the above-described uses.

On the other hand, for example, Patent Documents 3 to disclose Cu—Zn—Si alloys including Si instead of Pb as free-cutting copper alloys.

The copper alloys disclosed in Patent Documents 3 and 4 have an excellent machinability without containing Pb or containing only a small amount of Pb that is mainly realized by superb machinability-improvement function of γ phase. Addition of 0.3 mass % or higher of Sn can increase and promote the formation of γ phase having a function to improve machinability. In addition, Patent Documents 3 and disclose a method of improving corrosion resistance by forming a large amount of γ phase.

In addition, Patent Document 5 discloses a copper alloy including an extremely small amount (0.02 mass % or less) of Pb having excellent machinability that is mainly realized by simply defining the total area of γ phase and κ phase considering the Pb content. Here, Sn functions to form and increase γ phase such that erosion-corrosion resistance is improved.

Further, Patent Documents 6 and 7 propose a Cu—Zn—Si alloy casting. The documents disclose that in order to refine crystal grains of the casting, extremely small amounts of P and Zr are added, and the P/Zr ratio or the like is important.

In addition, in Patent Document 8, proposes a copper alloy in which Fe is added to a Cu—Zn—Si alloy is proposed.

Further, Patent Document 9, proposes a copper alloy in which Sn, Fe, Co, Ni, and Mn are added to a Cu—Zn—Si alloy.

Here, in Cu—Zn—Si alloys, it is known that, even when looking at only those having Cu concentration of 60 mass % or higher, Zn concentration of 30 mass % or lower, and Si concentration of 10 mass % or lower as described in Patent Document 10 and Non-Patent Document 1, 10 kinds of metallic phases including matrix α phase, β phase, γ phase, δ phase, ε phase, ζ phase, η phase, κ phase, μ phase, and χ phase, in some cases, 13 kinds of metallic phases including α', β', and γ' in addition to the 10 kinds of metallic phases are present. Further, it is empirically known that, as the number of additive elements increases, the metallographic structure becomes complicated, or a new phase or an intermetallic compound may appear. In addition, it is also empirically known that there is a large difference in the constitution of metallic phases between an alloy according to an equilibrium diagram and an actually produced alloy. Further, it is well known that the composition of these phases may change depending on the concentrations of Cu, Zn, Si, and the like in the copper alloy and processing heat history.

Apropos, γ phase has excellent machinability but contains high concentration of Si and is hard and brittle. Therefore, when a large amount of γ phase is contained, problems arise in corrosion resistance, ductility, impact resistance, high-temperature strength (high temperature creep), normal temperature strength, and cold workability in a harsh environment. Therefore, use of Cu—Zn—Si alloys including a large amount of γ phase is also restricted like copper alloys including Bi or a large amount of β phase.

Incidentally, the Cu—Zn—Si alloys described in Patent Documents 3 to 7 exhibit relatively satisfactory results in a dezincification corrosion test according to ISO-6509. However, in the dezincification corrosion test according to ISO-6509, in order to determine whether or not dezincification corrosion resistance is good or bad in water of ordinary quality, the evaluation is merely performed after a short period of time of 24 hours using a reagent of cupric chloride which is completely unlike water of actual water quality. That is, the evaluation is performed for a short period of time using a reagent which only provides an environment that is different from the actual environment, and thus corrosion resistance in a harsh environment cannot be sufficiently evaluated.

In addition, Patent Document 8 proposes that Fe is added to a Cu—Zn—Si alloy. However, Fe and Si form an Fe—Si intermetallic compound that is harder and more brittle than γ phase. This intermetallic compound has problems like reduced tool life of a cutting tool during cutting and generation of hard spots during polishing such that the external appearance is impaired. In addition, since Si is consumed when the intermetallic compound is formed, the performance of the alloy deteriorates.

Further, in Patent Document 9, Sn, Fe, Co, and Mn are added to a Cu—Zn—Si alloy. However, each of Fe, Co, and Mn combines with Si to form a hard and brittle intermetallic compound. Therefore, such addition causes problems during cutting or polishing as disclosed by Document 8. Further, according to Patent Document 9, β phase is formed by addition of Sn and Mn, but β phase causes serious dezincification corrosion and causes stress corrosion cracking to occur more easily.

RELATED ART DOCUMENT

Patent Document

[Patent Document 1] JP-A-2008-214760
[Patent Document 2] WO2008/081947
[Patent Document 3] JP-A-2000-119775
[Patent Document 4] JP-A-2000-119774
[Patent Document 5] WO2007/034571
[Patent Document 6] WO2006/016442
[Patent Document 7] WO2006/016624
[Patent Document 8] JP-T-2016-511792
[Patent Document 9] JP-A-2004-263301
[Patent Document 10] U.S. Pat. No. 4,055,445
[Patent Document 11] WO2012/057055
[Patent Document 12] JP-A-2013-104071

Non-Patent Document

[Non-Patent Document 1] Genjiro MIMA, Masaharu HASEGAWA, Journal of the Japan Copper and Brass Research Association, 2 (1963), pages 62 to 77

SUMMARY OF THE INVENTION

Problem that the Invention is to Solve

The present invention has been made in order to solve the above-described problems of the conventional art, and an object thereof is to provide a free-cutting copper alloy having excellent corrosion resistance in a harsh environment, impact resistance, ductility, and strength under normal temperature and high temperature, and a method of manufacturing the free-cutting copper alloy. In this specification, unless specified otherwise, corrosion resistance refers to both dezincification corrosion resistance and stress corrosion cracking resistance. In addition, a hot worked material refers to a hot extruded material, a hot forged material, or a hot rolled material. Cold workability refers to workability of cold working such as swaging or bending. High temperature properties refer to high temperature creep and tensile strength at about 150° C. (100° C. to 250° C.). Cooling rate refers to an average cooling rate in a given temperature range.

Means for Solving the Problem

In order to achieve the object by solving the problems, a free-cutting copper alloy according to the first aspect of the present invention includes:

75.4 mass % to 78.7 mass % of Cu;

3.05 mass % to 3.65 mass % of Si;

0.10 mass % to 0.28 mass % of Sn;

0.05 mass % to 0.14 mass % of P;

0.005 mass % or higher and lower than 0.020 mass % of Pb; and a balance including Zn and inevitable impurities, wherein when a Cu content is represented by [Cu] mass %, a Si content is represented by [Si] mass %, a Sn content is represented by [Sn] mass %, and a P content is represented by [P] mass %, the relations of $$76.5 \leq f1 = [Cu] + 0.8 \times [Si] - 8.5 \times [Sn] + [P] \leq 80.3,$$

$$60.7 \leq f2 = [Cu] - 4.6 \times [Si] - 0.7 \times [Sn] - [P] \leq 62.1, \text{ and}$$

$$0.25 \leq f7 = [P]/[Sn] \leq 1.0$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$28 \leq (\kappa) \leq 67,$$

$$0 \leq (\gamma) \leq 1.0,$$

$$0 \leq (\beta) \leq 0.2,$$

$$0 \leq (\mu) \leq 1.5,$$

$$97.4 \leq f3 = (\alpha) + (\kappa),$$

$$99.4 \leq f4 = (\alpha) + (\kappa) + (\gamma) + (\mu),$$

$$0 \leq f5 = (\gamma) + (\mu) \leq 2.0, \text{ and}$$

$$30 \leq f6 = (\kappa) + 6 \times (\gamma)^{1/2} + 0.5 \times (\mu) \leq 70$$

are satisfied, the length of the long side of γ phase is 40 μm or less, the length of the long side of μ phase is 25 μm or less, and κ phase is present in α phase.

According to the second aspect of the present invention, the free-cutting copper alloy according to the first aspect further includes:

one or more element(s) selected from the group consisting of 0.01 mass % to 0.08 mass % of Sb, 0.02 mass % to 0.08 mass % of As, and 0.005 mass % to 0.20 mass % of Bi.

A free-cutting copper alloy according to the third aspect of the present invention includes:

75.6 mass % to 77.9 mass % of Cu;

3.12 mass % to 3.45 mass % of Si;

0.12 mass % to 0.27 mass % of Sn;

0.06 mass % to 0.13 mass % of P;

0.006 mass % to 0.018 mass % of Pb; and a balance including Zn and inevitable impurities, wherein when a Cu content is represented by [Cu] mass %, a Si content is represented by [Si] mass %, a Sn content is represented by [Sn] mass %, and a P content is represented by [P] mass %, the relations of $$76.8 \leq f1 = [Cu] + 0.8 \times [Si] - 8.5 \times [Sn] + [P] \leq 79.3,$$

$$60.8 \leq f2 = [Cu] - 4.6 \times [Si] - 0.7 \times [Sn] - [P] \leq 61.9, \text{ and}$$

$$0.28 \leq f7 = [P]/[Sn] \leq 0.84$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$30 \leq (\kappa) \leq 56,$$

$$0 \leq (\gamma) \leq 0.5,$$

$$(\beta) = 0,$$

$$0 \leq (\mu) \leq 1.0,$$

$$98.5 \leq f3 = (\alpha) + (\kappa),$$

$$99.6 \leq f4 = (\alpha) + (\kappa) + (\gamma) + (\mu),$$

$$0 \leq f5 = (\gamma) + (\mu) \leq 1.2, \text{ and}$$

$$30 \leq f6 = (\kappa) + 6 \times (\gamma)^{1/2} + 0.5 \times (\mu) \leq 58$$

are satisfied, the length of the long side of γ phase is 25 μm or less, the length of the long side of μ phase is 15 μm or less, and κ phase is present in α phase.

According to the fourth aspect of the present invention, the free-cutting copper alloy according to the third aspect further includes:

one or more element(s) selected from the group consisting of 0.012 mass % to 0.07 mass % of Sb, 0.025 mass % to 0.07 mass % of As, and 0.006 mass % to 0.10 mass % of Bi.

According to the fifth aspect of the present invention, in the free-cutting copper alloy according to any one of the first to fourth aspects of the present invention, a total amount of Fe, Mn, Co, and Cr as the inevitable impurities is lower than 0.08 mass %.

According to the sixth aspect of the present invention, in the free-cutting copper alloy according to any one of the first to fifth aspects of the present invention, an amount of Sn in κ phase is 0.11 mass % to 0.40 mass %, and an amount of P in κ phase is 0.07 mass % to 0.22 mass %.

According to the seventh aspect of the present invention, in the free-cutting copper alloy according to any one of the first to sixth aspects of the present invention, a Charpy impact test value when a U-notched specimen is used is 12 J/cm$^2$ or higher and lower than 50 J/cm$^2$, and a creep strain after holding the material at 150° C. for 100 hours in a state where a load corresponding to 0.2% proof stress at room temperature is applied is 0.4% or lower.

Incidentally, the Charpy impact test value is a value obtained when a specimen with a U-shaped notch is used.

According to the eighth aspect of the present invention, the free-cutting copper alloy according to any one of the first to sixth aspects of the present invention is a hot worked material having a tensile strength S (N/mm$^2$) of 540 N/mm$^2$ or higher, an elongation E (%) of 12% or higher, a Charpy impact test value I (J/cm$^2$) when a specimen with a U-shaped notch is used is 12 J/cm$^2$ or higher, and either $660 \leq f8 = S \times \{(E+100)/100\}^{1/2}$ or $685 \leq f9 = S \times \{(E+100)/100\}^{1/2} + I$ is satisfied.

According to the ninth aspect of the present invention, the free-cutting copper alloy according to any one of the first to eighth aspects of the present invention is for use in a water supply device, an industrial plumbing component, a device that comes in contact with liquid, a pressure vessel a fitting, an automobile component, or an electric appliance component.

The method of manufacturing a free-cutting copper alloy according to the tenth aspect of the present invention is a method of manufacturing the free-cutting copper alloy according to any one of the first to ninth aspects of the present invention which includes:

any one or both of a cold working step and a hot working step; and an annealing step that is performed after the cold working step or the hot working step, wherein in the annealing step, the copper alloy is heated or cooled under any one of the following conditions (1) to (4):

(1) the copper alloy is held at a temperature of 525° C. to 575° C. for 20 minutes to 8 hours;

(2) the copper alloy is held at a temperature of 505° C. or higher and lower than 525° C. for 100 minutes to 8 hours;

(3) the maximum reaching temperature is 525° C. to 620° C. and the copper alloy is held in a temperature range from 575° C. to 525° C. for 20 minutes or longer; or (4) the copper alloy is cooled in a temperature range from 575° C. to 525° C. at an average cooling rate of 0.1° C./min to 2.5° C./min, and subsequently, the copper alloy is cooled in a temperature range from 460° C. to 400° C. at an average cooling rate of 2.5° C./min to 500° C./min.

The method of manufacturing a free-cutting copper alloy according to the eleventh aspect of the present invention is a method of manufacturing the free-cutting copper alloy according to any one of the first to seventh aspects of the present invention which includes:

a casting step, and an annealing step that is performed after the casting step, wherein in the annealing step, the copper alloy is heated or cooled under any one of the following conditions (1) to (4):

(1) the copper alloy is held at a temperature of 525° C. to 575° C. for 20 minutes to 8 hours;

(2) the copper alloy is held at a temperature of 505° C. or higher and lower than 525° C. for 100 minutes to 8 hours;

(3) the maximum reaching temperature is 525° C. to 620° C. and the copper alloy is held in a temperature range from 575° C. to 525° C. for 20 minutes or longer; or (4) the copper alloy is cooled in a temperature range from 575° C. to 525° C. at an average cooling rate of 0.1° C./min to 2.5° C./min, and subsequently, the copper alloy is cooled in a temperature range from 460° C. to 400° C. at an average cooling rate of 2.5° C./min to 500° C./min.

The method of manufacturing a free-cutting copper alloy according to the twelfth aspect of the present invention is a method of manufacturing the free-cutting copper alloy according to any one of the first to ninth aspects of the present invention which includes:

a hot working step, wherein the material's temperature during hot working is 600° C. to 740° C., and in the process of cooling after hot plastic working, the material is cooled in a temperature range from 575° C. to 525° C. at an average cooling rate of 0.1° C./min to 2.5° C./min and subsequently is cooled in a temperature range from 460° C. to 400° C. at an average cooling rate of 2.5° C./min to 500° C./min.

The method of manufacturing a free-cutting copper alloy according to the thirteenth aspect of the present invention is a method of manufacturing the free-cutting copper alloy according to any one of the first to ninth aspects of the present invention which includes:

any one or both of a cold working step and a hot working step; and a low-temperature annealing step that is performed after the cold working step or the hot working step, wherein in the low-temperature annealing step, conditions are as follows:

the material's temperature is in a range of 240° C. to 350° C.;

the heating time is in a range of 10 minutes to 300 minutes; and when the material's temperature is represented by T° C. and the heating time is represented by t min, $150 \leq (T-220) \times (t)^{1/2} \leq 1200$ is satisfied.

Advantage of the Invention

According to the aspects of the present invention, a metallographic structure in which the amount of μ phase that is effective for machinability is reduced as much as possible while minimizing the amount of γ phase that has an excellent machinability-improving function but has poor corrosion resistance, ductility, impact resistance and high-temperature strength (high temperature creep), and also, κ phase, which is effective to improve strength, machinability, ductility, and corrosion resistance, is present in α phase is defined. Further, a composition and a manufacturing method for obtaining this metallographic structure are defined. Therefore, according to the aspects of the present invention, it is possible to provide a free-cutting copper alloy having high normal-temperature strength and high-temperature strength, excellent corrosion resistance in a harsh environment, impact resistance, ductility, wear resistance, pressure-resistant properties, and cold workability such as facility of swaging or bending, and a method of manufacturing the free-cutting copper alloy.

BEST MODE FOR CARRYING OUT THE INVENTION

Figure 1:
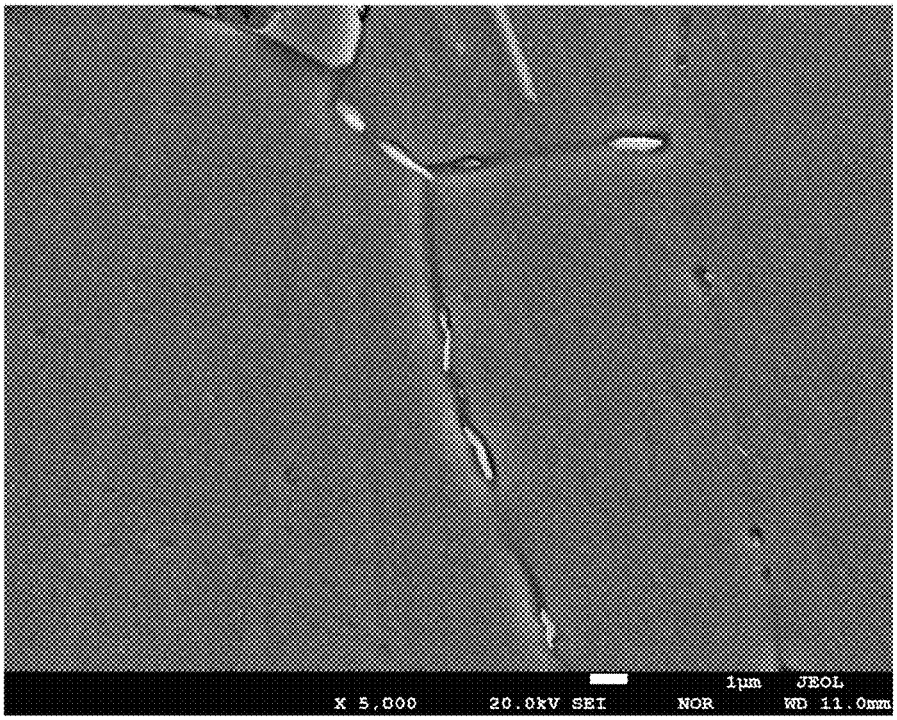
FIG. 1 is an electron micrograph of a metallographic structure of a free-cutting copper alloy (Test No. T05) according to Example 1.

Below is a description of free-cutting copper alloys according to the embodiments of the present invention and the methods of manufacturing the free-cutting copper alloys.

The free-cutting copper alloys according to the embodiments are for use in devices such as faucets, valves, or fittings to supply drinking water consumed by a person or an animal every day, components for electrical uses, automobiles, machines and industrial plumbing such as valves, fittings, or sliding components, or devices, components, pressure vessels, or fittings that come in contact with liquid.

Here, in this specification, an element symbol in parentheses such as [Zn] represents the content (mass %) of the element.

In the embodiment, using this content expressing method, a plurality of composition relational expressions are defined as follows.

Composition Relational Expression $f1=[Cu]+0.8\times[Si]-8.5\times[Sn]+[P]$

Composition Relational Expression $f2=[Cu]-4.6\times[Si]-0.7\times[Sn]-[P]$

Composition Relational Expression $f7=[P]/[Sn]$

Further, in the embodiments, in constituent phases of metallographic structure, an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%. Constituent phases of metallographic structure refer to α phase, γ phase, κ phase, and the like and do not include intermetallic compound, precipitate, non-metallic inclusion, and the like. In addition, κ phase present in α phase is included in the area ratio of α phase. The sum of the area ratios of all the constituent phases is 100%.

In the embodiments, a plurality of metallographic structure relational expressions are defined as follows.

Metallographic Structure Relational Expression $f3=(\alpha)+(\kappa)$

Metallographic Structure Relational Expression $f4=(\alpha)+(\kappa)+(\gamma)+(\mu)$ Metallographic Structure Relational Expression $f5=(\gamma)+(\mu)$ Metallographic Structure Relational Expression $f6=(\kappa)+6\times(\gamma)^{1/2}+0.5\times(\mu)$ A free-cutting copper alloy according to the first embodiment of the present invention includes: 75.4 mass % to 78.7 mass % of Cu; 3.05 mass % to 3.65 mass % of Si; 0.10 mass % to 0.28 mass % of Sn; 0.05 mass % to 0.14 mass % of P; 0.005 mass % or more and less than 0.020 mass % of Pb; and a balance including Zn and inevitable impurities. The composition relational expression f1 is in a range of $76.5\leq f1\leq 80.3$, the composition relational expression f2 is in a range of $60.7\leq f2\leq 62.1$, and the composition relational expression f7 is in a range of $0.25\leq f7\leq 1.0$. The area ratio of κ phase is in a range of $28\leq(\kappa)\leq 67$, the area ratio of γ phase is in a range of $0\leq(\gamma)\leq 1.0$, the area ratio of β phase is in a range of $0\leq(\beta)\leq 0.2$, and the area ratio of μ phase is in a range of $0\leq(\mu)\leq 1.5$. The metallographic structure relational expression f3 is $f3\geq 97.4$, the metallographic structure relational expression f4 is f499.4, the metallographic structure relational expression f5 is in a range of $0\leq f5\leq 2.0$, and the metallographic structure relational expression f6 is in a range of $30\leq f6\leq 70$. The length of the long side of γ phase is 40 μm or less, the length of the long side of μ phase is 25 μm or less, and κ phase is present in α phase.

A free-cutting copper alloy according to the second embodiment of the present invention includes: 75.6 mass % to 77.9 mass % of Cu; 3.12 mass % to 3.45 mass % of Si; 0.12 mass % to 0.27 mass % of Sn; 0.06 mass % to 0.13 mass % of P; 0.006 mass % to 0.018 mass % of Pb; and a balance including Zn and inevitable impurities. The composition relational expression f1 is in a range of $76.8\leq f1\leq 79.3$, the composition relational expression f2 is in a range of $60.8\leq f2\leq 61.9$, and the composition relational expression f7 is in a range of $0.28\leq f7\leq 0.84$. The area ratio of κ phase is in a range of $30\leq(\kappa)\leq 56$, the area ratio of γ phase is in a range of $0\leq(\gamma)\leq 0.5$, the area ratio of β phase is 0, and the area ratio of μ phase is in a range of $0\leq(\mu)\leq 1.0$. The metallographic structure relational expression f3 is $f3\geq 98.5$, the metallographic structure relational expression f4 is $f4\geq 99.6$, the metallographic structure relational expression f5 is in a range of $0\leq f5\leq 1.2$, and the metallographic structure relational expression f6 is in a range of $30\leq f6\leq 58$. The length of the long side of γ phase is 25 μm or less, the length of the long side of μ phase is 15 μm or less, and κ phase is present in α phase.

In addition, the free-cutting copper alloy according to the first embodiment of the present invention may further include one or more element(s) selected from the group consisting of 0.01 mass % to 0.08 mass % of Sb, 0.02 mass % to 0.08 mass % of As, and 0.005 mass % to 0.20 mass % of Bi.

In addition, the free-cutting copper alloy according to the second embodiment of the present invention may further include one or more element(s) selected from the group consisting of 0.012 mass % to 0.07 mass % of Sb, 0.025 mass % to 0.07 mass % of As, and 0.006 mass % to 0.10 mass % of Bi.

In the free-cutting copper alloy according to the first and second embodiments of the present invention, it is preferable that a total amount of Fe, Mn, Co, and Cr as the inevitable impurities is lower than 0.08 mass %.

Further, in the free-cutting copper alloy according to the first and second embodiments of the present invention, it is preferable that the amount of Sn in κ phase is 0.11 mass % to 0.40 mass %, and it is preferable that the amount of P in κ phase is 0.07 mass % to 0.22 mass %.

In addition, in the free-cutting copper alloy according to the first or second embodiment of the present invention, it is preferable that a Charpy impact test value when a U-notched specimen is used is 12 J/cm$^2$ or higher and lower than 50 J/cm$^2$, and it is preferable that a creep strain after holding the copper alloy at 150° C. for 100 hours in a state where 0.2% proof stress (load corresponding to 0.2% proof stress) at room temperature is applied is 0.4% or lower.

Regarding a relation between a tensile strength S (N/mm$^2$), an elongation E (%), a Charpy impact test value I (J/cm$^2$) in the free-cutting copper alloy (hot worked material) having undergone hot working according to the first or second embodiment of the present invention, it is preferable the tensile strength S is 540 N/mm$^2$ or higher, the elongation E is 12% or higher, the Charpy impact test value I (J/cm$^2$) when a U-notched specimen is used is 12 J/cm$^2$ or higher, and the value of $f8=S\times\{(E+100)/100\}^{1/2}$, which is the product of the tensile strength (S) and the value of {(Elongation (E)+100)/100} raised to the power ½, is 660 or higher or $f9=S\times\{(E+100)/100\}^{1/2}+I$, which is the sum of f8 and I, is 685 or higher.

The reason why the component composition, the composition relational expressions f1, f2, and f7 and the metallographic structure, the metallographic structure relational expressions f3, f4, f5, and f6, and the mechanical properties are defined as above is explained below.

<Component Composition>

(Cu)

Cu is a main element of the alloys according to the embodiments. In order to achieve the object of the present invention, it is necessary to add at least 75.4 mass % or higher amount of Cu. When the Cu content is lower than 75.4 mass %, the proportion of γ phase is higher than 1.0% although depending on the contents of Si, Zn, Sn, and Pb and the manufacturing process, corrosion resistance, impact resistance, ductility, normal-temperature strength, and high-temperature property (high temperature creep) deteriorate. In some cases, β phase may also appear. Accordingly, the lower limit of the Cu content is 75.4 mass % or higher, preferably 75.6 mass % or higher, and more preferably 75.8 mass % or higher.

On the other hand, when the Cu content is higher than 78.7 mass %, the effects on corrosion resistance, normal-temperature strength, and high-temperature strength are saturated, and the proportion of κ phase may become excessively high. In addition, μ phase having a high Cu concentration, in some cases, ζ phase and χ phase are more likely to precipitate. As a result, machinability, ductility, impact resistance, and hot workability may deteriorate although depending on the conditions of the metallographic structure. Accordingly, the upper limit of the Cu content is 78.7 mass % or lower, preferably 78.2 mass % or lower, 77.9 mass % or lower if ductility and impact resistance are important, and more preferably 77.6 mass % or lower.

(Si)

Si is an element necessary for obtaining most of excellent properties of the alloy according to the embodiment. Si contributes to the formation of metallic phases such as κ phase, γ phase, or μ phase. Si improves machinability, corrosion resistance, strength, high temperature properties, and wear resistance of the alloy according to the embodiment. In the case of α phase, inclusion of Si does not substantially improve machinability. However, due to α phase such as γ phase, κ phase, or μ phase that is formed by inclusion of Si and is harder than α phase, excellent machinability can be obtained without including a large amount of Pb. However, as the proportion of the metallic phase such as γ phase or μ phase increases, a problem of deterioration in ductility, impact resistance, or cold workability, a problem of deterioration of corrosion resistance in a harsh environment, and a problem in high temperature properties for withstanding long-term use arise. κ phase is useful for improving machinability or strength. However, if the amount of κ phase is excessive, ductility, impact resistance, and workability deteriorates and, in some cases, machinability also deteriorates. Therefore, it is necessary to define κ phase, γ phase, μ phase, and μ phase to be in an appropriate range.

In addition, Si has an effect of significantly suppressing evaporation of Zn during melting or casting. Further, as the Si content increases, the specific gravity can be reduced.

In order to solve these problems of a metallographic structure and to satisfy all the properties, it is necessary to contain 3.05 mass % or higher of Si although depending on the contents of Cu, Zn, Sn, and the like. The lower limit of the Si content is preferably 3.1 mass % or higher, more preferably 3.12 mass % or higher, and still more preferably 3.15 mass % or higher. In particular, when strength is important, the lower limit of the Si content is preferably 3.25 mass % or higher. It may look as if the Si content should be reduced in order to reduce the proportion of γ phase or μ phase having a high Si concentration. However, as a result of a thorough study on a mixing ratio between Si and another element and the manufacturing process, it was found that it is necessary to define the lower limit of the Si content as described above. In addition, although depending on the contents of other elements, the composition relational expressions, and the manufacturing process, once Si content reaches about 2.95 mass %, elongated acicular κ phase starts to appear in α phase, and when the Si content is about 3.05 mass % or higher, the amount of acicular κ phase in α phase increases, and when the Si content is about 3.1 mass % to 3.15 mass %, the amount of acicular κ phase further increases. Due to the presence of κ phase in α phase, machinability, tensile strength, impact resistance, wear resistance, and high temperature properties are improved without deterioration in ductility. Hereinafter, κ phase present in α phase will also be referred to as κ1 phase.

On the other hand, when the Si content is excessively high, the amount of κ phase is excessively large, and the amount of κ1 phase also becomes excessive. When the amount of κ phase is excessive, problems related to ductility, impact resistance, and machinability arise. In addition, when the amount of κ1 phase present in α phase is also excessive, ductility of α phase itself deteriorates, and the ductility of the alloy deteriorates. Therefore, the upper limit of the Si content is 3.65 mass % or lower and preferably 3.55 mass % or lower. In particular, when ductility, impact resistance, or workability of swaging or the like is important, the upper limit of the Si content is preferably 3.45 mass % or lower and more preferably 3.4 mass % or lower.

(Zn)

Zn is a main element of the alloy according to the embodiments together with Cu and Si and is required for improving machinability, corrosion resistance, strength, and castability. Zn is included in the balance, but to be specific, the upper limit of the Zn content is about 21.5 mass % or lower, and the lower limit thereof is about 17.0 mass % or higher.

(Sn)

Sn significantly improves dezincification corrosion resistance, in particular, in a harsh environment and improves stress corrosion cracking resistance, machinability, and wear resistance. In a copper alloy including a plurality of metallic phases (constituent phases), there is a difference in corrosion resistance between the respective metallic phases. Even if the two phases that remain in the metallographic structure are α phase and κ phase, corrosion begins from α phase having lower corrosion resistance and progresses. Sn improves corrosion resistance of α phase having the highest corrosion resistance and improves corrosion resistance of κ phase having the second highest corrosion resistance at the same time. The amount of Sn distributed in κ phase is about 1.4 times the amount of Sn distributed in α phase. That is, the amount of Sn distributed in κ phase is about 1.4 times the amount of Sn distributed in α phase. As the amount of Sn in κ phase is more than α phase, corrosion resistance of κ phase improves more. Because of the larger Sn content in κ phase, there is little difference in corrosion resistance between α phase and κ phase. Alternatively, at least a difference in corrosion resistance between α phase and κ phase is reduced. Therefore, the corrosion resistance of the alloy significantly improves.

However, addition of Sn promotes the formation of γ phase. Sn itself does not particularly have excellent machinability improvement function, but improves the machinability of the alloy by forming γ phase having excellent machinability. On the other hand, γ phase deteriorates alloy corrosion resistance, ductility, impact resistance, cold workability, high-temperature properties, and strength. The amount of Sn distributed in γ phase is about 10 times to 17 times the amount of Sn distributed in α phase. That is, the amount of Sn distributed in γ phase is about 10 times to 17 times the amount of Sn distributed in α phase. γ phase including Sn improves corrosion resistance slightly more than γ phase not including Sn, which is insufficient. This way, addition of Sn to a Cu—Zn—Si alloy promotes the formation of γ phase although the corrosion resistance of κ phase and α phase is improved. Therefore, unless a mixing ratio between the essential elements of Cu, Si, P, and Pb is appropriately adjusted and the metallographic structure is put into an appropriate state by means including adjustment of the manufacturing process, addition of Sn merely slightly improves the corrosion resistance of κ phase and α phase. Instead, an increase in γ phase causes deterioration in alloy corrosion resistance, ductility, impact resistance, high temperature properties, and tensile strength. In addition, when κ phase contains Sn, its machinability improves. This effect is further improved by addition of P together with Sn.

By performing a control of a metallographic structure including the relational expressions and the manufacturing process described below, a copper alloy having excellent properties can be prepared. In order to exhibit the above-described effect, the lower limit of the Sn content needs to be 0.10 mass % or higher, preferably 0.12 mass % or higher, and more preferably 0.15 mass % or higher.

On the other hand, when the Sn content is higher than 0.28 mass %, the proportion of γ phase increases. As a countermeasure, it is necessary to increase Cu concentration, but doing so would lead to an increase in κ phase, and as a result, good impact resistance may not be obtained because of the increase in κ phase. The upper limit of the Sn content is 0.28 mass % or lower, preferably 0.27 mass % or lower, and more preferably 0.25 mass % or lower.

(Pb)

Inclusion of Pb improves the machinability of the copper alloy. About 0.003 mass % of Pb is solid-solubilized in the matrix, and the amount of Pb in excess of 0.003 mass % is present in the form of Pb particles having a diameter of about 1 μm. Pb has an effect of improving machinability even with a small amount of inclusion. In particular, when the Pb content is 0.005 mass % or higher, a significant effect starts to be exhibited. In the alloy according to the embodiment, the proportion of γ phase having excellent machinability is limited to be 1.0% or lower. Therefore, even a small amount of Pb can be replacement for γ phase. The lower limit of the Pb content is preferably 0.006 mass % or higher.

On the other hand, Pb is harmful to a human body and affects impact resistance, high temperature properties, cold workability, and tensile strength although such influence can vary depending on the components and the metallographic structure of the alloy. Therefore, the upper limit of the Pb content is lower than 0.020 mass % and preferably 0.018 mass % or lower.

(P)

As in the case of Sn, P significantly improves corrosion resistance, in particular, in a harsh environment.

As in the case of Sn, the amount of P distributed in κ phase is about 2 times the amount of P distributed in α phase. That is, the amount of P distributed in κ phase is about 2 times the amount of P distributed in α phase. In addition, p has a significant effect of improving the corrosion resistance of α phase. However, when P is added alone, the effect of improving the corrosion resistance of κ phase is low. However, in cases where P is present together with Sn, the corrosion resistance of κ phase can be improved. P scarcely improves the corrosion resistance of γ phase. In addition, P contained in κ phase slightly improves the machinability of κ phase. By adding P together with Sn, machinability can be more effectively improved.

In order to exhibit the above-described effects, the lower limit of the P content is 0.05 mass % or higher, preferably 0.06 mass % or higher, and more preferably 0.07 mass % or higher.

On the other hand, in cases where the P content is higher than 0.14 mass %, the effect of improving corrosion resistance is saturated. In addition, a compound of P and Si is more likely to be formed, impact resistance, ductility, and cold workability deteriorate, and machinability also deteriorates instead of improves. Therefore, the upper limit of the P content is 0.14 mass % or lower, preferably 0.13 mass % or lower, and more preferably 0.12 mass % or lower.

(Sb, As, Bi)

As in the case of P and Sn, Sb and As significantly improve dezincification corrosion resistance, in particular, in a harsh environment.

In order to improve corrosion resistance due to inclusion of Sb, it is necessary to contain 0.01 mass % or higher of Sb, and it is preferable to contain 0.012 mass % or higher of Sb. On the other hand, even when the Sb content exceeds 0.08 mass %, the effect of improving corrosion resistance is saturated, and the proportion of γ phase increases instead. Therefore, Sb content is 0.08 mass % or lower and preferably 0.07 mass % or lower.

In order to improve corrosion resistance due to inclusion of As, it is necessary to contain 0.02 mass % or higher of As, and it is preferable to contain 0.025 mass % or higher of As. On the other hand, even when the As content exceeds 0.08 mass %, the effect of improving corrosion resistance is saturated. Therefore, the As content is 0.08 mass % or lower and preferably 0.07 mass % or lower.

By containing Sb alone, the corrosion resistance of α phase is improved. Sb is a metal of low melting point although it has a higher melting point than Sn, and exhibits similar behavior to Sn. The amount of Sb distributed in γ phase or κ phase is larger than the amount of Sb distributed in α phase. By adding Sb and Sn together, Sb has an effect of improving the corrosion resistance of κ phase. However, regardless of whether Sb is contained alone or contained together with Sn and P, the effect of improving the corrosion resistance of γ phase is low. Rather, inclusion of an excess amount of Sb may increase the proportion of γ phase.

Among Sn, P, Sb, and As, As strengthens the corrosion resistance of α phase. Even when κ phase is corroded, the corrosion resistance of α phase is improved, and thus As functions to prevent α phase from corroding in a chain reaction. However, As has a small effect of improving the corrosion resistance of κ phase and γ phase.

When both Sb and As are contained, even when the total content of Sb and As is higher than 0.10 mass %, the effect of improving corrosion resistance is saturated, and ductility, impact resistance, and cold workability deteriorate. Therefore, the total content of Sb and As is preferably 0.10 mass % or lower.

Bi further improves the machinability of the copper alloy. For Bi to exhibits the effect, it is necessary to contain 0.005 mass % or higher of Bi, and it is preferable to contain 0.006 mass % or higher of Bi. On the other hand, whether Bi is harmful to human body is uncertain. However, considering the influence on impact resistance, high temperature properties, hot workability, and cold workability, the upper limit of the Bi content is 0.20 mass % or lower, preferably 0.15 mass % or lower, and more preferably 0.10 mass % or lower.

(Inevitable Impurities)

Examples of the inevitable impurities in the embodiment include Al, Ni, Mg, Se, Te, Fe, Mn, Co, Ca, Zr, Cr, Ti, In, W, Mo, B, Ag, and rare earth elements.

Conventionally, a free-cutting copper alloy is not mainly formed of a good-quality raw material such as electrolytic copper or electrolytic zinc but is mainly formed of a recycled copper alloy. In a subsequent step (downstream step, machining step) of the related art, almost all the members and components are machined, and a large amount of copper alloy is wasted at a proportion of 40 to 80%. Examples of the wasted copper alloy include chips, ends of an alloy material, burrs, runners, and products having manufacturing defects. This wasted copper alloy is the main raw material. If chips and the like are insufficiently separated, alloy becomes contaminated by Pb, Fe, Mn, Se, Te, Sn, P, Sb, As, Bi, Ca, Al, B, Zr, Ni, or rare earth elements of other free-cutting copper alloys. In addition, the chips include Fe, W, Co, Mo, and the like that originate in tools. The wasted materials include plated product, and thus are contaminated with Ni, Cr, and Sn. Mg, Fe, Cr, Ti, Co, In, Ni, Se, and Te are mixed into pure copper-based scrap. From the viewpoints of reuse of resources and costs, scrap such as chips including these elements is used as a raw material to the extent that such use does not have any adverse effects to the properties at least.

Empirically speaking, a large part of Ni that is mixed into the alloy comes from a scrap and the like, and Ni may be contained in an amount lower than 0.06 mass %, but it is preferable if the content is lower than 0.05 mass %.

Fe, Mn, Co, or Cr forms an intermetallic compound with Si and, in some cases, forms an intermetallic compound with P and affect machinability, corrosion resistance, and other properties. Although depending on the content of Cu, Si, Sn, or P and the relational expression f1 or f2, Fe is likely to combine with Si, and inclusion of Fe may consume the same amount of Si as that of Fe and promotes the formation of a Fe—Si compound that adversely affects machinability. Therefore, the amount of each of Fe, Mn, Co, and Cr is preferably 0.05 mass % or lower and more preferably 0.04 mass % or lower. The total content of Fe, Mn, Co, and Cr is preferably lower than 0.08 mass %, more preferably lower than 0.07 mass %, and still more preferably lower than 0.06 mass % if possible in terms of raw material procurement.

On the other hand, it is not necessary to particularly limit the content of Ag because, in general, Ag can be considered as Cu and does not substantially affect various properties. However, the Ag content is preferably lower than 0.05 mass %.

Te and Se themselves have free-cutting nature, and can be mixed into an alloy in a large amount although it is rare. In consideration of influence on ductility or impact resistance, the content of each of Te and Se is preferably lower than 0.03 mass % and more preferably lower than 0.02 mass %.

The amount of each of Al, Mg, Ca, Zr, Ti, In, W, Mo, B, and rare earth elements as other elements is preferably lower than 0.03 mass %, more preferably lower than 0.02 mass %, and still more preferably lower than 0.01 mass %.

The amount of the rare earth elements refers to the total amount of one or more of Sc, Y, La, Ce, Pr, Nd, Pm, Sm, Eu, Gd, Tb, Dy, Ho, Er, Tm, Tb, and Lu.

It is desirable to manage and limit the amount of the impurity elements (inevitable impurities) in consideration of influence on the properties of the alloy according to the embodiment.

(Composition Relational Expression f1)

The composition relational expression f1 is an expression indicating a relation between the composition and the metallographic structure. Even if the amount of each of the elements is in the above-described defined range, unless this composition relational expression f1 is satisfied, the properties that the embodiment targets cannot be obtained. In the composition relational expression f1, a large coefficient of −8.5 is assigned to Sn. When the value of the composition relational expression f1 is lower than 76.5, the proportion of γ phase increases regardless of any adjustment to the manufacturing process, and β phase appears in some cases. In addition, the long side of γ phase increases, and corrosion resistance, ductility, impact resistance, and high temperature properties deteriorate. Accordingly, the lower limit of the composition relational expression f1 is 76.5 or higher, preferably 76.8 or higher, and more preferably 77.0 or higher. The more preferable the value of the composition relational expression f1 is, the smaller the area ratio of γ phase is. Even when γ phase is present, γ phase tends to break, and corrosion resistance, ductility, impact resistance, normal-temperature strength, and high temperature properties are further improved.

On the other hand, the upper limit of the composition relational expression f1 mainly affects the proportion of κ phase. When the value of the composition relational expression f1 is higher than 80.3, the proportion of κ phase is excessively high from the viewpoints of ductility and impact resistance. In addition, μ phase is more likely to precipitate. When the proportion of κ phase or μ phase is excessively high, ductility, impact resistance, cold workability, high temperature properties, hot workability, corrosion resistance, and machinability deteriorate. Accordingly, the upper limit of the composition relational expression f1 is 80.3 or lower, preferably 79.6 or lower, more preferably 79.3 or lower, and still more preferably 78.9 or lower.

This way, by defining the composition relational expression f1 to be in the above-described range, a copper alloy having excellent properties can be obtained. As, Sb, and Bi that are selective elements and the inevitable impurities that are separately defined scarcely affect the composition relational expression f1 because the contents thereof are low, and thus are not defined in the composition relational expression f1.

(Composition Relational Expression f2)

The composition relational expression f2 is an expression indicating a relation between the composition and workability, various properties, and the metallographic structure. When the value of the composition relational expression f2 is lower than 60.7, the proportion of γ phase in the metallographic structure increases, and other metallic phases including β phase are more likely to appear and remain. Therefore, corrosion resistance, ductility, impact resistance, cold workability, and high temperature properties deteriorate. In addition, during hot forging, crystal grains are coarsened, and cracking is more likely to occur. Accordingly, the lower limit of the composition relational expression f2 is 60.7 or higher, preferably 60.8 or higher, and more preferably 61.0 or higher.

On the other hand, when the value of the composition relational expression f2 exceeds 62.1, hot deformation resistance is improved, hot deformability deteriorates, and surface cracking may occur in a hot extruded material or a hot forged product. Partly depending on the hot working ratio or the extrusion ratio, it is difficult to perform hot working such as hot extrusion or hot forging, for example, at about 630° C. (material's temperature immediately after hot working). In addition, coarse α phase having a length of more than 1000 μm and a width of more than 200 μm in a direction parallel to a hot working direction is more likely to appear in a metallographic structure. When coarse α phase is present, machinability deteriorates, the length of the long side of γ phase present at a boundary between a phase and κ phase increases. Further, κ1 phase is not likely to appear in α phase, and strength and wear resistance deteriorate. In addition, the range of solidification temperature, that is, (liquidus temperature-solidus temperature) exceeds 50° C., shrinkage cavities during casting are significant, and sound casting cannot be obtained. Accordingly, the upper limit of the composition relational expression f2 is 62.1 or lower, preferably 61.9 or lower, and more preferably 61.7 or lower.

This way, by defining the composition relational expression f2 to be in the above-described narrow range, a copper alloy having excellent properties can be manufactured with a high yield. As, Sb, and Bi that are selective elements and the inevitable impurities that are separately defined scarcely affect the composition relational expression f2 because the contents thereof are low, and thus are not defined in the composition relational expression f2.

(Composition Relational Expression f7)

The composition relational expression f7 particularly relates to corrosion resistance. When 0.05 to 0.14 mass % of P and 0.10 to 0.28 mass % of Sn are added to the Cu—Zn—Si alloy such that [P]/[Sn] is 0.25 to 1.0 by mass concentration ratio and is about 1 to about 4 by atomic concentration ratio, that is, one to four P atoms are present with respect to one Sn atom, the dezincification corrosion resistance of α phase and κ phase is improved. When [P]/[Sn] is lower than 0.25, the improvement of corrosion resistance is small, high temperature properties deteriorate, and the effect on machinability decreases. [P]/[Sn] is more preferably 0.28 or higher and still more preferably 0.32 or higher. On the other hand, when [P]/[Sn] exceeds 1.0, not only the effect on dezincification corrosion resistance but also ductility becomes poor, and impact resistance deteriorates. [P]/[Sn] is preferably 0.84 or lower and more preferably 0.64 or lower.

(Comparison to Patent Documents)

Here, the results of comparing the compositions of the Cu—Zn—Si alloys described in Patent Documents 3 to 12 and the composition of the alloy according to the embodiment are shown in Table 1.

The embodiment and Patent Document 3 are different from each other in the contents of Pb and Sn which is a selective element. The embodiment and Patent Document 4 are different from each other in the contents of Pb and Sn which is a selective element. The embodiment and Patent Documents 6 and 7 are different from each other as to whether or not Zr is contained. The embodiment and Patent Document 8 are different from each other as to whether or not Fe is contained. The embodiment and Patent Document 9 are different from each other as to whether or not Pb is contained and also whether or not Fe, Ni, and Mn are contained. The embodiment and Patent Document 10 are different from each other as to whether or not Sn, P, and Pb are contained.

As described above, the alloy according to the embodiment and the Cu—Zn—Si alloys described in Patent Documents 3 to 9 excluding Patent Document 5 are different from each other in the composition ranges. Patent Document 5 is silent about strength, machinability, κ1 phase present in α phase contributing to wear resistance, f2, and f7, and the strength balance is also low. Patent Document 11 relates to brazing in which heating is performed at 700° C. or higher, and relates to a brazed structure. Patent Document 12 relates to a material that is to be rolled for producing a threaded bolt or a gear.

TABLE 1

| | Cu | Si | Sn | P | Pb | Other Essential Elements |
|---|---|---|---|---|---|---|
| First Embodiment | 75.4-78.7 | 3.05-3.65 | 0.10-0.28 | 0.05-0.14 | 0.005-less than 0.020 | — |
| Second Embodiment | 75.6-77.9 | 3.12-3.45 | 0.12-0.27 | 0.06-0.13 | 0.006-0.018 | — |
| Patent Document 3 | 69-79 | 2.0-4.0 | 0.3-3.5 | 0.02-0.25 | — | — |
| Patent Document 4 | 69-79 | 2.0-4.0 | 0.3-3.5 | 0.02-0.25 | 0.02-0.4 | — |
| Patent Document 5 | 71.5-78.5 | 2.0-4.5 | 0.1-1.2 | 0.01-0.2 | 0.005-0.02 | — |
| Patent Document 6 | 69-88 | 2-5 | 0.1-2.5 | 0.01-0.25 | 0.004-0.45 | Zr:0.0005-0.04 |
| Patent Document 7 | 69-88 | 2-5 | 0.05-1.5 | 0.01-0.25 | 0.005-0.45 | Zr:0.0005-0.04 |
| Patent Document 8 | 74.5-76.5 | 3.0-3.5 | 0.05-0.2 | 0.04-0.10 | 0.01-0.25 | Fe:0.11-0.2 |
| Patent Document 9 | 70-83 | 1-5 | 0.01-2 | 0.1 or less | — | Fe,Co:0.01-0.3 Ni:0.01-0.3 Mn:0.01-0.3 |
| Patent Document 10 | — | 0.25-3.0 | — | — | — | — |
| Patent Document 11 | 73.0-79.5 | 2.5-4.0 | 0.03-1.0 | 0.015-0.2 | 0.003-0.25 | — |
| Patent Document 12 | 70-83 | 1-5 | 0.01-2 | — | 0.006-0.018 | — |

<Metallographic Structure>

In Cu—Zn—Si alloys, 10 or more kinds of phases are present, complicated phase change occurs, and desired properties cannot be necessarily obtained simply by defining the composition ranges and relational expressions of the elements. By specifying and determining the kinds of metallic phases that are present in a metallographic structure and the ranges thereof, desired properties can finally be obtained.

In the case of Cu—Zn—Si alloys including a plurality of metallic phases, the corrosion resistance level varies between phases. Corrosion begins and progresses from a phase having the lowest corrosion resistance, that is, a phase that is most prone to corrosion, or from a boundary between a phase having low corrosion resistance and a phase adjacent to such phase. In the case of Cu—Zn—Si alloys including three elements of Cu, Zn, and Si, for example, when corrosion resistances of α phase, α' phase, β phase (including (β' phase), κ phase, γ phase (including γ' phase), and μ phase are compared, the ranking of corrosion resistance is: α phase>α' phase>κ phase>μ phase≥γ phase>β phase. The difference in corrosion resistance between κ phase and μ phase is particularly large.

Compositions of the respective phases vary depending on the composition of the alloy and the area ratios of the respective phases, and the following can be said.

Si concentration of each phase is higher in the following order: μ phase>γ phase>κ phase>α phase>α' phase≥β phase. The Si concentrations in μ phase, γ phase, and κ phase are higher than the Si concentration in the alloy. In addition, the Si concentration in μ phase is about 2.5 times to about 3 times the Si concentration in α phase, and the Si concentration in γ phase is about 2 times to about 2.5 times the Si concentration in α phase.

Cu concentration is higher in the following order: μ phase>κ phase≥α phase>α' phase≥γ phase>β phase. The Cu concentration in μ phase is higher than the Cu concentration in the alloy.

In the Cu—Zn—Si alloys described in Patent Documents 3 to 6, a large part of γ phase, which has the highest machinability-improving function, is present together with α' phase or is present at a boundary between κ phase and α phase. When used in water that is bad for copper alloys or in an environment that is harsh for copper alloys, γ phase becomes a source of selective corrosion (origin of corrosion) such that corrosion progresses. Of course, when β phase is present, β phase starts to corrode before γ phase. When μ phase and γ phase are present together, μ phase starts to corrode slightly later than or at the same time as γ phase. For example, when α phase, κ phase, γ phase, and μ phase are present together, if dezincification corrosion selectively occurs in γ phase or μ phase, the corroded γ phase or μ phase becomes a corrosion product (patina) that is rich in Cu due to dezincification. This corrosion product causes κ phase or α' phase adjacent thereto to be corroded, and corrosion progresses in a chain reaction.

The water quality of drinking water varies across the world including Japan, and this water quality is becoming one where corrosion is more likely to occur to copper alloys. For example, the concentration of residual chlorine used for disinfection for the safety of human body is increasing although the upper limit of chlorine level is regulated. That is to say, the environment where copper alloys that compose water supply devices are used is becoming one in which alloys are more likely to be corroded. The same is true of corrosion resistance in a use environment where a variety of solutions are present, for example, those where component materials for automobiles, machines, and industrial plumbing described above are used.

On the other hand, even if the amount of γ phase, or the amounts of γ phase, μ phase, and β phase are controlled, that is, the proportions of the respective phases are significantly reduced or are made to be zero, the corrosion resistance of a Cu—Zn—Si alloy including three phases of α phase, α' phase, and κ phase is not perfect. Depending on the environment where corrosion occurs, κ phase having lower corrosion resistance than α phase may be selectively corroded, and it is necessary to improve the corrosion resistance of κ phase. Further, in cases where κ phase is corroded, the corroded κ phase becomes a corrosion product that is rich in Cu. This corrosion product causes α phase to be corroded, and thus it is also necessary to improve the corrosion resistance of α phase.

In addition, γ phase is a hard and brittle phase. Therefore, when a large load is applied to a copper alloy member, the γ phase microscopically becomes a stress concentration source. γ phase is mainly present in an elongated shape at an α-κ phase boundary (phase boundary between α phase and κ phase) or a grain boundary. γ phase becomes a stress concentration source and thus has a huge effect of making a point where chip parting begins, promoting chip parting, and reducing cutting resistance during cutting. On the other hand, γ phase becomes the stress concentration source such that ductility, cold workability, or impact resistance deteriorates and tensile strength deteriorates due to deterioration in ductility. Further, high temperature creep strength deteriorates due to a high-temperature creep phenomenon. μ phase is mainly present at a grain boundary of α phase or at a phase boundary between α phase and κ phase. Therefore, as in the case of γ phase, μ phase microscopically becomes a stress concentration source. Due to being a stress concentration source or a grain boundary sliding phenomenon, μ phase makes the alloy more vulnerable to stress corrosion cracking, deteriorates impact resistance, and deteriorates ductility, cold workability, and strength under normal temperature and high temperature. As in the case of γ phase, μ phase has an effect of improving machinability, and this effect is much smaller than that of γ phase.

However, if the proportion of γ phase or the proportions of γ phase and μ phase are significantly reduced or are made to be zero in order to improve corrosion resistance and the above-mentioned properties, satisfactory machinability may not be obtained merely by containing a small amount of Pb and three phases of α phase, α' phase, and κ phase. Therefore, providing that the alloy with a tiny amount of Pb has excellent machinability, it is necessary to define the constituent phases of a metallographic structure (metallic phases or crystalline phases) as follows in order to improve corrosion resistance, ductility, impact resistance, strength, and high-temperature properties in a harsh use environment.

Hereinafter, the unit of the proportion of each of the phases is area ratio (area %).

(γ Phase)

γ phase is a phase that contributes most to the machinability of Cu—Zn—Si alloys. In order to improve corrosion resistance, normal-temperature strength, high temperature properties, ductility, cold workability, and impact resistance in a harsh environment, it is necessary to limit γ phase. In order to improve corrosion resistance, it is necessary to add Sn, and addition of Sn further increases the proportion of γ phase. In order to obtain sufficient machinability and corrosion resistance at the same time when Sn has such contradicting effects, the Sn content, the P content, the composition relational expressions f1, f2, and f7, metallographic structure relational expressions described below, and the manufacturing process are limited.

(β Phase and Other Phases)

In order to obtain excellent corrosion resistance and high ductility, impact resistance, strength, and high-temperature strength, the proportions of β phase, γ phase, μ phase, and other phases such as ζ phase in a metallographic structure are particularly important.

The proportion of β phase needs to be at least 0.2% or lower and is preferably 0.1% or lower, and it is most preferable that β phase is not present.

The proportion of phases such as ζ phase other than α phase, κ phase, β phase, γ phase, and μ phase is preferably 0.3% or lower and more preferably 0.1% or lower. It is most preferable that the other phases such as ζ phase are not present.

First, in order to obtain excellent corrosion resistance, the proportion of γ phase needs to be 0% to 1.0% and the length of the long side of γ phase needs to be 40 μm or less.

The length of the long side of γ phase is measured using the following method. Using mainly a 500-fold or 1000-fold metallographic micrograph, the maximum length of the long side of γ phase is measured in one visual field. This operation is performed in arbitrarily chosen five visual fields as described below. The average maximum length of the long side of γ phase calculated from the lengths measured in the respective visual fields is regarded as the length of the long side of γ phase. Therefore, the length of the long side of γ phase can be referred to as the maximum length of the long side of γ phase.

As the proportion of γ phase increases, not only corrosion resistance but also strength, ductility, cold workability, impact resistance, and high temperature properties deteriorate. Considering the importance of these properties, and in order to improve them, the proportion of γ phase is 1.0% or lower, preferably 0.8% or lower, and more preferably 0.5% or lower, and it is most preferable γ phase is not sufficiently observed with a 500-fold microscope, that is, the proportion of γ phase is 0% in effect.

Since the length of the long side of γ phase affects corrosion resistance, the length of the long side of γ phase is 40 μm or less, preferably 25 μm or less, more preferably 10 μm or less, and most preferably 5 μm or less. γ phase that can be clearly recognized with a 500-fold microscope is γ phase having a long side with a length of about 2 μm or more.

The larger the amount of γ phase is, the more likely γ phase is selectively corroded, and the longer the series of γ phase is, the more likely γ phase is selectively corroded and the progress of corrosion in the direction away from the surface is accelerated. In addition, the larger the corroded portion is, the more affected the corrosion resistance of α' phase and κ phase or α phase present around the corroded γ phase is.

On the other hand, regarding machinability, the presence of γ phase is the most effective improver of machinability of the copper alloy according to the embodiment. However, γ phase needs to be eliminated if possible due to various problems that γ phase has, and κ1 phase described below can be replacement for γ phase. In addition, increasing the Sn concentration and the P concentration in κ phase are also effective.

The proportion of γ phase and the length of the long side of γ phase are closely related to the contents of Cu, Sn, and Si and the composition relational expressions f1 and f2.

(μ Phase)

μ phase is effective to improve machinability and affects corrosion resistance, ductility, cold workability, impact resistance, normal-temperature tensile strength, and high temperature properties. Therefore, it is necessary that the proportion of β phase is at least 0% to 1.5%. The proportion of β phase is preferably 1.0% or lower and more preferably 0.3% or lower, and it is most preferable that μ phase is not present. β phase is mainly present at a grain boundary or a phase boundary. Therefore, in a harsh environment, grain boundary corrosion occurs at a grain boundary where μ phase is present. In addition, when impact is applied, cracks are more likely to develop from μ phase present at a grain boundary. In addition, for example, when a copper alloy is used in a valve used around the engine of a vehicle or in a high-pressure gas valve, if the copper alloy is held at a high temperature of 150° C. for a long period of time, grain boundary sliding occurs, and creep is more likely to occur. Therefore, it is necessary to limit the amount of μ phase, and at the same time limit the length of the long side of μ phase that is mainly present at a grain boundary to 25 μm or less. The length of the long side of μ phase is preferably 15 μm or less, more preferably 5 μm or less, still more preferably 4 μm or less, and most preferably 2 μm or less.

The length of the long side of μ phase is measured using the same method as the method of measuring the length of the long side of γ phase. That is, by basically using a 500-fold metallographic micrograph, but where appropriate, using a 1000-fold metallographic micrograph, or a 2000-fold or 5000-fold secondary electron micrograph (electron micrograph) according to the size of μ phase, the maximum length of the long side of μ phase in one visual field is measured. This operation is performed in arbitrarily chosen five visual fields. The average maximum length of the long sides of μ phase calculated from the lengths measured in the respective visual fields is regarded as the length of the long side of μ phase. Therefore, the length of the long side of μ phase can be referred to as the maximum length of the long side of μ phase.

(κ Phase)

Under recent high-speed machining conditions, the machinability of a material including cutting resistance and chip dischargeability is important. However, in order to obtain excellent machinability in a state where the proportion of γ phase having the highest machinability-improvement function is limited to be 1.0% or lower and the Pb content having an excellent machinability-improvement function is limited to be lower than 0.02 mass %, the proportion of κ phase needs to be at least 28% or higher. The proportion of κ phase is preferably 30% or higher, more preferably 32% or higher, and most preferably 34% or higher. The tensile strength and high-temperature strength under normal temperature increase as the proportion of κ phase increases. In addition, when the proportion of κ phase is the necessary minimum amount for obtaining satisfactory machinability, the material exhibits excellent ductility, impact resistance, and corrosion resistance.

κ phase is less brittle, is richer in ductility, and has higher corrosion resistance than γ phase, μ phase, and β phase. γ phase and μ phase are present along a grain boundary or a phase boundary of α phase, but this tendency is not shown in κ phase. In addition, strength, machinability, wear resistance, and high temperature properties are higher than α phase.

As the proportion of κ phase increases, machinability is improved, tensile strength and high-temperature strength are high, and wear resistance is improved. However, on the other hand, as the proportion of κ phase increases, ductility, cold workability, or impact resistance gradually deteriorates. When the proportion of κ phase reaches a given amount, specifically, about 50%, the effect of improving machinability is also saturated, and as the proportion of κ phase further increases, machinability deteriorate instead. In addition, when the proportion of κ phase reaches a given amount, the hardness index increases, but the improvement of tensile strength is saturated and cold workability and hot workability deteriorate along with deterioration in ductility. In consideration of deterioration in ductility or impact resistance and improvement of strength and machinability, the proportion of κ phase needs to be 67% or lower, which is about ⅔ or less. That is, by allowing about ⅓ or more of soft α phase, which is rich in ductility, and about ⅔ or less of κ phase to be present together, excellent properties of κ phase can be utilized. The proportion of κ phase is preferably 60% or lower and more preferably 56% or lower and, when ductility, impact resistance, and workability are important, the proportion is 50% or lower.

In order to obtain excellent machinability in a state where the area ratio of γ phase is limited to be 1.0% or lower and the Pb content is limited to be lower than 0.02 mass %, it is necessary to improve the machinability of κ phase and α phase themselves. That is, the machinability of κ phase is improved by containing Sn and P in κ phase. Further, by making acicular κ phase (κ1 phase) to be present in α phase, the machinability of α phase is improved, and the machinability of the alloy is improved with little deterioration in ductility. It is most preferable that the proportion of κ phase in the metallographic structure is about 32% to about 56% from the viewpoints of obtaining ductility, cold workability, strength, impact resistance, corrosion resistance, high temperature properties, machinability, and wear resistance with a good balance.

(Presence of Elongated Acicular κ Phase (κ1 phase) in a Phase)

When the above-described requirements of the composition, the composition relational expressions f1 and f2, and the process are satisfied, acicular κ phase starts to appear in α phase. This κ phase is harder than α phase. The thickness of κ phase (κ1 phase) present in α phase is about 0.1 μm to about 0.2 μm (about 0.05 μm to about 0.5 μm), and this κ phase (κ1 phase) is thin, elongated, and acicular. Due to the presence of acicular κ1 phase in α phase, the following effects are obtained.

1) α phase is strengthened, and the tensile strength of the alloy is improved.

2) The machinability of α phase is improved, and the machinability improvement of the alloy such as decrease in cutting resistance or improvement of chip partibility can be achieved.

3) Since the κ1 phase is present in α phase, there is no bad influence on the corrosion resistance of the alloy.

4) α phase is strengthened, and the wear resistance of the alloy is improved.

5) Since the κ1 phase is present in α phase, there is a small influence on ductility and impact resistance.

The acicular κ phase present in α phase is affected by a constituent element such as Cu, Zn, or Si or a relational expression. When the requirements of the composition and the metallographic structure of the embodiment are satisfied, if the amount of Si is about 2.95 mass % or higher, acicular κ1 phase starts to be present in α phase. When the amount of Si is about 3.05 mass % or higher and is clearly about 3.12 mass % or higher, κ1 phase becomes more clearly present in α phase. In addition, the presence of κ1 phase is affected by the relational expression of the composition. For example, when the value of the composition relational expression f2 is 61.9 or lower and is further 61.7 or lower, κ1 phase is more likely to be present.

As the proportion of κ1 phase in α phase increases, that is, the amount of κ1 phase excessively increases, the ductility and impact resistance of α phase deteriorate. The amount of κ1 phase in α phase is proportionate mainly to the proportion of κ phase in the metallographic structure, and is also affected by the contents of Cu, Si, and Zn and the relational expression f2. When the amount of κ phase exceeds 67%, the amount of κ1 phase present in α phase is excessively large. From the viewpoint of obtaining an appropriate amount of κ1 phase present in α phase, the amount of κ phase in the metallographic structure is preferably 67% or lower and more preferably 60% or lower and, when ductility, cold workability, or impact resistance is important, is preferably 56% or lower and more preferably 50% or lower.

κ1 phase present in α phase can be recognized as an elongated linear material or acicular material when enlarged with a metallographic microscope at a magnification of 500-fold, in some cases, about 1000-fold. However, since it is difficult to calculate the area ratio of κ1 phase, it should be noted that the area ratio of κ1 phase in α phase is included in the area ratio of α phase.

(Metallographic Structure Relational Expressions f3, f4, f5, and f6)

In order to obtain excellent corrosion resistance, ductility, impact resistance, and high temperature properties, the total proportion of α phase and κ phase (metallographic structure relational expression f3=(α)+(κ)) needs to be 97.4% or higher. The value of f3 is preferably 98.5% or higher and more preferably 99.0% or higher. Likewise, the total proportion of α phase, κ phase, γ phase, and μ phase (metallographic structure relational expression f4=(α)+(κ)+(γ)+(μ)) is 99.4% or higher and preferably 99.6% or higher.

Further, the total proportion of γ phase and μ phase (f5=(γ)+(μ)) is 0% to 2.0%. The value of f5 is preferably 1.2% or lower and more preferably 0.6% or lower.

The metallographic structure relational expressions f3 to f6 are directed to 10 kinds of metallic phases including α phase, β phase, γ phase, δ phase, ε phase, ζ phase, η phase, κ phase, μ phase, and χ phase, and are not directed to intermetallic compounds, Pb particles, oxides, non-metallic inclusion, non-melted materials, and the like. In addition, acicular κ phase (κ1 phase) present in α phase is included in α phase, and μ phase that cannot be observed with a 500-fold or 1000-fold metallographic microscope is excluded. Intermetallic compounds that are formed by Si, P, and elements that are inevitably mixed in (for example, Fe, Co, and Mn) are excluded from the area ratio of a metallic phase. However, these intermetallic compounds affect machinability, and thus it is necessary to pay attention to the inevitable impurities.

(Metallographic Structure Relational Expression f6)

In the alloy according to the embodiment, it is necessary that machinability is excellent while minimizing the Pb content in the Cu—Zn—Si alloy, and it is necessary that the alloy has particularly excellent corrosion resistance, impact resistance, ductility, cold workability, normal-temperature strength, and high-temperature strength. However, the effect of γ phase on machinability is contradictory to that on corrosion resistance or impact resistance.

Metallographically, it is preferable to contain a large amount of γ phase having the highest machinability. However, from the viewpoints of corrosion resistance, impact resistance, and other properties, it is necessary to reduce the amount of γ phase. It was found from experiment results that, when the proportion of γ phase is 1.0% or lower, it is necessary that the value of the metallographic structure relational expression f6 is in an appropriate range in order to obtain excellent machinability.

Since γ phase has the highest machinability, a high coefficient that is six times the proportion of κ phase ((κ)) is assigned to the square root value of the proportion of γ phase ((γ) (%)) in the metallographic structure relational expression f6 relating to machinability. As described above, even a small amount of γ phase has a large effect of improving chip partibility or reducing cutting resistance. On the other hand, the coefficient of κ phase is 1. κ phase forms a metallographic structure with α phase and exhibits the effect according to the proportion without being unevenly distributed in a phase boundary like γ phase or μ phase. The coefficient of μ phase is 0.5, and the effect of improving machinability is small. Other phases such as β phase has little effect of improving machinability and functions negatively in some cases. However, in the embodiment, β phase is scarcely present and thus is not included in f6. In order to obtain excellent machinability, the value of the metallographic structure relational expression f6 needs to be 30 or higher. The value of f6 is preferably 32 or higher and more preferably 34 or higher.

On the other hand, when the metallographic structure relational expression f6 exceeds 70, machinability conversely deteriorates, and deterioration in impact resistance and ductility becomes significant. Therefore, the metallographic structure relational expression f6 needs to be 70 or lower. The value of f6 is preferably 62 or lower and more preferably 58 or lower. By allowing κ phase to be present together with soft α phase, the effect of improving the machinability of κ phase is exhibited. However, if the proportion of γ phase or the Pb content is significantly limited, when the proportion of κ phase is about 50%, the effect of improving chip partibility and the effect of reducing cutting resistance are saturated. Further, as the amount of κ phase increases, the effects gradually deteriorate. That is, even when the proportion of κ phase excessively increases, a component ratio or a mixed state between κ phase and soft α phase deteriorates such that chip partibility deteriorates. When the proportion of κ phase exceeds about 50%, the influence of κ phase having high strength is strengthened, and the cutting resistance gradually increases.

(Amounts of Sn and P in κ phase)

In order to improve the corrosion resistance of κ phase, it is preferable if the alloy contains 0.10 mass % to 0.28 mass % of Sn and 0.05 mass % to 0.14 mass % of P.

In the alloy according to the embodiment, when the Sn content is 0.10 to 0.28 mass % and the amount of Sn distributed in α phase is 1, the amount of Sn distributed in κ phase is about 1.4, the amount of Sn distributed in γ phase is about 10 to about 17, and the amount of Sn distributed in μ phase is about 2 to about 3. By devising the manufacturing process, the amount of Sn distributed in γ phase can be reduced to be about 10 times the amount of Sn distributed in α phase. For example, in the case of the alloy according to the embodiment, in a Cu—Zn—Si—Sn alloy including 0.2 mass % of Sn, when the proportion of α phase is 50%, the proportion of κ phase is 49%, and the proportion of γ phase is 1%, the Sn concentration in α phase is about 0.15 mass %, the Sn concentration in κ phase is about 0.22 mass %, and the Sn concentration in γ phase is about 1.8 mass %. When the area ratio of γ phase is high, the amount of Sn consumed by γ phase is large, and the amounts of Sn distributed in κ phase and α phase are small. Accordingly, if the amount of γ phase is considerably reduced like in the alloys according to the embodiments, Sn is effectively used for corrosion resistance and machinability of α phase and κ phase as described below.

On the other hand, assuming that the amount of P distributed in α phase is 1, the amount of P distributed in κ phase is about 2, the amount of P distributed in γ phase is about 3, and the amount of P distributed in μ phase is about 4. For example, in the case of the alloy according to the embodiment, in a Cu—Zn—Si alloy including 0.1 mass % of P, when the proportion of α phase is 50%, the proportion of κ phase is 49%, and the proportion of γ phase is 1%, the P concentration in α phase is about 0.06 mass %, the P concentration in κ phase is about 0.12 mass %, and the P concentration in γ phase is about 0.18 mass %.

Both Sn and P improve the corrosion resistance of α phase and κ phase. The amount of Sn and the amount of P in κ phase are about 1.4 times and about 2 times the amount of Sn and the amount of P in α phase, respectively. That is, the amount of Sn in κ phase is about 1.4 times the amount of Sn in α phase, and the amount of P in κ phase is about 2 times the amount of P in α phase. Therefore, the degree of corrosion resistance improvement of κ phase brought by Sn and P is higher than that of α phase. As a result, the corrosion resistance of κ phase approaches the corrosion resistance of α phase. By adding both Sn and P, in particular, the corrosion resistance of κ phase can be improved. When [P]/[Sn] ratio (f7) is appropriate, the corrosion resistance further improves.

When the Sn content is lower than 0.10 mass %, the corrosion resistance of κ phase is lower than that of α phase. Therefore, when used in water of bad quality, κ phase can be selectively corroded. Due to a large amount of Sn being distributed to κ phase, corrosion resistance of κ phase, which is lower than the corrosion resistance of α phase, improves, and when κ phase contains a certain concentration of Sn (or higher than that), the corrosion resistance of κ phase and that of α phase narrow. When Sn is contained in κ phase, machinability and wear resistance of κ phase also improve. To that end, the Sn concentration in κ phase is preferably 0.11 mass % or higher, and more preferably 0.14 mass % or higher.

On the other hand, a large amount of Sn is distributed in γ phase. However, even if a large amount of Sn is contained in γ phase, the corrosion resistance of γ phase scarcely improves mainly because the crystal structure of γ phase is a BCC structure. On the contrary, if the proportion of γ phase is high, the corrosion resistance of κ phase scarcely improves because the amount of Sn distributed in κ phase is low. If the proportion of γ phase is reduced, the amount of Sn distributed in κ phase increases. When a large amount of Sn is distributed in κ phase, the corrosion resistance and machinability of κ phase are improved, and the loss of the machinability of γ phase can be compensated for by that. It is presumed that, by having a predetermined amount or more of Sn in κ phase, the machinability improvement function of κ phase itself and chip partibility are improved. However, even though the machinability of the alloy improves when the Sn concentration in κ phase is higher than 0.40 mass %, the ductility and toughness of κ phase start to deteriorate. If a higher importance is placed on ductility and cold workability, the upper limit of the Sn concentration in κ phase is preferably 0.40 mass % or lower, and more preferably 0.36 mass % or lower.

On the other hand, as the Sn content increases, it becomes difficult to reduce the amount of γ phase due to a relation between Sn content and the content of Cu or Si. In order to adjust the proportion of γ phase to be 1.0% or lower and further 0.5% or lower, the Sn content in the alloy needs to be 0.28 mass % or lower and preferably 0.27 mass % or lower.

As in the case of Sn, when a large amount of P is distributed in κ phase, corrosion resistance is improved, and the machinability of κ phase is also improved. However, when an excessive amount of P is added, P is consumed by formation of an intermetallic compound with Si such that the properties deteriorate. Alternatively, if P is excessively solid-solubilized in κ phase, impact resistance and ductility of the alloy are impaired because ductility and toughness of κ phase are impaired. The lower limit of the P concentration in κ phase is preferably 0.07 mass % or higher and more preferably 0.08 mass % or higher. The upper limit of the P concentration in κ phase is preferably 0.22 mass % or lower, and more preferably 0.18 mass % or lower.

<Properties>

(Normal-Temperature Strength and High Temperature Properties)

As a strength required in various fields of valves and devices for drinking water, vessels, fittings, plumbing, and valves relating to hydrogen such as those of a hydrogen station, hydrogen power generation, or in a high-pressure hydrogen environment, and automotive valves and fittings, a tensile strength is important. In the case of the pressure vessel, an allowable stress thereof is affected by the tensile strength. In the alloy according to the embodiment, hydrogen embrittlement does not occur unlike an iron-based material. Therefore, when the alloy according to the embodiment has a high strength, the allowable stress and the allowable pressure increase such that the alloy can be used more safely. In addition, for example, a valve used in an environment close to the engine room of a vehicle or a high-temperature and high-pressure valve is used in an environment where the temperature can reach about 150° C. at the maximum. And the alloy, of course, is required to remain intact without deformation or fracture when a pressure or a stress is applied.

To that end, it is preferable that a hot extruded material, a hot rolled material, or a hot forged material as a hot worked material is a high strength material having a tensile strength of 540 N/mm$^2$ or higher at a normal temperature. The tensile strength at a normal temperature is more preferably 560 N/mm$^2$ or higher, more preferably 575 N/mm$^2$ or higher, and most preferably 590 N/mm$^2$ or higher. A free-cutting hot forged alloy having a high tensile strength of 590 N/mm$^2$ or higher is not found among copper alloys. In general, cold working is not performed on hot forged materials. For example, the surface can be hardened by shot peening. In this case, however, the cold working ratio is merely about 0.1% to 2.5% in practice, and the improvement of the tensile strength is about 2 to 40 N/mm$^2$.

The alloy according to the embodiment undergoes a heat treatment under an appropriate temperature condition that is higher than the recrystallization temperature of the material or undergoes an appropriate thermal history to improve the tensile strength. Specifically, although depending on the composition or the heat treatment conditions, the tensile strength is improved by about 10 to about 60 N/mm$^2$ as compared to the hot worked material before the heat treatment. Except for Corson alloy or age-hardening alloy such as Ti—Cu alloy, example of increased tensile strength by heat treatment at a temperature higher than the recrystallization temperature is scarcely found among copper alloys. The reason why the strength of the alloy according to the embodiment is improved is presumed to be as follows. By performing the heat treatment at a temperature of 505° C. to 575° C. under appropriate conditions, α phase or κ phase in the matrix is softened. On the other hand, the strengthening of α phase due to the presence of acicular κ phase in α phase, an increase in maximum load that can be withstood before breakage due to improvement of ductility caused by a decrease in the amount of γ phase, and an increase in the proportion of κ phase significantly surmount the softening of α phase and κ phase. As a result, as compared to the hot worked material, not only corrosion resistance but also tensile strength, ductility, impact value, and cold workability are significantly improved, and an alloy having high strength, high ductility, and high toughness is prepared. Incidentally, although depending on the composition or the manufacturing process, the elongation or the impact value is improved by about 1.05 times to about 2 times as compared to the hot worked material before the heat treatment.

On the other hand, the hot worked material is drawn, wire-drawn, or rolled in a cold state after an appropriate heat treatment to improve the strength in some cases. When cold working is performed on the alloy according to the embodiment, at a cold working ratio of 15% or lower, the tensile strength increases by 12 N/mm$^2$ per 1% of cold working ratio. On the other hand, the impact resistance and the Charpy impact test value decrease by about 4% per 1% of cold working ratio. Otherwise, an impact value $I_R$ after cold working under the condition that the cold working ratio is 20% or lower can be substantially defined by $I_R=I_0\times(20/(20+RE))$, wherein $I_0$ represents the impact value of the heat treated material and RE % represents the cold working ratio. For example, when an alloy material having a tensile strength of 570 N/mm$^2$ and an impact value of 30 J/cm$^2$ is cold-drawn at a cold working ratio of 5% to prepare a cold worked material, the tensile strength of the cold worked material is about 630 N/mm$^2$, and the impact value is about 24 J/cm$^2$. When the cold working ratio varies, the tensile strength and the impact value also vary and cannot be determined.

This way, when cold working is performed, the tensile strength increases, but the impact value and the elongation deteriorate. In order to obtain a strength, an elongation, and an impact value according to the intended use, it is necessary to set an appropriate cold working ratio.

On the other hand, when cold drawing, cold wire-drawing, or cold rolling is performed and then a heat treatment is performed under appropriate conditions, tensile strength, elongation, impact resistance are improved as compared to the hot worked material, in particular, the hot extruded material. In addition, there may be a case where a tensile test cannot be performed for a forged product. In this case, since the Rockwell B scale (HRB) and the tensile strength (S) have a strong correlation, the tensile strength can be estimated by measuring the Rockwell B scale for convenience. However, this correlation is established on the presupposition that the composition of the embodiment is satisfied and the requirements f1 to f7 are satisfied.

When HRB is 65 to 88, $S=4.3\times HRB+242$ When HRB is higher than 88 and 99 or lower, $S=11.8\times HRB-422$ When the values of HRB are 65, 75, 85, 88, 93, and 98, the values of tensile strength are estimated to be about 520, 565, 610, 625, 675, and 735 N/mm$^2$, respectively.

Regarding the high temperature creep, it is preferable that a creep strain after holding the copper alloy at 150° C. for 100 hours in a state where a stress corresponding to 0.2% proof stress at room temperature is applied is 0.4% or lower. This creep strain is more preferably 0.3% or lower and still more preferably 0.2% or lower. In this case, even when the copper alloy is exposed to a high temperature as in the case of, for example, a high-temperature high-pressure valve or a valve used close to the engine room of an automobile, deformation is not likely to occur, and high temperature properties are excellent.

Even when machinability is excellent and tensile strength is high, if ductility and cold workability are poor, the use of the alloy is limited. Regarding cold workability, for example, for use in water-related devices, automobiles, and electrical components, a hot forged material or a cut material may undergo slight swaging or bending and is required not to crack due to such processing. Machinability requires a material to have some kind of brittleness for chip parting, which is contrary to cold workability. Likewise, tensile strength and ductility are contrary to each other, and it is desired that tensile strength and ductility (elongation) are highly balanced. Regarding a hot worked material that undergoes a heat treatment step or a material that undergoes cold working before and after a heat treatment after hot working, one yardstick to determine whether such a material has high strength and high ductility is that if the tensile strength is 540 N/mm$^2$ or higher, the elongation is 12% or higher, and the value of $f8=S\times\{(E+100)/100\}^{1/2}$, which is the product of the tensile strength (S), and the value of {(Elongation (E %)+100)/100} raised to the power ½ is 660 or higher, the material can be regarded as having high strength and high ductility. The value of f8 is more preferably 675 or higher. By performing cold working at an appropriate cold working ratio of 2% to 15% before or after a heat treatment, an elongation of 12% or higher and a tensile strength of 580 N/mm$^2$ or higher and further 600 N/mm$^2$ or higher can all be obtained.

Incidentally, the strength balance index f8 is not applicable to castings because crystal grains of casting are likely to coarsen and may include microscopic defects.

Incidentally, in the case of free-cutting brass including 60 mass % of Cu, 3 mass % of Pb with a balance including Zn and inevitable impurities, tensile strength at a normal temperature is 360 N/mm$^2$ to 400 N/mm$^2$ when formed into a hot extruded material or a hot forged product, and the elongation is 35% to 45%. That is, the value of f8 is about 450. In addition, even after the alloy is exposed to 150° C. for 100 hours in a state where a stress corresponding to 0.2% proof stress at room temperature is applied, the creep strain is about 4% to 5%. Therefore, the tensile strength and heat resistance of the alloy according to the embodiment are higher than those of conventional free-cutting brass including Pb. That is, the alloy according to the embodiment has excellent corrosion resistance and high strength at room temperature, and scarcely deforms even after being exposed to a high temperature for a long period of time. Therefore, a reduction in thickness and weight can be realized using the high strength. In particular, in the case of a forged material such as a valve for high-pressure gas or high-pressure hydrogen, cold working cannot be performed in practice. Therefore, an increase in allowable pressure and a reduction in thickness and weight can be realized using the high strength.

In the case of the alloy according to the embodiment, there is little difference in the properties under high temperature between an extruded material and a cold worked material. That is, the 0.2% proof stress increases due to cold working, but even in a state where a load corresponding to the 0.2% proof stress increased due to cold working is applied, a creep strain after exposing the alloy to 150° C. for 100 hours is 0.4% or lower, and high heat resistance is obtained. The high temperature properties are mainly affected by the area ratios of β phase, γ phase, and μ phase, and as these area ratios increase, the high temperature properties deteriorate. In addition, as the length of the long side of μ phase or γ phase present at a grain boundary of α phase or at a phase boundary increases, the high temperature properties deteriorate.

(Impact Resistance)

In general, when a material has high strength, the material is brittle. It is said that a material having chip partibility during cutting has some kind of brittleness. Impact resistance is contrary to machinability and strength in some aspect.

However, if the copper alloy is for use in various members including drinking water devices such as valves or fittings, automobile components, mechanical components, and industrial plumbing components, the copper alloy needs to have not only high strength but also properties to resist impact. Specifically, when a Charpy impact test is performed using a U-notched specimen, the resultant test value (I) is preferably 12 J/cm$^2$ or higher and more preferably 16 J/cm$^2$ or higher. Regarding a hot worked material that does not undergo cold working, the Charpy impact test value is preferably 14 J/cm$^2$ or higher, more preferably 16 J/cm$^2$ or higher, still more preferably 20 J/cm$^2$ or higher, and most preferably 24 J/cm$^2$ or higher. The alloy according to the embodiment relates to an alloy having excellent machinability. Therefore, it is not really necessary that the Charpy impact test value exceeds 50 J/cm$^2$. Conversely, when the Charpy impact test value exceeds 50 J/cm$^2$, cutting resistance increases due to increased ductility and toughness, which causes unseparated chips more likely to be generated, and as a result, machinability deteriorates. Therefore, it is preferable that the Charpy impact test value is 50 J/cm$^2$ or lower.

When the amount of hard κ phase increases, the amount of acicular κ phase present in α phase increases, or the Sn concentration in κ phase increases, strength and machinability are improved, but toughness, that is, impact resistance deteriorates. Therefore, strength and machinability are contrary to toughness (impact resistance). The following expression defines a strength-ductility-impact balance index (hereinafter, also referred to as "strength balance index") f9 which indicates impact resistance in addition to strength and ductility.

Regarding the hot worked material, when the tensile strength (S) is 540 N/mm$^2$ or higher, the elongation (E) is 12% or higher, the Charpy impact test value (I) is 12 J/cm$^2$ or higher, and the value of $f9=S\times\{(E+100)/100\}^{1/2}+I$, is preferably 685 or higher and more preferably 700 or higher, it can be said that the material has high strength, ductility, and toughness.

Although impact resistance and ductility are similar properties, it is preferable that the strength balance index f8 is 660 or higher or the strength balance index f9 is 685 or higher.

Impact resistance has a close relation with a metallographic structure, and γ phase deteriorates impact resistance. In addition, if μ phase is present at a grain boundary of α phase or a phase boundary between α phase, κ phase, and γ phase, the grain boundary or the phase boundary is embrittled, and impact resistance deteriorates.

As a result of a study, it was found that if μ phase having the length of the long side of more than 25 μm is present at a grain boundary or a phase boundary, impact resistance particularly deteriorates. Therefore, the length of the long side of μ phase present is 25 μm or less, preferably 15 μm or less, more preferably 5 μm or less, and most preferably 2 μm or less. In addition, in a harsh environment, μ phase present at a grain boundary is more likely to corrode than α phase or κ phase, thus causes grain boundary corrosion and deteriorate properties under high temperature.

In the case of μ phase, if the occupancy ratio is low and the length is short and the width is narrow, it is difficult to detect the μ phase using a metallographic microscope at a magnification of about 500-fold or 1000-fold. When observing μ phase whose length is 5 μm or less, the μ phase may be observed at a grain boundary or a phase boundary using an electron microscope at a magnification of about 2000-fold or 5000-fold, μ phase can be found at a grain boundary or a phase boundary.

<Manufacturing Process>

Next, the method of manufacturing the free-cutting copper alloy according to the first or second embodiment of the present invention is described below.

The metallographic structure of the alloy according to the embodiment varies not only depending on the composition but also depending on the manufacturing process. The metallographic structure of the alloy is affected not only by hot working temperature during hot extrusion and hot forging, and heat treatment conditions but also by an average cooling rate (also simply referred to as cooling rate) in the process of cooling during hot working or heat treatment. As a result of a thorough study, it was found that the metallographic structure is largely affected by a cooling rate in a temperature range from 460° C. to 400° C. and a cooling rate in a temperature range from 575° C. to 525° C., in particular, from 570° C. to 530° C. in the process of cooling during hot working or a heat treatment.

The manufacturing process according to the embodiment is a process required for the alloy according to the embodiment. Basically, the manufacturing process has the following important roles although they are affected by composition.

1) Reduce the amount of γ phase that deteriorates corrosion resistance and impact resistance and shorten the length of the long side of γ phase.

2) Control μ phase that deteriorates corrosion resistance and impact resistance as well as the length of the long side of μ phase.

3) Allow acicular κ phase to appear in α phase.

4) Reduce the amount of γ phase, and at the same time, increase the amount (concentration) of Sn that is solid-solubilized in κ phase and α phase.

(Melt Casting)

Melting is performed at a temperature of about 950° C. to about 1200° C. that is higher than the melting point (liquidus temperature) of the alloy according to the embodiment by about 100° C. to about 300° C. In casting, casting material is poured into a predetermined mold at about 900° C. to about 1100° C. that is higher than the melting point by about 50° C. to about 200° C., then is cooled by some cooling means such as air cooling, slow cooling, or water cooling. After solidification, constituent phase(s) changes in various ways.

(Hot Working)

Examples of hot working include hot extrusion, hot forging, and hot rolling.

For example, although depending on production capacity of the equipment used, it is preferable that hot extrusion is performed when the temperature of the material during actual hot working, specifically, immediately after the material passes through an extrusion die, is 600° C. to 740° C. If hot working is performed when the material temperature is higher than 740° C., a large amount of β phase is formed during plastic working, and β phase may remain. In addition, a large amount of γ phase remains and has an adverse effect on constituent phase(s) after cooling. In addition, even when a heat treatment is performed in the next step, the metallographic structure of a hot worked material is affected. The hot working temperature is preferably 670° C. or lower and more preferably 645° C. or lower. When hot extrusion is performed at 645° C. or lower, the amount of γ phase in the hot extruded material is reduced. Further, α phase is refined into fine grains, which improves the strength. When a hot forged material or a heat treated material having undergone hot forging is prepared using the hot extruded material having a small amount of γ phase, the amount of γ phase in the hot forged material or the heat treated material is further reduced.

On the other hand, when the hot working temperature is low, hot deformation resistance is improved. From the viewpoint of deformability, the lower limit of the hot working temperature is preferably 600° C. or higher. When the extrusion ratio is 50 or lower, or when hot forging is performed in a relatively simple shape, hot working can be performed at 600° C. or higher. To be safe, the lower limit of the hot working temperature is preferably 605° C. Although depending on the production capacity of the equipment used, it is preferable to perform hot working at a lowest possible temperature.

In consideration of feasibility of measurement position, the hot working temperature is defined as a temperature of a hot worked material that can be measured three or four seconds after hot extrusion, hot forging, or hot rolling. The metallographic structure is affected by a temperature immediately after working where large plastic deformation occurs.

In the embodiment, in the process of cooling after hot plastic working, the material is cooled in a temperature range from 575° C. to 525° C. at an average cooling rate of 0.1° C./min to 2.5° C./min. Subsequently, the material is cooled in a temperature range from 460° C. to 400° C. at an average cooling rate of 2.5° C./min to 500° C./min.

Most of extruded materials are made of a brass alloy including 1 to 4 mass % of Pb. Typically, this kind of brass alloy is wound into a coil after hot extrusion unless the diameter of the extruded material exceeds, for example, about 38 mm. The heat of the ingot (billet) during extrusion is taken by an extrusion device such that the temperature of the ingot decreases. The extruded material comes into contact with a winding device such that heat is taken and the temperature further decreases. A temperature decrease of 50° C. to 100° C. from the temperature of the ingot at the start of the extrusion or from the temperature of the extruded material occurs when the cooling rate is relatively high. Although depending on the weight of the coil and the like, the wound coil is cooled in a temperature range from 460° C. to 400° C. at a relatively low cooling rate of about 2° C./min due to a heat keeping effect. After the material's temperature reaches about 300° C., the cooling rate further declines. Therefore, water cooling is performed in consideration of handling. In the case of a brass alloy including Pb, hot extrusion is performed at about 600° C. to 800° C. In the metallographic structure immediately after extrusion, a large amount of β phase having excellent hot workability is present. When the cooling rate after extrusion is high, a large amount of β phase remains in the cooled metallographic structure such that corrosion resistance, ductility, impact resistance, and high temperature properties deteriorate. In order to avoid the deterioration, by performing cooling at a relatively low cooling rate using the heat keeping effect of the extruded coil and the like, β phase is transformed into α phase, and a metallographic structure that is rich in α phase is obtained. As described above, the cooling rate of the extruded material is relatively high immediately after extrusion. Therefore, by subsequently performing cooling at a relatively low cooling rate, a metallographic structure that is rich in α phase is obtained. Patent Document 1 does not describe the cooling rate but discloses that, in order to reduce the amount of β phase and to isolate β phase, slow cooling is performed until the temperature of an extruded material is 180° C. or lower.

As described above, the alloy according to the embodiment is manufactured at a cooling rate that is completely different from that of a method of manufacturing a brass alloy including Pb of the conventional art in the process of cooling after hot working.

(Hot Forging)

As a material for hot forging, a hot extruded material is mainly used, but a continuously cast rod is also used. Since a more complex shape is formed in hot forging than in hot extrusion, the temperature of the material before forging is made high. However, the temperature of a hot forged material on which plastic working is performed to create a large, main portion of a forged product, that is, the material's temperature about three or four seconds immediately after forging is preferably 600° C. to 740° C. as in the case of the hot extruded material. Although depending on the production capacity of the equipment used for forging and the degree of working of a forged product, it is preferable to perform forging at 605° C. to 695° C. because the amount of γ phase is reduced, α phase is refined, and the strength is improved at a stage immediately after forging.

If the extrusion temperature during the manufacturing of the hot extruded rod is lowered to obtain a metallographic structure including a small amount of γ phase, when hot forging is performed on the hot extruded rod, a hot forged metallographic structure in which the amount of γ phase is maintained to be small can be obtained even if hot forging is performed at a high temperature.

Further, by adjusting the cooling rate after forging, a material having various properties such as corrosion resistance or machinability can be obtained. That is, the temperature of the forged material about three or four seconds after hot forging is 600° C. to 740° C. When cooling is performed in a temperature range from 575° C. to 525° C., in particular, 570° C. to 530° C. at a cooling rate of 0.1° C./min to 2.5° C./min in the process of cooling after hot forging, the amount of γ phase is reduced. The lower limit of the cooling rate in a temperature range from 575° C. to 525° C. is set to be 0.1° C./min or higher in consideration of economic efficiency. On the other hand, when the cooling rate exceeds 2.5° C./min, the amount of γ phase is not sufficiently reduced. The cooling rate is preferably 1.5° C./min or lower and more preferably 1° C./min or lower. Cooling in a temperature range from 575° C. to 525° C. at a cooling rate of 2.5° C./min or lower is a condition corresponding to holding in a temperature range from 525° C. to 575° C. for 20 minutes or longer according to the calculation, and by such cooling, an effect substantially the same as that of a heat treatment described below can be obtained, and the metallographic structure can be improved.

The cooling rate in a temperature range from 460° C. to 400° C. is 2.5° C./min to 500° C./min, preferably 4° C./min or higher, and more preferably 8° C./min or higher. As a result, an increase in the amount of μ phase is prevented. This way, in a temperature range from 575° C. to 525° C., cooling is performed at a cooling rate of 2.5° C./min or lower and preferably 1.5° C./min or lower. In addition, in a temperature range from 460° C. to 400° C., cooling is performed at a cooling rate of 2.5° C./min or higher and preferably 4° C./min or higher. This way, by adjusting the cooling rate to be low in a temperature range from 575° C. to 525° C. and conversely adjusting the cooling rate to be high in a temperature range from 460° C. to 400° C., a material having a more satisfactory metallographic structure can be prepared.

When a heat treatment is performed in the next step or the final step once again, it is not necessary to control the cooling rate in a temperature range from 575° C. to 525° C. and the cooling rate in a temperature range from 460° C. to 400° C. after hot working.

(Hot Rolling)

In the case of hot rolling, rolling is repeatedly performed, but the final hot rolling temperature (material's temperature three or four seconds after the final hot rolling) is preferably 600° C. to 740° C. and more preferably 605° C. to 670° C.

During cooling after hot extrusion and after hot rolling, as in the case of hot forging, by cooling the material in a temperature range from 575° C. to 525° C. at a cooling rate of 0.1° C./min to 2.5° C./min and cooling the material in a temperature range from 460° C. to 400° C. at a cooling rate of 2.5° C./min to 500° C./min, a metallographic structure including a small amount of γ phase can be obtained.

(Heat Treatment)

The main heat treatment for copper alloys is also called annealing. When producing a small product which cannot be made by, for example, hot extrusion, a heat treatment is performed as necessary after cold drawing or cold wire drawing such that the material recrystallizes, that is, usually for the purpose of softening a material. In addition, in the case of hot worked materials, if the material is desired to have substantially no work strain, or if an appropriate metallographic structure is required, a heat treatment is performed as necessary.

In the case of a brass alloy including Pb, a heat treatment is performed as necessary. In the case of the brass alloy including Bi disclosed in Patent Document 1, a heat treatment is performed under conditions of 350° C. to 550° C. and 1 to 8 hours.

In the case of the alloy according to the embodiment, when it is held at a temperature of 525° C. to 575° C. for 20 minutes to 8 hours, tensile strength, ductility, corrosion resistance, impact resistance, and high temperature properties are improved. However, when a heat treatment is performed under the condition that the material's temperature exceeds 620° C., a large amount of γ phase or β phase is formed, and α phase is coarsened. As the heat treatment condition, the heat treatment temperature is preferably 575° C. or lower.

On the other hand, although a heat treatment can be performed even at a temperature lower than 525° C., the degree of a decrease in the amount of γ phase becomes much smaller, and it takes more time to complete heat treatment. At a temperature of at least 505° C. or higher and lower than 525° C., a time of 100 minutes or longer and preferably 120 minutes or longer is required. Further, in a heat treatment that is performed at a temperature lower than 505° C. for a long time, a decrease in the amount of γ phase is very small, or the amount of γ phase scarcely decreases. Depending on conditions, μ phase appears.

Regarding the heat treatment time (the time for which the material is held at the heat treatment temperature), it is necessary to hold the material at a temperature of 525° C. to 575° C. for at least 20 minutes or longer. The holding time contributes to a decrease in the amount of γ phase. Therefore, the holding time is preferably 40 minutes or longer and more preferably 80 minutes or longer. The upper limit of the holding time is 8 hours, and from the viewpoint of economic efficiency, the holding time is 480 minutes or shorter and preferably 240 minutes or shorter. Alternatively, as described above, at a temperature of 505° C. or higher and preferably 515° C. or higher and lower than 525° C., the holding time is 100 minutes or longer and preferably 120 minutes to 480 minutes.

The advantage of performing heat treatment at this temperature is that, when the amount of γ phase in the material before the heat treatment is small, the softening of α phase and κ phase can be minimized, the grain growth of α phase scarcely occurs, and a higher strength can be obtained. In addition, the amount of κ1 phase contributing to strength or machinability is the largest when heat treated at 515° C. to 545° C.

Regarding another heat treatment method, in the case of a continuous heat treatment furnace where a hot extruded material, a hot forged product, a hot rolled material, or a material that is cold worked (cold drawn, cold wire-drawn, etc.) moves in a heat source, the above-described problems occur if the material's temperature exceeds 620° C. However, by performing the heat treatment under conditions corresponding to increasing the material's temperature to 525° C. to 620° C. and preferably 525° C. to 595° C. and subsequently holding the material's temperature in a temperature range of 525° C. to 575° C. for 20 minutes or longer, that is, the heat treatment is performed such that the sum of the holding time in a temperature range of 525° C. to 575° C. and the time for which the material passes through a temperature range of 525° C. to 575° C. during cooling after holding is 20 minutes or longer, the metallographic structure can be improved. In the case of a continuous furnace, the holding time at a maximum reaching temperature is short. Therefore, the cooling rate in a temperature range from 575° C. to 525° C. is preferably 0.1° C./min to 2.5° C./min, more preferably 2° C./min or lower, and still more preferably 1.5° C./min or lower. Of course, the temperature is not necessarily set to be 575° C. or higher. For example, when the maximum reaching temperature is 545° C., the material may be held in a temperature range from 545° C. to 525° C. for at least 20 minutes. Even if the material's temperature reaches 545° C. as the maximum reaching temperature and the holding time is 0 minutes, the material may pass through a temperature range from 545° C. to 525° C. at an average cooling rate of 1° C./min or lower. That is, as long as the material is held in a temperature range of 525° C. or higher for 20 minutes or longer and the materials' temperature is in a range of 525° C. to 620° C., the maximum reaching temperature is not a problem. Not only in a continuous furnace but also in other furnaces, the definition of the holding time is the time from when the material's temperature reaches "Maximum Reaching Temperature−10° C.".

Although the material is cooled to normal temperature in these heat treatments also, in the process of cooling, the cooling rate in a temperature range from 460° C. to 400° C. needs to be 2.5° C./min to 500° C./min. The cooling rate is preferably 4° C./min or higher. That is, from about 500° C., it is necessary to increase the cooling rate. In general, during cooling in the furnace, the cooling rate decreases at a lower temperature. For example, the cooling rate at 430° C. is lower than that at 550° C.

When the metallographic structure is observed using a 2000-fold or 5000-fold electron microscope, it can be seen that the cooling rate in a temperature range from 460° C. to 400° C., which decides whether μ phase appears or not, is about 8° C./min. In particular, a critical cooling rate that significantly affects the properties is 2.5° C./min or 4° C./min. Of course, whether or not μ phase appears also depends on the composition, and the formation of μ phase rapidly progresses as the Cu concentration increases, the Si concentration increases, and the value of the metallographic structure relational expression f1 increases.

That is, when the cooling rate in a temperature range from 460° C. to 400° C. is lower than about 8° C./min, the length of the long side of μ phase precipitated at a grain boundary reaches about 1 μm, and μ phase further grows as the cooling rate becomes lower. When the cooling rate is about 5° C./min, the length of the long side of μ phase is about 3 μm to 10 μm. When the cooling rate is lower than about 2.5° C./min, the length of the long side of μ phase exceeds 15 μm and, in some cases, exceeds 25 μm. When the length of the long side of μ phase reaches about 10 μm, μ phase can be distinguished from a grain boundary and can be observed using a 1000-fold metallographic microscope. On the other hand, the upper limit of the cooling rate varies depending on the hot working temperature or the like. When the cooling rate is excessively high (exceeds 500° C./min), a constituent phase that is formed under high temperature is maintained as it is even under normal temperature, the amount of κ phase increases, and the amounts of β phase and γ phase that affect corrosion resistance and impact resistance increase.

Currently, for most of extrusion materials of a copper alloy, brass alloy including 1 to 4 mass % of Pb is used. In the case of the brass alloy including Pb, as disclosed in Patent Document 1, a heat treatment is performed at a temperature of 350° C. to 550 as necessary. The lower limit of 350° C. is a temperature at which recrystallization occurs and the material softens almost entirely. At 550° C. as the upper limit, the recrystallization ends, and recrystallized grains start to be coarsened. In addition, heat treatment at a higher temperature causes a problem in relation to energy. In addition, when a heat treatment is performed at a temperature of higher than 550° C., the amount of β phase significantly increases. It is presumed that this is the reason the upper limit is disclosed as 550° C. As a common manufacturing facility, a batch furnace or a continuous furnace is used. In the case of the batch furnace, after furnace cooling, the material is air-cooled after its temperature reaches about 300° C. In the case of the continuous furnace, the material is cooled at a relatively low rate until the material's temperature decreases to about 300° C. Cooling is performed at a cooling rate that is different from that of the method of manufacturing the alloy according to the embodiment.

Regarding the metallographic structure of the alloy according to the embodiment, one important thing in the manufacturing step is the cooling rate in the temperature range from 460° C. to 400° C. in the process of cooling after heat treatment or hot working. When the cooling rate is lower than 2.5° C./min, the proportion of μ phase increases. μ phase is mainly formed around a grain boundary or a phase boundary. In a harsh environment, the corrosion resistance of μ phase is lower than that of α phase or κ phase. Therefore, selective corrosion of μ phase or grain boundary corrosion is caused to occur. In addition, as in the case of γ phase, μ phase becomes a stress concentration source or causes grain boundary sliding to occur such that impact resistance or high-temperature strength deteriorates. Preferably, in the process of cooling after hot working, the cooling rate in a temperature range from 460° C. to 400° C. is 2.5° C./min or higher, preferably 4° C./min or higher and more preferably 8° C./min or higher. In consideration of thermal strain, the upper limit of the cooling rate is 500° C./min or lower and preferably 300° C./min or lower.

(Cold Working Step)

In order to obtain high strength, to improve the dimensional accuracy, or to straighten the extruded coil, cold working may be performed on the hot worked material. For example, the hot worked material is cold-worked at a working ratio of about 2% to about 20%, preferably about 2% to about 15%, and more preferably about 2% to about 10% and then undergoes a heat treatment. Alternatively, after hot working and a heat treatment, the heat treated material is wire-drawn or rolled in a cold state at a working ratio of about 2% to about 20%, preferably about 2% to about 15%, and more preferably about 2% to about 10% and, in some cases, undergoes a straightness correction step. Depending on the dimensions of a final product, cold working and the heat treatment may be repeatedly performed. The straightness of the rod material may be improved using only a straightness correction facility, or shot peening may be performed a forged product after hot working. Actual cold working ratio is about 0.1% to about 2.5%, and even when the cold working ratio is small, the strength increases.

Cold working is advantageous in that the strength of the alloy can be increased. By performing a combination of cold working at a working ratio of 2% to 20% and a heat treatment on the hot worked material, regardless of the order of performing these processes, high strength, ductility, and impact resistance can be well-balanced, and properties in which strength is prioritized or ductility or toughness is prioritized according to the intended use can be obtained.

When the heat treatment of the embodiment is performed after cold working at a working ratio of 2% to 15%, α phase and κ phase are sufficiently recovered due to the heat treatment but are not completely recrystallized such that work strain remains in α phase and κ phase. Concurrently, the amount of γ phase is reduced, α phase is strengthened due to the presence of acicular κ phase (κ1 phase) in α phase, and the amount of κ phase increases. As a result, ductility, impact resistance, tensile strength, high temperature properties, and the strength-ductility balance index are higher than those of the hot worked material. When a copper alloy that is generally widely used as the free-cutting copper alloy is cold-worked at 2% to 15% and is heated to 525° C. to 575° C., the strength of the copper alloy decreases by recrystallization. That is, in a free-cutting copper alloy of the conventional art that undergoes cold working, the strength significantly decreases by recrystallization heat treatment. However, in the case of the alloy according to the embodiment that undergoes cold working, the strength increases on the contrary, and an extremely high strength is obtained. This way, the alloy according to the embodiment and the free-cutting copper alloy of the conventional art that undergo cold working are completely different from each other in the behavior after the heat treatment.

On the other hand, by performing cold working at an appropriate cold working ratio after the heat treatment, ductility and impact resistance deteriorate, but a material having a high strength is prepared. In addition, the strength balance index f8 can reach 660 or higher, or the strength balance index f9 can reach 685 or higher.

By adopting the manufacturing process, an alloy having excellent corrosion resistance and having excellent impact resistance, ductility, strength, and machinability is prepared.

(Low-Temperature Annealing)

A rod material, a forged product, or a casting may be annealed at a low temperature which is lower than the recrystallization temperature mainly in order to remove residual stress or to correct the straightness of rod material. In the alloy according to the embodiment, elongation and proof stress are improved while maintaining tensile strength. As low-temperature annealing conditions, it is desired that the material's temperature is 240° C. to 350° C. and the heating time is 10 minutes to 300 minutes. Further, it is preferable that the low-temperature annealing is performed so that the relation of $150 \leq (T-220) \times (t)^{1/2} \leq 1200$, wherein the temperature (material's temperature) of the low-temperature annealing is represented by T (° C.) and the heating time is represented by t (min), is satisfied. Note that the heating time t (min) is counted (measured) from when the temperature is 10° C. lower (T−10) than a predetermined temperature T (° C.).

When the low-temperature annealing temperature is lower than 240° C., residual stress is not removed sufficiently, and straightness correction is not sufficiently performed. When the low-temperature annealing temperature is higher than 350° C., μ phase is formed around a grain boundary or a phase boundary. When the low-temperature annealing time is shorter than 10 minutes, residual stress is not removed sufficiently. When the low-temperature annealing time is longer than 300 minutes, the amount of μ phase increases. As the low-temperature annealing temperature increases or the low-temperature annealing time increases, the amount of μ phase increases, and corrosion resistance, impact resistance, and high-temperature properties deteriorate. However, as long as low-temperature annealing is performed, precipitation of μ phase is not avoidable. Therefore, how precipitation of μ phase can be minimized while removing residual stress is the key. Consequently, the value of $(T-220) \times (t)^{1/2}$ is important.

The lower limit of the value of $(T-220) \times (t)^{1/2}$ is 150, preferably 180 or higher, and more preferably 200 or higher. In addition, the upper limit of the value of $(T-220) \times (t)^{1/2}$ is 1200, preferably 1100 or lower, and more preferably 1000 or lower.

(Heat Treatment of Casting)

Even when a final product is a casting, a heat treatment is performed on a casting after being cast and cooled to normal temperature under any one of the following conditions.

The casting is held at a temperature of 525° C. to 575° C. for 20 minutes to 8 hours or is held at a temperature of 505° C. or higher and lower than 525° C. for 100 minutes to 8 hours. Alternatively, the material's temperature is increased to be 525° C. to 620° C. as the maximum reaching temperature and subsequently is held in a temperature range of 525° C. to 575° C. for 20 minutes or longer. Alternatively, the casting is cooled on a condition corresponding to the above condition, specifically, in a temperature range of 525° C. to 575° C. at an average cooling rate of 0.1° C./min to 2.5° C./min.

Subsequently, the casting is cooled in a temperature range from 460° C. to 400° C. at an average cooling rate of 2.5° C./min to 500° C./min. As a result, the metallographic structure can be improved.

Crystal grains of the casting are coarsened, and defects are present in the casting. Therefore, the strength balance properties f8 and f9 are not applied to the casting.

Using this manufacturing method, the free-cutting copper alloys according to the first and second embodiments of the present invention are manufactured.

The hot working step, the heat treatment (also referred to as annealing) step, and the low-temperature annealing step are steps of heating the copper alloy. When the low-temperature annealing step is not performed, or the hot working step or the heat treatment step is performed after the low-temperature annealing step (when the low-temperature annealing step is not the final step among the steps of heating the copper alloy), the step that is performed later among the hot working steps and the heat treatment steps is important, regardless of whether cold working is performed. When the hot working step is performed after the heat treatment step, or the heat treatment step is not performed after the hot working step (when the hot working step is the final step among the steps of heating the copper alloy), it is necessary that the hot working step satisfies the above-described heating conditions and cooling conditions. When the heat treatment step is performed after the hot working step, or the hot working step is not performed after the heat treatment step (a case where the heat treatment step is the final step among the steps of heating the copper alloy), it is necessary that the heat treatment step satisfies the above-described heating conditions and cooling conditions. For example, in cases where the heat treatment step is not performed after the hot forging step, it is necessary that the hot forging step satisfies the above-described heating conditions and cooling conditions for hot forging. In cases where the heat treatment step is performed after the hot forging step, it is necessary that the heat treatment step satisfies the above-described heating conditions and cooling conditions for heat treatment. In this case, it is not necessary that the hot forging step satisfies the above-described heating conditions and cooling conditions for hot forging.

In the low-temperature annealing step, the material's temperature is 240° C. to 350° C. This temperature concerns whether or not μ phase is formed, and does not concern the temperature range (575° C. to 525° C. and 525° C. to 505° C.) where the amount of γ phase is reduced. This way, the material's temperature in the low-temperature annealing step does not relate to an increase or decrease in the amount of γ phase. Therefore, when the low-temperature annealing step is performed after the hot working step or the heat treatment step (the low-temperature annealing step is the final step among the steps of heating the copper alloy), the conditions of the low-temperature annealing step and the heating conditions and cooling conditions of the step before the low-temperature annealing step (the step of heating the copper alloy immediately before the low-temperature annealing step) are both important, and it is necessary that the low-temperature annealing step and the step before the low-temperature annealing step satisfy the above-described heating conditions and the cooling conditions. Specifically, the heating conditions and cooling conditions of the step that is performed last among the hot working steps and the heat treatment steps performed before the low-temperature annealing step are important, and it is necessary that the above-described heating conditions and cooling conditions are satisfied. When the hot working step or the heat treatment step is performed after the low-temperature annealing step, as described above, the step that is performed last among the hot working steps and the heat treatment steps is important, and it is necessary that the above-described heating conditions and cooling conditions are satisfied. The hot working step or the heat treatment step may be performed before or after the low-temperature annealing step.

In the free-cutting alloy according to the first or second embodiment of the present invention having the above-described constitution, the alloy composition, the composition relational expressions, the metallographic structure, and the metallographic structure relational expressions are defined as described above. Therefore, corrosion resistance in a harsh environment, impact resistance, and high-temperature properties are excellent. In addition, even if the Pb content is low, excellent machinability can be obtained.

The embodiments of the present invention are as described above. However, the present invention is not limited to the embodiments, and appropriate modifications can be made within a range not deviating from the technical requirements of the present invention.

EXAMPLES

The results of an experiment that was performed to verify the effects of the present invention are as described below. The following Examples are shown in order to describe the effects of the present invention, and the requirements for composing the example alloys, processes, and conditions included in the descriptions of the Examples do not limit the technical range of the present invention.

Example 1

<Experiment on the Actual Production Line>

Using a low-frequency melting furnace and a semi-continuous casting machine on the actual production line, a trial manufacture test of copper alloy was performed. Table shows alloy compositions. Since the equipment used was the one on the actual production line, impurities were also measured in the alloys shown in Table 2. In addition, manufacturing steps were performed under the conditions shown in Tables 5 to 11.

(Step Nos. A1 to A14 and AH1 to AH14)

Using the low-frequency melting furnace and the semi-continuous casting machine on the actual production line, a billet having a diameter of 240 mm was manufactured. As to raw materials, those used for actual production were used. The billet was cut into a length of 800 mm and was heated. Then hot extruded into a round bar shape having a diameter of 25.6 mm, and the rod bar was wound into a coil (extruded material). Next, using the heat keeping effect of the coil and adjustment of a fan, the extruded material was cooled in temperature ranges from 575° C. to 525° C. and from 460° C. to 400° C. at a cooling rate of 20° C./min. In a temperature range of 400° C. or lower also, the extruded material was cooled at a cooling rate of about 20° C./min. The temperature was measured using a radiation thermometer placed mainly around the final stage of hot extrusion about three to four seconds after being extruded from an extruder. A radiation thermometer DS-06DF (manufactured by Daido Steel Co., Ltd.) was used for the temperature measurement.

It was verified that the average temperature of the extruded material was within ±5° C. of a temperature shown in Tables 5 and 6 (in a range of (temperature shown in Tables 5 and 6)−5° C. to (temperature shown in Table 5 and 6)+5° C.)

In Step No. AH12, the extrusion temperature was 580° C. In steps other than Step AH12, the extrusion temperatures were 640° C. In Step No. AH12 in which the extrusion temperature was 580° C., two kinds of prepared materials were not able to be extruded to the end, and the extrusion was given up.

After the extrusion, in Step No. AH1, only straightness correction was performed. In Step No. AH2, an extruded material having a diameter of 25.6 mm was cold-drawn to obtain a diameter of 25.0 mm.

In Step Nos. A1 to A6 and AH3 to AH6, an extruded material having a diameter of 25.6 mm was cold-drawn to obtain a diameter of 25.0 mm. The drawn material was heated and held at a predetermined temperature for a predetermined time using an electric furnace on the actual production line or a laboratory electric furnace, and an average cooling rate in a temperature range from 575° C. to 525° C. or an average cooling rate in a temperature range from 460° C. to 400° C. in the process of cooling was made to vary.

In Step Nos. A7 to A9 and AH7 to AH11, an extruded material having a diameter of 25.6 mm was cold-drawn to obtain a diameter of 25.0 mm. A heat treatment was performed on the drawn material using a laboratory electric furnace or a laboratory continuous furnace, and a maximum reaching temperature, a cooling rate in a temperature range from 575° C. to 525° C. or a cooling rate in a temperature range from 460° C. to 400° C. in the process of cooling was made to vary.

In Step Nos. A10 and A11, a heat treatment was performed on an extruded material having a diameter of 25.6 mm. Next, in Step Nos. A10 and A11, the extruded materials were cold-drawn at cold working ratios of about 5% and about 8% to obtain diameters of 25 mm and 24.5 mm, respectively, and the straightness thereof was corrected (drawing and straightness correction after heat treatment).

Step No. A12 is the same as Step No. A1, except for the dimension after drawing as being ϕ24.5 mm.

In Step Nos. A13, A14, AH13, and AH14, a cooling rate after hot extrusion was made to vary, and a cooling rate in a temperature range from 575° C. to 525° C. or a cooling rate in a temperature range from 460° C. to 400° C. in the process of cooling was made to vary.

Regarding heat treatment conditions, as shown in Tables 5 and 6, the heat treatment temperature was made to vary in a range of 495° C. to 635° C., and the holding time was made to vary in a range of 5 minutes to 180 minutes.

In the following tables, if cold drawing was performed before the heat treatment, "0" is indicated, and if the cold drawing was not performed before the heat treatment, "?" is indicated.

(Step Nos. B1 to B3 and BH1 to BH3)

A material (rod material) having a diameter of 25 mm obtained in Step No. A10 was cut into a length of 3 m. Next, this rod material was set in a mold and was annealed at a low temperature for straightness correction. The conditions of this low-temperature annealing are shown in Table 8.

The conditional expression indicated in Table 8 is as follows:

$$(\text{Conditional Expression})=(T-220)\times(t)^{1/2}$$

T: temperature (material's temperature) (° C.)

t: heating time (min)

The result was that straightness was poor only in Step No. BH1.

(Step Nos. C0 and C1)

Using the low-frequency melting furnace and the semi-continuous casting machine on the actual production line, an ingot (billet) having a diameter of 240 mm was manufactured. As to raw materials, raw materials corresponding to those used for actual production were used. The billet was cut into a length of 500 mm and was heated. Hot extrusion was performed to obtain a round bar-shaped extruded material having a diameter of 50 mm. This extruded material was extruded onto an extrusion table in a straight rod shape. The temperature was measured using a radiation thermometer mainly at the final stage of extrusion about three to four seconds after extrusion from an extruder. It was verified that the average temperature of the extruded material was within ±5° C. of a temperature shown in Table 9 (in a range of (temperature shown in Table 9)−5° C. to (temperature shown in Table 9)+5° C.). The cooling rate from 575° C. to 525° C. and the cooling rate from 460° C. to 400° C. after extrusion were 15° C./min and 12° C./min, respectively (extruded material). In steps described below, an extruded material (round bar) obtained in Step No. C0 was used as materials for forging. In Step No. C1, heating was performed at 560° C. for 60 minutes, and subsequently, the material was cooled from 460° C. to 400° C. at a cooling rate of 12° C./min. The extruded materials obtained in Step No. C0 and C1 were partially used as a material for an abrasion test.

(Step Nos. D1 to D8 and DH1 to DH5)

A round bar having a diameter of 50 mm obtained in Step No. C0 was cut into a length of 180 mm. This round bar was horizontally set and was forged into a thickness of 16 mm using a press machine having a hot forging press capacity of 150 ton. About three or four seconds immediately after hot forging the material into a predetermined thickness, the temperature was measured using the radiation thermometer. It was verified that the hot forging temperature (hot working temperature) was within ±5° C. of a temperature shown in Table 10 (in a range of (temperature shown in Table 10)−5° C. to (temperature shown in Table 10)+5° C.)

In Step Nos. D1 to D4, D8, DH2, and DH6, a heat treatment was performed in a laboratory electric furnace, and the heat treatment temperature, the time, the cooling rate in a temperature range from 575° C. to 525° C., and the cooling rate in a temperature range from 460° C. to 400° C. in the process of cooling were made to vary. Regarding D8, working (compression) was performed at a cold working ratio of 1.0% after the heat treatment.

In Step Nos. D5, D7, DH3, and DH4, heating was performed in the continuous furnace in a temperature range of 565° C. to 590° C. for 3 minutes, and the cooling rate was made to vary.

Heat treatment temperature refers to the maximum reaching temperature of the material, and as the holding time, a period of time in which the material was held in a temperature range from the maximum reaching temperature to (maximum reaching temperature−10° C.) was used.

In Step Nos. DH1, D6, and DH5, during cooling after hot forging, the cooling rate in a temperature range from 575° C. to 525° C. and the cooling rate in a temperature range from 460° C. to 400° C. were made to vary. The preparation operations of the samples ended upon completion of the cooling after forging.

<Laboratory Experiment>

Using a laboratory facility, a trial manufacture test of copper alloy was performed. Tables 3 and 4 show alloy compositions. The balance refers to Zn and inevitable impurities. The copper alloys having the compositions shown in Table 2 were also used in the laboratory experiment. In addition, manufacturing steps were performed under the conditions shown in Tables 12 to 15.

(Step Nos. E1 and EH1)

In a laboratory, raw materials mixed at a predetermined component ratio were melted. The molten alloy was cast into a mold having a diameter of 100 mm and a length of 180 mm to prepare a billet. A part of the molten alloy was cast from a melting furnace on the actual production line into a mold having a diameter of 100 mm and a length of 180 mm to prepare a billet. This billet was heated and, in Step Nos. E1 and EH1, was extruded into a round bar having a diameter of 40 mm.

Immediately after stopping the extrusion test machine, the temperature was measured using a radiation thermometer. In effect, this temperature corresponds to the temperature of the extruded material about three or four seconds after being extruded from the extruder.

In Step No. EH1, the preparation operation of the sample ended upon completion of the extrusion, and the obtained extruded material was used as a material for hot forging in steps described below.

In Step No. E1, a heat treatment was performed under conditions shown in Table 12 after extrusion.

The extruded materials obtained in Step Nos. EH1 and E1 were used as materials for evaluation of an abrasion test and hot workability.

(Step Nos. F1 to F5, FH1, and FH2)

Round bars having a diameter of 40 mm obtained in Step Nos. EH1 and PH1, which will be described later, were cut into a length of 180 mm. This round bar obtained in Step No. EH1 or the casting of Step No. PH1 was horizontally set and was forged to a thickness of 15 mm using a press machine having a hot forging press capacity of 150 ton. About three to four seconds immediately after hot forging the material to the predetermined thickness, the temperature was measured using a radiation thermometer. It was verified that the hot forging temperature (hot working temperature) was within ±5° C. of a temperature shown in Table 13 (in a range of (temperature shown in Table 13)−5° C. to (temperature shown in Table 13)+5° C.)

The hot-forged material was cooled at the cooling rate of 20° C./min for a temperature range from 575° C. to 525° C. and at the cooling rate of 18° C./min for a temperature range from 460° C. to 400° C. respectively. In Step No. FH1, hot forging was performed on the round bar obtained in Step No. EH1, and the preparation operation of the sample ended upon cooling the material after hot forging.

In Step Nos. F1, F2, F3, and FH2, hot forging was performed on the round bar obtained in Step No. EH1, and a heat treatment was performed after hot forging. The heat treatment was performed with varied heating conditions and varied cooling rates for temperature ranges from 575° C. to 525° C. and from 460° C. to 400° C.

In Step Nos. F4 and F5, hot forging was performed using a casting which was made with a metal mold (Step No. PH1) as a material for forging. After hot forging, a heat treatment (annealing) was performed with varied heating conditions and cooling rates.

(Step Nos. P1 to P3 and PH1 to PH3)

In Step Nos. P1 to P3 and PH1 to PH3, raw materials mixed at a predetermined component ratio was melted, and the molten alloy was cast into a mold having an inner diameter of ϕ40 mm to obtain a casting. Specifically, a part of the molten alloy was taken from a melting furnace on the actual production line and was poured into a mold having an inner diameter of 40 mm to prepare the casting. In steps other than Step No. PH1, the heat treatment was performed on the castings on varied heating conditions and cooling rates.

(Step No. R1)

In Step No. R1, a part of the molten alloy was taken from a melting furnace on the actual production line and poured into a mold having dimensions of 35 mm×70 mm. The surface of the casting was machined to obtain dimensions of 30 mm×65 mm. Next, the casting was heated to 780° C. and was hot rolled in three passes to obtain a thickness of 8 mm. About three or four seconds after the end of the final hot rolling, the material's temperature was 640, and then the material was air-cooled. A heat treatment was performed on the obtained rolled plate using an electric furnace.

TABLE 2

| Alloy | Component Composition (mass %) | | | | | | Impurities (mass %) | | | | Composition Relational Expression | | |
|---|---|---|---|---|---|---|---|---|---|---|---|---|---|
| No. | Cu | Si | Pb | Sn | P | Zn | Element | Amount | Element | Amount | f1 | f2 | f7 |
| SO1 | 76.3 | 3.13 | 0.012 | 0.15 | 0.08 | Balance | Fe | 0.02 | Ni | 0.04 | 77.6 | 61.7 | 0.53 |
| | | | | | | | Ag | 0.03 | Cr | 0.005 | | | |
| | | | | | | | Se | 0.001 | Co | 0.003 | | | |
| | | | | | | | W | 0.001 | As | 0.003 | | | |
| SO2 | 77.4 | 3.41 | 0.008 | 0.24 | 0.10 | Balance | Fe | 0.04 | Al | 0.002 | 78.2 | 61.4 | 0.42 |
| | | | | | | | Ag | 0.008 | Zr | 0.003 | | | |
| | | | | | | | Mg | 0.001 | Ni | 0.01 | | | |
| | | | | | | | Rare Earth Element | 0.002 | Te | 0.001 | | | |
| | | | | | | | S | 0.0003 | Sb | 0.004 | | | |
| SO3 | 76.3 | 3.25 | 0.011 | 0.18 | 0.09 | Balance | Fe | 0.02 | Al | 0.002 | 77.5 | 61.1 | 0.50 |
| | | | | | | | Ag | 0.01 | Mn | 0.03 | | | |
| | | | | | | | Cr | 0.006 | Ni | 0.03 | | | |
| | | | | | | | Zr | 0.001 | Rare Earth Element | 0.001 | | | |

TABLE 3

| Alloy No. | Cu | Si | Pb | Sn | P | Others | Zn | f1 | f2 | f7 |
|---|---|---|---|---|---|---|---|---|---|---|
| S11 | 77.1 | 3.36 | 0.006 | 0.22 | 0.08 | | Balance | 78.0 | 61.4 | 0.36 |
| S12 | 76.1 | 3.17 | 0.016 | 0.25 | 0.07 | | Balance | 76.6 | 61.3 | 0.28 |
| S13 | 76.5 | 3.20 | 0.012 | 0.17 | 0.07 | | Balance | 77.7 | 61.6 | 0.41 |
| S14 | 78.4 | 3.58 | 0.015 | 0.14 | 0.09 | | Balance | 80.2 | 61.7 | 0.64 |
| S15 | 78.4 | 3.51 | 0.013 | 0.19 | 0.10 | | Balance | 79.7 | 62.0 | 0.53 |
| S16 | 77.6 | 3.44 | 0.015 | 0.18 | 0.09 | | Balance | 78.9 | 61.6 | 0.50 |
| S17 | 75.4 | 3.11 | 0.013 | 0.16 | 0.14 | | Balance | 76.7 | 60.8 | 0.88 |
| S18 | 76.4 | 3.10 | 0.015 | 0.11 | 0.09 | | Balance | 78.0 | 62.0 | 0.82 |

TABLE 3-continued

| Alloy No. | Cu | Si | Pb | Sn | P | Others | Zn | f1 | f2 | f7 |
|---|---|---|---|---|---|---|---|---|---|---|
| S19 | 75.8 | 3.22 | 0.012 | 0.14 | 0.13 | | Balance | 77.3 | 60.8 | 0.93 |
| S20 | 76.8 | 3.33 | 0.007 | 0.20 | 0.10 | | Balance | 77.9 | 61.2 | 0.50 |
| S21 | 77.0 | 3.28 | 0.008 | 0.23 | 0.07 | | Balance | 77.7 | 61.7 | 0.30 |
| S22 | 75.5 | 3.07 | 0.017 | 0.17 | 0.11 | | Balance | 76.6 | 61.1 | 0.65 |
| S23 | 77.2 | 3.25 | 0.009 | 0.22 | 0.11 | | Balance | 78.0 | 62.0 | 0.50 |
| S24 | 76.5 | 3.36 | 0.007 | 0.14 | 0.06 | | Balance | 78.1 | 60.9 | 0.43 |
| S30 | 77.0 | 3.24 | 0.011 | 0.15 | 0.09 | As:0.04, Sb:0.015 | Balance | 78.4 | 61.9 | 0.60 |
| S31 | 77.2 | 3.31 | 0.016 | 0.11 | 0.09 | As:0.03, Sb:0.03 | Balance | 79.0 | 61.8 | 0.82 |
| S32 | 76.5 | 3.16 | 0.009 | 0.22 | 0.12 | Sb:0.04, Bi:0.03 | Balance | 77.3 | 61.7 | 0.55 |

TABLE 4

| Alloy No. | Cu | Si | Pb | Sn | P | Others | Zn | f1 | f2 | f7 |
|---|---|---|---|---|---|---|---|---|---|---|
| S101 | 75.5 | 2.95 | 0.016 | 0.16 | 0.08 | | Balance | 76.6 | 61.7 | 0.50 |
| S102 | 75.8 | 3.06 | 0.012 | 0.25 | 0.08 | | Balance | 76.2 | 61.5 | 0.32 |
| S103 | 72.1 | 2.50 | 0.008 | 0.24 | 0.07 | | Balance | 72.1 | 60.4 | 0.29 |
| S104 | 74.2 | 3.25 | 0.013 | 0.15 | 0.10 | | Balance | 75.6 | 59.0 | 0.67 |
| S105 | 78.5 | 3.71 | 0.010 | 0.16 | 0.12 | | Balance | 80.2 | 61.2 | 0.75 |
| S106 | 76.2 | 3.23 | 0.016 | 0.26 | 0.06 | | Balance | 76.6 | 61.1 | 0.23 |
| S107 | 76.9 | 3.10 | 0.013 | 0.14 | 0.09 | | Balance | 78.3 | 62.5 | 0.64 |
| S108 | 77.0 | 3.32 | 0.010 | 0.15 | 0.03 | | Balance | 78.4 | 61.6 | 0.20 |
| S109 | 77.4 | 3.50 | 0.011 | 0.11 | 0.14 | | Balance | 79.4 | 61.1 | 1.27 |
| S110 | 76.4 | 3.10 | 0.001 | 0.11 | 0.07 | | Balance | 78.0 | 62.0 | 0.64 |
| S111 | 77.0 | 3.39 | 0.013 | 0.22 | 0.18 | | Balance | 78.0 | 61.1 | 0.82 |
| S112 | 76.1 | 3.15 | 0.012 | 0.34 | 0.12 | | Balance | 75.9 | 61.3 | 0.35 |
| S113 | 76.4 | 3.23 | 0.016 | 0.15 | 0.07 | Fe:0.07 | Balance | 77.8 | 61.4 | 0.47 |
| S114 | 78.6 | 3.60 | 0.010 | 0.12 | 0.11 | | Balance | 80.6 | 61.8 | 0.92 |
| S115 | 76.3 | 3.09 | 0.009 | 0.04 | 0.02 | | Balance | 78.5 | 62.0 | 0.50 |
| S116 | 79.0 | 3.65 | 0.010 | 0.22 | 0.11 | | Balance | 80.2 | 61.9 | 0.50 |
| S117 | 78.0 | 3.30 | 0.007 | 0.18 | 0.09 | | Balance | 79.2 | 62.6 | 0.50 |
| S118 | 76.0 | 3.44 | 0.010 | 0.15 | 0.10 | | Balance | 77.6 | 60.0 | 0.67 |
| S119 | 76.4 | 3.15 | 0.007 | 0.13 | 0.08 | Fe:0.16 | Balance | 77.9 | 61.7 | 0.62 |
| S120 | 75.8 | 3.07 | 0.005 | 0.08 | 0.07 | Fe:0.10, Cr:0.02 | Balance | 77.6 | 61.6 | 0.88 |
| S121 | 76.2 | 3.14 | 0.080 | 0.16 | 0.09 | | Balance | 77.5 | 61.6 | 0.56 |

TABLE 5

| | Hot Extrusion | | | Cold Drawing | Diameter of Extruded | Heat Treatment (Annealing) | | | | |
|---|---|---|---|---|---|---|---|---|---|---|
| Step No. | Temp. (° C.) | Cooling Rate from 575° C. to 525° C. (° C./min) | Cooling Rate from 460° C. to 400° C. (° C./min) | and Straightness Correction before Heat Treatment | Material before Heat Treatment (mm) | Kind of Furnace (*) | Temp. (° C.) | Holding Time (min) | Cooling Rate from 575° C. to 525° C. (° C./min) | Cooling Rate from 460° C. to 400° C. (° C./min) |
| A1 | 640 | 20 | 20 | ○ | 25.0 | C | 540 | 120 | 15 | 20 |
| A2 | 640 | 20 | 20 | ○ | 25.0 | C | 540 | 120 | 15 | 14 |
| A3 | 640 | 20 | 20 | ○ | 25.0 | C | 540 | 120 | 15 | 7 |
| A4 | 640 | 20 | 20 | ○ | 25.0 | C | 540 | 120 | 15 | 3.6 |
| A5 | 640 | 20 | 20 | ○ | 25.0 | C | 515 | 180 | — | 20 |
| A6 | 640 | 20 | 20 | ○ | 25.0 | A | 540 | 30 | 15 | 20 |
| A7 | 640 | 20 | 20 | ○ | 25.0 | B | 590 | 5 | 1.8 | 10 |
| A8 | 640 | 20 | 20 | ○ | 25.0 | B | 590 | 5 | 1 | 10 |
| A9 | 640 | 20 | 20 | ○ | 25.0 | B | 560 | 5 | 1 | 20 |
| A10 | 640 | 20 | 20 | — | 25.6 | C | 540 | 120 | 15 | 20 |
| A11 | 640 | 20 | 20 | — | 25.6 | C | 540 | 120 | 15 | 20 |
| A12 | 640 | 20 | 20 | ○ | 24.5 | C | 540 | 120 | 15 | 20 |
| A13 | 640 | 1.6 | 15 | Correction only | 25.6 | — | — | — | — | — |
| A14 | 640 | 1.1 | 15 | Correction only | 25.6 | — | — | — | — | — |

(*) A: Electric furnace in the laboratory
B: Continuous furnace in the laboratory
C: Electric furnace on the production line

TABLE 6

| Step No. | Hot Extrusion Temp. (° C.) | Hot Extrusion Cooling Rate from 575° C. to 525° C. (° C./min) | Hot Extrusion Cooling Rate from 460° C. to 400° C. (° C./min) | Cold Drawing and Straightness Correction before Heat Treatment | Diameter of Extruded Material before Heat Treatment (mm) | Heat Treatment (Annealing) Kind of Furnace (*) | Heat Treatment (Annealing) Temp. (° C.) | Heat Treatment (Annealing) Holding Time (min) | Heat Treatment (Annealing) Cooling Rate from 575° C. to 525° C. (° C./min) | Heat Treatment (Annealing) Cooling Rate from 460° C. to 400° C. (° C./min) |
|---|---|---|---|---|---|---|---|---|---|---|
| AH1 | 640 | 20 | 20 | Correction only | 25.6 | — | — | — | — | — |
| AH2 | 640 | 20 | 20 | ○ | 25.0 | — | — | — | — | — |
| AH3 | 640 | 20 | 20 | ○ | 25.0 | C | 540 | 120 | 2.4 | 1.8 |
| AH4 | 640 | 20 | 20 | ○ | 25.0 | C | 540 | 120 | 1.5 | 1 |
| AH5 | 640 | 20 | 20 | ○ | 25.0 | A | 635 | 60 | 15 | 10 |
| AH6 | 640 | 20 | 20 | ○ | 25.0 | A | 495 | 180 | — | 20 |
| AH7 | 640 | 20 | 20 | ○ | 25.0 | B | 590 | 5 | 5 | 10 |
| AH8 | 640 | 20 | 20 | ○ | 25.0 | B | 590 | 5 | 1.8 | 1.6 |
| AH9 | 640 | 20 | 20 | ○ | 25.0 | A | 515 | 60 | — | 20 |
| AH10 | 640 | 20 | 20 | ○ | 25.0 | A | 560 | 10 | 15 | 20 |
| AH11 | 640 | 20 | 20 | ○ | 25.0 | A | 595 | 60 | 15 | 20 |
| AH12 | 640 | 20 | 20 | Unable to be extruded to the end. | | | | | | |
| AH13 | 640 | 3.5 | 15 | Correction only | 25.6 | — | — | — | — | — |
| AH14 | 640 | 1.4 | 1.2 | Correction only | 25.6 | — | — | — | — | — |

(*) A: Electric furnace in the laboratory
B: Continuous furnace in the laboratory
C: Electric furnace on the production line

TABLE 7

| Step No. | Note |
|---|---|
| A1 | Appropriate conditions |
| A2 | Cooling rate of heat treatment was made to vary |
| A3 | Cooling rate of heat treatment was made to vary |
| A4 | Cooling rate of heat treatment from 460° C. to 400° C. was close to 2.5° C./min. |
| A5 | Heat treatment temperature was low, but holding time was relatively long |
| A6 | Heat treatment temperature was appropriate, and holding time was relatively short (31 minutes in effect) |
| A7 | Heat treatment temperature was relatively high. Cooling rate from 525° C. to 575° C. was relatively low (relatively short as being 28 minutes in effect) |
| A8 | Heat treatment temperature was relatively high. Cooling rate from 525° C. to 575° C. was relatively low (50 minutes in effect) |
| A9 | Cooling rate was relatively low (40 minutes in effect) |
| A10 | After heat treatment, drawing and straightness correction were performed at cold working ratio of 4.6% to obtain diameter of 25 mm |
| A11 | After heat treatment, drawing and straightness correction were performed at cold working ratio of 8.4% to obtain diameter of 24.5 mm |
| A12 | Same conditions as those of Step A1, except that diameter in Step A1 was 25 mm, whereas that in Step A12 was 24.5 mm |
| A13 | Cooling rate from 575° C. to 525° C. after extrusion was slightly low |
| A14 | Cooling rate from 575° C. to 525° C. after extrusion was relatively low |
| AH1 | — |
| AH2 | — |
| AH3 | Cooling rate from 460° C. to 400° C. was low due to furnace cooling |
| AH4 | Cooling rate from 460° C. to 400° C. was low due to furnace cooling |
| AH5 | Heat treatment temperature was high, and α phase was coarsened |
| AH6 | Heat treatment temperature was low |
| AH7 | Heat treatment temperature was higher by 15° C., and cooling rate from 525° C. to 575° C. was high |
| AH8 | Cooling rate of heat treatment from 460° C. to 400° C. was low |
| AH9 | Heat treatment temperature was relatively low, and holding time was short |
| AH10 | Heat treatment temperature was appropriate, and holding time was short (12 minutes in effect) |
| AH11 | heat treatment temperature was relatively high, and holding time from 575° C. to 525° C. during cooling was short |
| AH12 | Extrusion was not able to be performed to the end due to low extrusion temperature |
| AH13 | Cooling rate from 575° C. to 525° C. after extrusion was high |
| AH14 | Cooling rate from 460° C. to 400° C. after extrusion was low |

TABLE 8

| Step No. | Material | Kind of Furnace | Temp. (° C.) | Holding Time (min) | Value of Conditional Expression |
|---|---|---|---|---|---|
| B1 | Rod material obtained in Step A10 | Electric furnace on the production line | 275 | 180 | 738 |
| B2 | | Electric furnace on the production line | 320 | 75 | 866 |
| B3 | | Electric furnace on the production line | 290 | 75 | 606 |
| BH1 | | Electric furnace on the production line | 220 | 120 | — |
| BH2 | | Electric furnace in the laboratory | 370 | 20 | 671 |
| BH3 | | Electric furnace on the production line | 320 | 180 | 1342 |

Conditional Expression: $(T - 220) \times (t)^{1/2}$

T: Temperature (° C.), t: Time (min)

TABLE 11

| Step No. | Note |
|---|---|
| D1 | Appropriate conditions |
| D2 | Cooling rate of heat treatment was made to vary |
| D3 | Cooling rate of heat treatment was made to vary |
| D4 | Heat treatment temperature was relatively low, but holding time was relatively long |
| D5 | Cooling rate from 575° C. to 525° C. in heat treatment was relatively low (25 minutes in effect) |
| D6 | Cooling rate from 575° C. to 525° C. after forging was relatively low |
| D7 | Cooling rate from 575° C. to 525° C. in heat treatment was relatively low (43 minutes in effect) |
| D8 | Barrel assumption; after D1, a low working ratio of 1.0% |
| DH1 | — |
| DH2 | Due to furnace cooling, the cooling rate from 460° C. to 400° C. was low |

TABLE 9

| | Hot Extrusion | | | Diameter of Extruded | Heat Treatment (Annealing) | | | | |
|---|---|---|---|---|---|---|---|---|---|
| Step No. | Temp. (° C.) | Cooling Rate from 575° C. to 525° C. (° C./min) | Cooling Rate from 460° C. to 400° C. (° C./min) | Material before Heat Treatment (mm) | Temp. (° C.) | Holding Time (min) | Cooling Rate from 575° C. to 525° C. (° C./min) | Cooling Rate from 460° C. to 400° C. (° C./min) | Note |
| C0 | 640 | 15 | 15 | 50 | — | — | — | — | Materials for forging and wear resistance test |
| C1 | 640 | 15 | 15 | 50 | 560 | 60 | 15 | 12 | Materials for wear resistance test |

TABLE 10

| | | Hot Forging | | | Heat Treatment (Annealing) | | | | |
|---|---|---|---|---|---|---|---|---|---|
| Step No. | Material | Temp. (° C.) | Cooling Rate from 575° C. to 525° C. (° C./min) | Cooling Rate from 460° C. to 400° C. (° C./min) | Kind of Furnace | Temp. (° C.) | Holding Time (min) | Cooling Rate from 575° C. to 525° C. (° C./min) | Cooling Rate from 460° C. to 400° C. (° C./min) |
| D1 | Round bar obtained in Step C0 | 690 | 20 | 20 | Electric Furnace in the Lab | 540 | 60 | 15 | 15 |
| D2 | | 690 | 20 | 20 | Electric Furnace in the Lab | 540 | 60 | 15 | 8 |
| D3 | | 690 | 20 | 20 | Electric Furnace in the Lab | 540 | 60 | 6 | 4.5 |
| D4 | | 690 | 20 | 20 | Electric Furnace in the Lab | 515 | 160 | — | 15 |
| D5 | | 690 | 20 | 20 | Continuous Furnace in the Lab | 590 | 3 | 2 | 15 |
| D6 | | 690 | 1.6 | 10 | — | — | — | — | — |
| D7 | | 690 | 20 | 20 | Continuous Furnace in Lab | 565 | 3 | 1 | 15 |
| D8 | | 690 | 20 | 20 | Electric Furnace in the Lab | 540 | 60 | 15 | 15 |
| DH1 | | 690 | 20 | 20 | — | — | — | — | — |
| DH2 | | 690 | 20 | 20 | Electric Furnace in the Lab | 540 | 60 | 6 | 2 |
| DH3 | | 690 | 20 | 20 | Continuous Furnace in Lab | 590 | 3 | 1.5 | 1.8 |
| DH4 | | 690 | 20 | 20 | Continuous Furnace in Lab | 565 | 3 | 4 | 15 |
| DH5 | | 690 | 3.3 | 10 | — | — | — | — | — |
| DH6 | | 690 | 20 | 20 | Electric Furnace in the Lab | 515 | 60 | — | 15 |

TABLE 11-continued

| Step No. | Note |
|---|---|
| DH3 | Cooling rate of heat treatment from 460° C. to 400° C. was low |
| DH4 | Cooling rate from 575° C. to 525° C. in heat treatment was high (13 minutes in effect) |
| DH5 | Cooling rate from 575° C. to 525° C. after forging was high |
| DH6 | Heat treatment temperature was relatively low, and holding time was short |

TABLE 12

| | Hot Extrusion | | | | Heat Treatment (Annealing) | | | | |
|---|---|---|---|---|---|---|---|---|---|
| Step No. | Temp. (° C.) | Cooling Rate from 575° C. to 525° C. (° C./min) | Cooling Rate from 460° C. to 400° C. (° C./min) | Diameter of Extruded Material (mm) | Temp. (° C.) | Holding Time (min) | Cooling Rate from 575° C. to 525° C. (° C./min) | Cooling Rate from 460° C. to 400° C. (° C./min) | Note |
| E1 | 640 | 20 | 20 | 40 | 540 | 80 | 15 | 15 | Materials for wear resistance test and hot workability evaluation |
| EH1 | 640 | 20 | 20 | 40 | — | — | — | — | Materials for forging and wear resistance test |

TABLE 13

| | | Hot Forging | | | Heat Treatment (Annealing) | | | | | |
|---|---|---|---|---|---|---|---|---|---|---|
| Step No. | Material | Temp. (° C.) | Cooling Rate from 575° C. to 525° C. (° C./min) | Cooling Rate from 460° C. to 400° C. (° C./min) | Kind of Furnace (*) | Temp. (° C.) | Holding Time (min) | Cooling Rate from 575° C. to 525° C. (° C./min) | Cooling Rate from 460° C. to 400° C. (° C./min) | Note |
| F1 | Ø40 mm | 690 | 20 | 18 | A | 560 | 50 | 50 | 10 | — |
| F2 | round bar obtained in Step EH1 | 690 | 20 | 18 | B | 590 | 5 | 1.8 | 10 | The cooling rate in heat treatment from 575° C. to 525° C. is relatively low (28 minutes in effect). |
| F3 | | 690 | 20 | 18 | B | 565 | 10 | 1.2 | 10 | The cooling rate in heat treatment from 575° C. to 525° C. is relatively low (43 minutes in effect). |
| F4 | Ø40 mm | 690 | 20 | 18 | A | 560 | 80 | 20 | 20 | — |
| F5 | round bar obtained in Step PH1 (casting) | 690 | 20 | 18 | B | 595 | 5 | 1.2 | 10 | The cooling rate in heat treatment from 575° C. to 525° C. is relatively low (42 minutes in effect). |
| FH1 | Ø40 mm | 690 | 20 | 18 | — | — | — | — | — | — |
| FH2 | round bar obtained in Step EH1 | 690 | 20 | 18 | B | 590 | 5 | 1.8 | 1.5 | The cooling rate in heat treatment from 460° C. to 400° C. is low. |

(*) A: Electric furnace in the laboratory
B: Continuous furnace in the laboratory

TABLE 14

| | Casting | | | Heat Treatment (Annealing) | | | | | |
|---|---|---|---|---|---|---|---|---|---|
| Step No. | Cooling Rate from 575° C. to 525° C. (° C./min) | Cooling Rate from 460° C. to 400° C. (° C./min) | Diameter of Casting (mm) | Kind of Furnace (*) | Temp. (° C.) | Holding Time (min) | Cooling Rate from 575° C. to 525° C. (° C./min) | Cooling Rate from 460° C. to 400° C. (° C./min) | Note |
| P1 | 20 | 20 | 40 | A | 540 | 120 | 15 | 20 | — |
| P2 | 20 | 20 | 40 | A | 520 | 180 | — | 15 | Heat treatment temperature was relatively low, but the holding time was relatively long. |

TABLE 14-continued

| Step No. | Casting: Cooling Rate from 575° C. to 525° C. (° C./min) | Casting: Cooling Rate from 460° C. to 400° C. (° C./min) | Casting: Diameter of Casting (mm) | Heat Treatment (Annealing): Kind of Furnace (*) | Heat Treatment (Annealing): Temp. (° C.) | Heat Treatment (Annealing): Holding Time (min) | Heat Treatment (Annealing): Cooling Rate from 575° C. to 525° C. (° C./min) | Heat Treatment (Annealing): Cooling Rate from 460° C. to 400° C. (° C./min) | Note |
|---|---|---|---|---|---|---|---|---|---|
| P3 | 20 | 20 | 40 | B | 595 | 5 | 1 | 15 | The cooling rate in heat treatment from 575° C. to 525° C. was relatively low (50 minutes in effect). |
| PH1 | 20 | 20 | 40 | — | — | — | — | — | — |
| PH2 | 20 | 20 | 40 | A | 540 | 120 | 2 | 1.2 | The cooling rate from 460° C. to 400° C. is low due to furnace cooling. |
| PH3 | 20 | 20 | 40 | A | 520 | 60 | — | 20 | Heat treatment temperature is relatively low, and the holding time is short. |

(*) A: Electric furnace in the laboratory
B: Continuous furnace in the laboratory

TABLE 15

| Step No. | Hot Rolling: Rolling Commencemnent Temperature (° C.) | Hot Rolling: Final Rolling Temp. (° C.) | Hot Rolling: Cooling Rate from 575° C. to 525° C. (° C./min) | Hot Rolling: Cooling Rate from 460° C. to 400° C. (° C./min) | Heat Treatment (Annealing): Temp. (° C.) | Heat Treatment (Annealing): Holding Time (min) | Heat Treatment (Annealing): Cooling Rate from 575° C. to 525° C. (° C./min) | Heat Treatment (Annealing): Cooling Rate from 460° C. to 400° C. (° C./min) |
|---|---|---|---|---|---|---|---|---|
| R1 | 780 | 640 | 20 | 20 | 540 | 120 | 15 | 20 |

Regarding the above-described test materials, the metallographic structure observed, corrosion resistance (dezincification corrosion test/dipping test), and machinability were evaluated in the following procedure.

(Observation of Metallographic Structure)

The metallographic structure was observed using the following method and area ratios (%) of α phase, κ phase, β phase, γ phase, and μ phase were measured by image analysis. Note that α' phase, β' phase, and γ' phase were included in α phase, β phase, and γ phase respectively.

Each of the test materials, rod material or forged product, was cut in a direction parallel to the longitudinal direction or parallel to the flowing direction of the metallographic structure. Next, the surface was polished (mirror-polished) and was etched with a mixed solution of hydrogen peroxide and ammonia water. For etching, an aqueous solution obtained by mixing 3 mL of 3 vol % hydrogen peroxide water and 22 mL of 14 vol % ammonia water was used. At room temperature of about 15° C. to about 25° C., the metal's polished surface was dipped in the aqueous solution for about 2 seconds to about 5 seconds.

Using a metallographic microscope, the metallographic structure was observed mainly at a magnification of 500-fold and, depending on the conditions of the metallographic structure, at a magnification of 1000-fold. In micrographs of five visual fields, respective phases (α phase, κ phase, β phase, γ phase, and μ phase) were manually painted using image processing software "Photoshop CC". Next, the micrographs were binarized using image analysis software "WinROOF2013" to obtain the area ratios of the respective phases. Specifically, the average value of the area ratios of the five visual fields for each phase was calculated and regarded as the proportion of the phase. Thus, the total of the area ratios of all the constituent phases was 100%.

The lengths of the long sides of γ phase and μ phase were measured using the following method. Mainly using a 500-fold metallographic micrograph (when it is still difficult to distinguish, a 1000-fold metallographic micrograph instead), the maximum length of the long side of γ phase was measured in one visual field. This operation was performed in arbitrarily selected five visual fields, and the average maximum length of the long side of γ phase calculated from the lengths measured in the five visual fields was regarded as the length of the long side of γ phase. Likewise, by using a 500-fold or 1000-fold metallographic micrograph or using a 2000-fold or 5000-fold secondary electron micrograph (electron micrograph) according to the size of μ phase, the maximum length of the long side of μ phase in one visual field was measured. This operation was performed in arbitrarily selected five visual fields, and the average maximum length of the long sides of μ phase calculated from the lengths measured in the five visual fields was regarded as the length of the long side of μ phase.

Specifically, the evaluation was performed using an image that was printed out in a size of about 70 mm×about 90 mm. In the case of a magnification of 500-fold, the size of an observation field was 276 μm×220 μm.

When it was difficult to identify a phase, the phase was identified using an electron backscattering diffraction pattern (FE-SEM-EBSP) method at a magnification of 500-fold or 2000-fold.

In addition, in Examples in which the cooling rates were made to vary, in order to determine whether or not μ phase, which mainly precipitates at a grain boundary, was present, a secondary electron image was obtained using JSM-7000F (manufactured by JEOL Ltd.) under the conditions of acceleration voltage: 15 kV and current value (set value: 15) and JXA-8230 (manufactured by JEOL Ltd.) under the conditions of acceleration voltage: 20 kV and current value: $3.0\times10^{-11}$ A, and the metallographic structure was observed at a magnification of 2000-fold or 5000-fold. In cases where μ phase was able to be observed using the 2000-fold or 5000-fold secondary electron image but was not able to be observed using the 500-fold or 1000-fold metallographic micrograph, the μ phase was not included in the calculation of the area ratio. That is, μ phase that was able to be observed using the 2000-fold or 5000-fold secondary electron image but was not able to be observed using the 500-fold or 1000-fold metallographic micrograph was not included in the area ratio of μ phase. The reason for this is that, in most cases, the length of the long side of μ phase that is not able to be observed using the metallographic microscope is 5 μm or less, and the width of such μ phase is 0.3 μm or less. Therefore, such μ phase scarcely affects the area ratio.

The length of μ phase was measured in arbitrarily selected five visual fields, and the average value of the maximum lengths measured in the five visual fields was regarded as the length of the long side of μ phase as described above. The composition of μ phase was verified using an EDS, an accessory of JSM-7000F. Note that when μ phase was not able to be observed at a magnification of 500-fold or 1000-fold but the length of the long side of μ phase was measured at a higher magnification, in the measurement result columns of the tables, the area ratio of μ phase is indicated as 0%, but the length of the long side of μ phase is filled in.

(Observation of μ Phase)

Regarding μ phase, when cooling was performed in a temperature range of 460° C. to 400° C. at a cooling rate of 8° C./min or lower or 15° C./min or lower after hot extrusion or heat treatment, the presence of μ phase was able to be identified. FIG. 1 shows an example of a secondary electron image of Test No. T05 (Alloy No. S01/Step No. A3). It was verified that μ phase was precipitated at a grain boundary of α phase (elongated grayish white phase).

(Acicular κ Phase Present in α Phase)

Acicular κ phase (κ1 phase) present in α phase has a width of about 0.05 μm to about 0.5 μm and has an elongated linear shape or an acicular shape. If the width is 0.1 μm or more, the presence of κ1 phase can be identified using a metallographic microscope.

Figure 2:
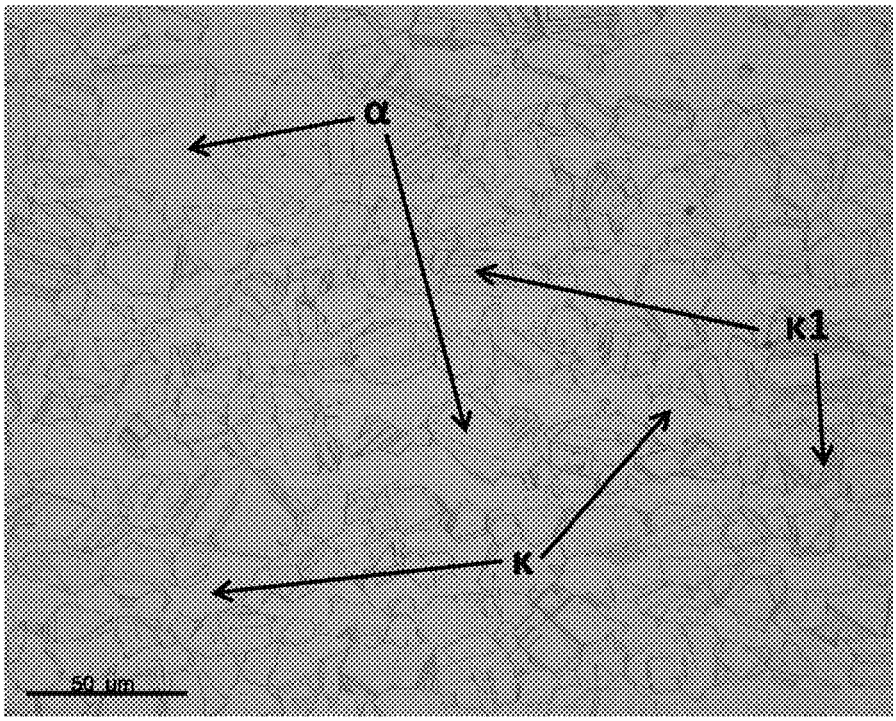
FIG. 2 is a metallographic micrograph of a metallographic structure of a free-cutting copper alloy (Test No. T73) according to Example 1.
Figure 3:
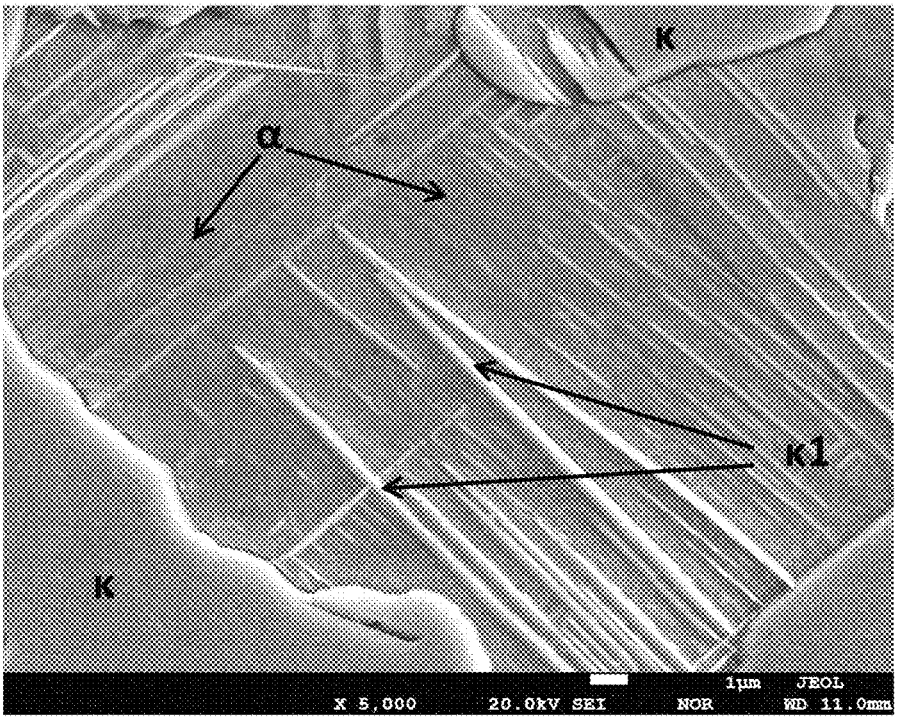
FIG. 3 is an electron micrograph of a metallographic structure of a free-cutting copper alloy (Test No. T73) according to Example 1.

FIG. 2 shows a metallographic micrograph of Test No. T73 (Alloy No. S02/Step No. A1) as a representative metallographic micrograph. FIG. 3 shows an electron micrograph of Test No. T73 (Alloy No. S02/Step No. A1) as a representative electron micrograph of acicular κ phase present in α phase. Observation points of FIGS. 2 and 3 were not the same. In a copper alloy, κ phase may be confused with twin crystal present in α phase. However, the width of κ phase is narrow, and twin crystal consists of a pair of crystals, and thus κ phase present in α phase can be distinguished from twin crystal present in α phase. In the metallographic micrograph of FIG. 2, a phase having an elongated, linear, and acicular pattern is observed in α phase. In the secondary electron image (electron micrograph) of FIG. 3, the pattern present in α phase can be clearly identified as κ phase. The thickness of κ phase was about 0.1 to about 0.2 μm.

The amount (number) of acicular κ phase in α phase was determined using the metallographic microscope. The micrographs of the five visual fields taken at a magnification of 500-fold or 1000-fold for the determination of the metallographic structure constituent phases (metallographic structure observation) were used. In an enlarged visual field printed out to the dimensions of about 70 mm in length and about 90 mm in width, the number of acicular κ phases was counted, and the average value of five visual fields was obtained. When the average number of acicular κ phase in the five visual fields is 10 or more and less than 50, it was determined that acicular κ phase was present, and "Δ" was indicated. When the average number of acicular κ phase in the five visual fields was 50 or more, it was determined that a large amount of acicular κ phase was present, and "○" was indicated. When the average number of acicular κ phase in the five visual fields was less than 10, it was determined that almost no acicular κ phase was present, and "X" was indicated. The number of acicular κ1 phases that was unable to be observed using the images was not counted.

(Amounts of Sn and P in κ Phase)

The amount of Sn and the amount of P contained in κ phase were measured using an X-ray microanalyzer. The measurement was performed using "JXA-8200" (manufactured by JEOL Ltd.) under the conditions of acceleration voltage: 20 kV and current value: $3.0\times10^{-8}$ A.

Regarding Test No. T03 (Alloy No. S01/Step No. A1), Test No. T34 (Alloy No. S01/Step No. BH3), Test No. T212 (Alloy No. S13/Step No. FH1), and Test No. T213 (Alloy No. S13/Step No. F1), the quantitative analysis of the concentrations of Sn, Cu, Si, and P in the respective phases was performed using the X-ray microanalyzer, and the results thereof are shown in Tables 16 to 19.

Regarding μ phase, the length of the longest long side in the visual field was measured using an EDS, an accessory of JSM-7000F.

TABLE 16

Test No. T03 (Alloy No. S01: 76.3Cu—3.13Si—0.012Pb—0.15Sn—0.08P/Step No. A1) (mass %)

| | Cu | Si | Sn | P | Zn |
|---|---|---|---|---|---|
| α Phase | 76.5 | 2.6 | 0.13 | 0.06 | Balance |
| κ Phase | 77.0 | 4.1 | 0.18 | 0.11 | Balance |
| γ Phase | 75.0 | 6.1 | 1.4 | 0.16 | Balance |
| μ Phase | — | — | — | — | Balance |

TABLE 17

Test No. T34 (Alloy No. S01: 76.3Cu—3.13Si—0.012Pb—0.15Sn—0.08P/Step No. BH3) (mass %)

| | Cu | Si | Sn | P | Zn |
|---|---|---|---|---|---|
| α Phase | 76.5 | 2.7 | 0.13 | 0.06 | Balance |
| κ Phase | 77.0 | 4.1 | 0.19 | 0.12 | Balance |
| γ Phase | 75.0 | 5.8 | 1.4 | 0.16 | Balance |
| μ Phase | 82.0 | 7.5 | 0.25 | 0.21 | Balance |

TABLE 18

Test No. T212 (Alloy No. S13: 76.5Cu—3.20Si—0.012Pb—0.17Sn—0.07P/Step No. FH1) (mass %)

| | Cu | Si | Sn | P | Zn |
|---|---|---|---|---|---|
| α Phase | 76.5 | 2.6 | 0.12 | 0.05 | Balance |
| α' Phase | 75.5 | 2.5 | 0.10 | 0.04 | Balance |
| κ Phase | 77.0 | 4.1 | 0.15 | 0.10 | Balance |
| γ Phase | 74.5 | 6.1 | 1.7 | 0.15 | Balance |

TABLE 19

| Test No. T213 (Alloy No. S13: 76.5Cu—3.20Si—0.012Pb—0.17Sn—0.07P/Step No. F1) (mass %) | | | | | |
|---|---|---|---|---|---|
| | Cu | Si | Sn | P | Zn |
| α Phase | 76.0 | 2.7 | 0.15 | 0.05 | Balance |
| κ Phase | 77.0 | 4.0 | 0.21 | 0.10 | Balance |
| γ Phase | 75.0 | 5.8 | 1.6 | 0.14 | Balance |

Based on the above-described measurement results, the following findings were obtained.

1) The concentrations of the elements distributed in the respective phases vary depending on the alloy compositions.

2) The amount of Sn distributed in κ phase is about 1.4 times that in α phase.

3) The Sn concentration in γ phase is about 10 to about 15 times the Sn concentration in α phase.

4) The Si concentrations in κ phase, γ phase, and μ phase are about 1.5 times, about 2.2 times, and about 2.7 times the Si concentration in α phase, respectively.

5) The Cu concentration in μ phase is higher than that in α phase, κ phase, γ phase, or μ phase.

6) As the proportion of γ phase increases, the Sn concentration in κ phase necessarily decreases.

7) The amount of P distributed in κ phase is about 2 times that in α phase.

8) The P concentrations in γ phase and μ phase are about 3 times and about 4 times the P concentration in α phase respectively.

9) Even with the same composition, as the proportion of γ phase decreases, the Sn concentration in α phase increases 1.25 times from 0.12 mass % to 0.15 mass % (Alloy No. S13). Likewise, the Sn concentration in κ phase increases 1.4 times from 0.15 mass % to 0.21 mass %. In addition, the increase in the Sn concentration in κ phase is more than the increase in the Sn concentration in α phase.

(Mechanical Properties)

(Tensile Strength)

Each of the test materials was processed into a No. 10 specimen according to JIS Z 2241, and the tensile strength thereof was measured. If the tensile strength of a hot extruded material or hot forged material is preferably 540 N/mm$^2$ or higher, more preferably 570 N/mm$^2$ or higher, and most preferably 590 N/mm$^2$ or higher, the material can be regarded as a free-cutting copper alloy of the highest quality, and with such a material, a reduction in the thickness and weight, or increase in allowable stress of members used in various fields can be realized.

As the alloy according to the embodiment is a copper alloy having a high tensile strength, the finished surface roughness of the tensile test specimen affects elongation and tensile strength. Therefore, the tensile test specimen was prepared so as to satisfy the following conditions.

(Condition of Finished Surface Roughness of Tensile Test Specimen)

The difference between the maximum value and the minimum value on the Z-axis is 2 μm or less in a cross-sectional curve corresponding to a standard length of 4 mm at any position between gauge marks on the tensile test specimen. The cross-sectional curve refers to a curve obtained by applying a low-pass filter of a cut-off value λs to a measured cross-sectional curve.

(High Temperature Creep)

A flanged specimen having a diameter of 10 mm according to JIS Z 2271 was prepared from each of the specimens. In a state where a load corresponding to 0.2% proof stress at room temperature was applied to the specimen, a creep strain after being kept for 100 hours at 150° C. was measured. If the creep strain is 0.4% or lower after the test piece is held at 150° C. for 100 hours in a state where 0.2% proof stress, that is, a load corresponding to 0.2% plastic deformation in elongation between gauge marks under room temperature, is applied, the specimen is regarded to have good high-temperature creep. In the case where this creep strain is 0.3% or lower, the alloy is regarded to be of the highest quality among copper alloys, and such material can be used as a highly reliable material in, for example, valves used under high temperature or in automobile components used in a place close to the engine room.

(Impact Resistance)

In an impact test, a U-notched specimen (notch depth: 2 mm, notch bottom radius: 1 mm) according to JIS Z 2242 was taken from each of the extruded rod materials, the forged materials, and alternate materials thereof, the cast materials, and the continuously cast rod materials. Using an impact blade having a radius of 2 mm, a Charpy impact test was performed to measure the impact value.

The relation between the impact value obtained from the V-notched specimen and the impact value obtained from the U-notched specimen is substantially as follows.

$$(\text{V-Notch Impact Value})=0.8\times(\text{U-Notch Impact Value})-3$$

(Machinability)

The machinability was evaluated as follows in a cutting test using a lathe.

Hot extruded rod materials having a diameter of 50 mm, 40 mm, or 25.6 mm, cold drawn materials having a diameter of 25 mm (24.5 mm), and castings were machined to prepare test materials having a diameter of 18 mm. A forged material was machined to prepare a test material having a diameter of 14.5 mm. A point nose straight tool, in particular, a tungsten carbide tool not equipped with a chip breaker was attached to the lathe. Using this lathe, the circumference of the test material having a diameter of 18 mm or a diameter of 14.5 mm was machined under dry conditions at rake angle: −6 degrees, nose radius: 0.4 mm, machining speed: 150 m/min, machining depth: 1.0 mm, and feed rate: 0.11 mm/rev.

A signal emitted from a dynamometer (AST tool dynamometer AST-TL1003, manufactured by Mihodenki Co., Ltd.) that is composed of three portions attached to the tool was electrically converted into a voltage signal, and this voltage signal was recorded on a recorder. Next, this signal was converted into cutting resistance (N). Accordingly, the machinability of the alloy was evaluated by measuring the cutting resistance, in particular, the principal component of cutting resistance showing the highest value during machining.

Concurrently, chips were collected, and the machinability was evaluated based on the chip shape. The most serious problem during actual machining is that chips become entangled with the tool or become bulky. Therefore, when all the chips that were generated had a chip shape with one winding or less, it was evaluated as "○" (good). When the chips had a chip shape with more than one winding and three windings or less, it was evaluated as "Δ" (fair). When a chip having a shape with more than three windings was included, it was evaluated as "X" (poor). This way, the evaluation was performed in three grades.

The cutting resistance depends on the strength of the material, for example, shear stress, tensile strength, or 0.2% proof stress, and as the strength of the material increases, the cutting resistance tends to increase. Cutting resistance that is higher than the cutting resistance of a free-cutting brass rod including 1% to 4% of Pb by about 10% to about 20%, the cutting resistance is sufficiently acceptable for practical use. In the embodiment, the cutting resistance was evaluated based on whether it had 130 N (boundary value). Specifically, when the cutting resistance was 130 N or lower, the machinability was evaluated as excellent (evaluation: 0). When the cutting resistance was higher than 130 N and 150 N or lower, the machinability was evaluated as "acceptable (A)". When the cutting resistance was higher than 150 N, the cutting resistance was evaluated as "unacceptable (X)". Incidentally, when Step No. F1 was performed on a 58 mass % Cu-42 mass % Zn alloy to prepare a sample and this sample was evaluated, the cutting resistance was 185 N.

(Hot Working Test)

The rod materials and castings having a diameter of 50 mm, 40 mm, 25.6 mm, or 25.0 mm were machined to prepare test materials having a diameter of 15 mm and a length of 25 mm. The test materials were held at 740° C. or 635° C. for 20 minutes. Next, the test materials were horizontally set and compressed to a thickness of 5 mm at a high temperature using an Amsler testing machine having a hot compression capacity of 10 ton and equipped with an electric furnace at a strain rate of 0.02/sec and a working ratio of 80%.

Hot workability was evaluated using a magnifying glass at a magnification of 10-fold, and when cracks having an opening of 0.2 mm or more were observed, it was regarded that cracks occurred. When cracking did not occur under two conditions of 740° C. and 635° C., it was evaluated as "○" (good). When cracking occurred at 740° C. but did not occur at 635° C., it was evaluated as "Δ" (fair). When cracking did not occur at 740° C. and occurred at 635° C., it was evaluated as "▲" (fair). When cracking occurred at both of the temperatures, 740° C. and 635° C., it was evaluated as "X" (poor).

When cracking did not occur under two conditions of 740° C. and 635° C., even if the material's temperature decreases to some extent during actual hot extrusion or hot forging, or even if the material comes into contact with a mold or a die even for a moment and the material's temperature decreases, there is no problem in practical use as long as hot extrusion or hot forging is performed at an appropriate temperature. When cracking occurs at either temperature of 740° C. or 635° C., although hot working is considered to be possible, there is a restriction in practical use, and therefore, it is necessary to perform hot working in a more narrowly controlled temperature range. When cracking occurred at both temperatures of 740° C. and 635° C., it is determined to be unacceptable as that is a serious problem in practical use.

(Swaging (Bending) Workability)

In order to evaluate swaging (bending) workability, the outer surfaces of the rod material and the forged material were machined to reduce the outer diameter to 13 mm, and holes were drilled with a drill having a drill bit of 10 mm in diameter attached in the materials, which were then cut into a length of 10 mm. As a result, cylindrical samples having an outer diameter of 13 mm, a thickness of 1.5 mm, and a length of 10 mm were prepared. These samples were clamped with a vice and were flattened in an elliptical shape by human power to investigate whether or not cracking occurred.

The swaging ratio (ellipticity) of when cracking occurred was calculated based on the following expression.

(Swaging Ratio)=(1−(Length of Inner Short Side after Flattening)/(Inner Diameter))×100(%)

(Length (mm) of Inner Short Side after Flattening)=(Length of Outer Short Side of Flattened Elliptical Shape)−(Thickness)×2

(Inner Diameter (mm))=(Outer Diameter of Cylinder)−(Thickness)×2

Incidentally, when a load added to flatten a cylindrical material is removed, the material springs back to the original shape. However, the shape here refer to a permanently deformed shape.

Here, if the swaging ratio (bending ratio) when cracking occurred was 25% or higher, the swaging (bending) workability was evaluated as "○" (good). When the swaging ratio (bending ratio) was 10% or higher and lower than 25%, the swaging (bending) workability was evaluated as "Δ" (fair). When the swaging ratio (bending ratio) was lower than 10%, the swaging (bending) workability was evaluated as "X" (poor).

Incidentally, when a commercially available free-cutting brass rod (59% Cu-3% Pb-balance Zn) to which Pb was added was tested to examine its swaging workability, the swaging ratio was 9%. An alloy having excellent free-cutting ability has some kind of brittleness.

(Dezincification Corrosion Tests 1 and 2)

When the test material was an extruded material, the test material was embedded in a phenol resin material such that an exposed sample surface of the test material was perpendicular to the extrusion direction. When the test material was a cast material (cast rod), the test material was embedded in a phenol resin material such that an exposed sample surface of the test material was perpendicular to the longitudinal direction of the cast material. When the test material was a forged material, the test material was embedded in a phenol resin material such that an exposed sample surface of the test material was perpendicular to the flowing direction of forging.

The sample surface was polished with emery paper up to grit 1200, was ultrasonically cleaned in pure water, and then was dried with a blower. Next, each of the samples was dipped in a prepared dipping solution.

After the end of the test, the samples were embedded in a phenol resin material again such that the exposed surface is maintained to be perpendicular to the extrusion direction, the longitudinal direction, or the flowing direction of forging. Next, the sample was cut such that the cross-section of a corroded portion was the longest cut portion. Next, the sample was polished.

Using a metallographic microscope, corrosion depth was observed in 10 visual fields (arbitrarily selected 10 visual fields) of the microscope at a magnification of 500-fold. The deepest corrosion point was recorded as the maximum dezincification corrosion depth.

In the dezincification corrosion test 1, the following test solution 1 was prepared as the dipping solution, and the above-described operation was performed. In the dezincification corrosion test 2, the following test solution 2 was prepared as the dipping solution, and the above-described operation was performed.

The test solution 1 is a solution for performing an accelerated test in a harsh corrosion environment simulating an environment in which an excess amount of a disinfectant which acts as an oxidant is added such that pH is significantly low. When this solution is used, it is presumed that this test is an about 75 to 100 times accelerated test performed in such a harsh corrosion environment. If the maximum corrosion depth is 70 μm or less, corrosion resistance is excellent. In the case excellent corrosion resistance is required, it is presumed that the maximum corrosion depth is preferably 50 μm or less and more preferably 30 μm or less.

The test solution 2 is a solution for performing an accelerated test in a harsh corrosion environment, for simulating water quality that makes corrosion advance fast in which the chloride ion concentration is high and pH is low. When this solution is used, it is presumed that corrosion is accelerated about 30 to 50 times in such a harsh corrosion environment. If the maximum corrosion depth is 40 μm or less, corrosion resistance is good. If excellent corrosion resistance is required, it is presumed that the maximum corrosion depth is preferably 30 μm or less and more preferably 20 μm or less. The Examples of the instant invention were evaluated based on these presumed values.

In the dezincification corrosion test 1, hypochlorous acid water (concentration: 30 ppm, pH=6.8, water temperature: 40° C.) was used as the test solution 1. Using the following method, the test solution 1 was adjusted. Commercially available sodium hypochlorite (NaClO) was added to 40 L of distilled water and was adjusted such that the residual chlorine concentration measured by iodometric titration was 30 mg/L. Residual chlorine decomposes and decreases in amount over time. Therefore, while continuously measuring the residual chlorine concentration using a voltammetric method, the amount of sodium hypochlorite added was electronically controlled using an electromagnetic pump. In order to reduce pH to 6.8, carbon dioxide was added while adjusting the flow rate thereof. The water temperature was adjusted to 40° C. using a temperature controller. While maintaining the residual chlorine concentration, pH, and the water temperature to be constant, the sample was held in the test solution 1 for 2 months. Next, the sample was taken out from the aqueous solution, and the maximum value (maximum dezincification corrosion depth) of the dezincification corrosion depth was measured.

In the dezincification corrosion test 2, a test water including components shown in Table 20 was used as the test solution 2. The test solution 2 was adjusted by adding a commercially available chemical agent to distilled water. Simulating highly corrosive tap water, 80 mg/L of chloride ions, 40 mg/L of sulfate ions, and 30 mg/L of nitrate ion were added. The alkalinity and hardness were adjusted to 30 mg/L and 60 mg/L, respectively, based on Japanese general tap water. In order to reduce pH to 6.3, carbon dioxide was added while adjusting the flow rate thereof. In order to saturate the dissolved oxygen concentration, oxygen gas was continuously added. The water temperature was adjusted to 25° C. which is the same as room temperature. While maintaining pH and the water temperature to be constant and maintaining the dissolved oxygen concentration in the saturated state, the sample was held in the test solution 2 for 3 months. Next, the sample was taken out from the aqueous solution, and the maximum value (maximum dezincification corrosion depth) of the dezincification corrosion depth was measured.

TABLE 20

(Units of Items other than pH: mg/L)

| Mg | Ca | Na | K | $NO^{3-}$ | $SO_4^{2-}$ | Cl | Alkalinity | Hardness | pH |
|---|---|---|---|---|---|---|---|---|---|
| 10.1 | 7.3 | 55 | 19 | 30 | 40 | 80 | 30 | 60 | 6.3 |

(Dezincification Corrosion Test 3: Dezincification Corrosion Test according to ISO 6509)

This test is adopted in many countries as a dezincification corrosion test method and is defined by JIS H 3250 of JIS Standards.

As in the case of the dezincification corrosion tests 1 and 2, the test material was embedded in a phenol resin material. For example, the test material was embedded in a phenol resin material such that the exposed sample surface was perpendicular to the extrusion direction of the extruded material. The sample surface was polished with emery paper up to grit 1200, was ultrasonically cleaned in pure water, and then was dried.

Each of the samples was dipped in an aqueous solution (12.7 g/L) of 1.0% cupric chloride dihydrate ($CuCl_2.2H_2O$) and was held under a temperature condition of 75° C. for 24 hours. Next, the sample was taken out from the aqueous solution.

The samples were embedded in a phenol resin material again such that the exposed surfaces were maintained to be perpendicular to the extrusion direction, the longitudinal direction, or the flowing direction of forging. Next, the samples were cut such that the longest possible cross-section of a corroded portion could be obtained. Next, the samples were polished.

Using a metallographic microscope, corrosion depth was observed in 10 visual fields of the microscope at a magnification of 100-fold or 500-fold. The deepest corrosion point was recorded as the maximum dezincification corrosion depth.

When the maximum corrosion depth in the test according to ISO 6509 is 200 μm or less, there was no problem for practical use regarding corrosion resistance. When particularly excellent corrosion resistance is required, it is presumed that the maximum corrosion depth is preferably 100 μm or less and more preferably 50 μm or less.

In this test, when the maximum corrosion depth was more than 200 μm, it was evaluated as "X" (poor). When the maximum corrosion depth was more than 50 μm and 200 μm or less, it was evaluated as "Δ" (fair). When the maximum corrosion depth was 50 μm or less, it was strictly evaluated as "○" (good). In the embodiment, a strict evaluation criterion was adopted because the alloy was assumed to be used in a harsh corrosion environment, and only when the evaluation was "○", it was determined that corrosion resistance was excellent.

(Abrasion Test)

In two tests including an Amsler abrasion test under a lubricating condition and a ball-on-disk abrasion test under a dry condition, wear resistance was evaluated. As samples, alloys prepared in Step Nos. C0, C1, E1, EH1, FH1, and PH1 were used.

The Amsler abrasion test was performed using the following method. At room temperature, each of the samples was machined to prepare an upper specimen having a diameter mm. In addition, a lower specimen (surface hardness: HV184) having a diameter of 42 mm formed of austenitic stainless steel (SUS304 according to JIS G 4303) was prepared. By applying 490 N of load, the upper specimen and the lower specimen were brought into contact with each other. For an oil droplet and an oil bath, silicone oil was used. In a state where the upper specimen and the lower specimen were brought into contact with the load being applied, the upper specimen and the lower specimen were rotated under the conditions that the rotation speed of the upper specimen was 188 rpm and the rotation speed of the lower specimen was 209 rpm. Due to a difference in circumferential speed between the upper specimen and the lower specimen, a sliding speed was 0.2 m/sec. By making the diameters and the rotation speeds of the upper specimen and the lower specimen different from each other, the specimen was made to wear. The upper specimen and the lower specimen were rotated until the number of times of rotation of the lower specimen reached 250000.

After the test, the change in the weight of the upper specimen was measured, and wear resistance was evaluated based on the following criteria. When the decrease in the weight of the upper specimen caused by abrasion was 0.25 g or less, it was evaluated as "◎" (excellent). When the decrease in the weight of the upper specimen was more than 0.25 g and 0.5 g or less, it was evaluated as "○" (good). When the decrease in the weight of the upper specimen was more than 0.5 g and 1.0 g or less, it was evaluated as "Δ" (fair). When the decrease in the weight of the upper specimen was more than 1.0 g, it was evaluated as "X" (poor). The wear resistance was evaluated in these four grades. In addition, when the weight of the lower specimen decreased by 0.025 g or more, it was evaluated as "X".

Incidentally, the abrasion loss (a decrease in weight caused by abrasion) of a free-cutting brass 59Cu-3Pb-38Zn including Pb under the same test conditions was 12 g.

The ball-on-disk abrasion test was performed using the following method. A surface of the specimen was polished with a #2000 sandpaper. A steel ball having a diameter of 10 mm formed of austenitic stainless steel (SUS304 according to JIS G 4303) was pressed against the specimen and was slid thereon under the following conditions.

(Conditions)

Room temperature, no lubrication, load: 49 N, sliding diameter: 10 mm, sliding speed: 0.1 m/sec, sliding distance: 120 m After the test, the change in the weight of the specimen was measured, and wear resistance was evaluated based on the following criteria. When a decrease in the weight of the specimen caused by abrasion was 4 mg or less, it was evaluated as "◎" (excellent). When a decrease in the weight of the specimen was more than 4 mg and 8 mg or less, it was evaluated as "○" (good). When a decrease in the weight of the specimen was more than 8 mg and 20 mg or less, it was evaluated as "Δ" (fair). When a decrease in the weight of the specimen was more than 20 mg, it was evaluated as "X" (poor). The wear resistance was evaluated in these four grades.

Incidentally, the abrasion loss of a free-cutting brass 59Cu-3Pb-38Zn including Pb under the same test conditions was 80 mg.

The evaluation results are shown in Tables 21 to 61.

Tests No. T01 to T66, T71 to T119, and T121 to T180 are the results of experiments performed on alloys corresponding to Examples on the actual production line. Tests No. T201 to T236 and T240 to T245 are the results of laboratory experiments performed on alloys corresponding to Examples. Tests No. T501 to T534 are the results of laboratory experiments performed on alloys corresponding to Comparative Examples.

Regarding the length of the long side of μ phase in the tables, the value "40" refers to 40 μm or more. In addition, regarding the length of the long side of γ phase in the tables, the value "150" refers to 150 μm or more.

TABLE 21

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T01 | S01 | AH1 | 27.9 | 3.0 | 0 | 0 | 97.0 | 100 | 3.0 | 38.3 | 60 | 0 | X | 0.14 | 0.11 |
| T02 | S01 | AH2 | 28.2 | 2.6 | 0 | 0 | 97.4 | 100 | 2.6 | 37.9 | 62 | 0 | X | 0.14 | 0.11 |
| T03 | S01 | A1 | 33.6 | 0.1 | 0 | 0 | 99.9 | 100 | 0.1 | 35.5 | 14 | 0 | ○ | 0.18 | 0.11 |
| T04 | S01 | A2 | 33.8 | 0 | 0 | 0 | 100 | 100 | 0 | 33.8 | 0 | 0 | ○ | 0.18 | 0.11 |
| T05 | S01 | A3 | 33.7 | 0.1 | 0 | 0 | 99.9 | 100 | 0.1 | 35.6 | 12 | 3 | ○ | 0.18 | 0.11 |
| T06 | S01 | A4 | 34.8 | 0.1 | 0 | 0.5 | 99.4 | 100 | 0.6 | 37.0 | 10 | 16 | ○ | 0.18 | 0.11 |
| T07 | S01 | AH3 | 32.8 | 0.1 | 0 | 2.3 | 97.6 | 100 | 2.4 | 35.8 | 16 | 34 | ○ | 0.19 | 0.12 |
| T08 | S01 | AH4 | 30.2 | 0.1 | 0 | 5.1 | 94.8 | 100 | 5.2 | 34.6 | 12 | 40 | ○ | 0.19 | 0.12 |
| T09 | S01 | A5 | 34.8 | 0.3 | 0 | 0 | 99.7 | 100 | 0.3 | 38.0 | 32 | 0 | ○ | 0.18 | 0.11 |
| T10 | S01 | A6 | 33.0 | 0.4 | 0 | 0 | 99.6 | 100 | 0.4 | 36.8 | 26 | 0 | ○ | 0.18 | 0.11 |
| T11 | S01 | AH5 | 31.2 | 1.2 | 0 | 0 | 98.8 | 100 | 1.2 | 37.8 | 54 | 0 | X | 0.17 | 0.11 |
| T12 | S01 | AH6 | 31.0 | 1.4 | 0 | 0 | 98.6 | 100 | 1.4 | 38.1 | 70 | 0 | X | 0.16 | 0.11 |
| T13 | S01 | AH7 | 32.0 | 1.1 | 0 | 0 | 98.9 | 100 | 1.1 | 38.3 | 40 | 0 | X | 0.17 | 0.11 |
| T14 | S01 | A7 | 33.1 | 0.5 | 0 | 0 | 99.5 | 100 | 0.5 | 37.3 | 24 | 0 | Δ | 0.18 | 0.11 |
| T15 | S01 | A8 | 34.8 | 0.3 | 0 | 0 | 99.7 | 100 | 0.3 | 38.0 | 20 | 0 | ○ | 0.18 | 0.11 |
| T16 | S01 | AH8 | 32.0 | 0.3 | 0 | 2.6 | 97.1 | 100 | 2.9 | 36.5 | 20 | 40 | Δ | 0.18 | 0.11 |
| T17 | S01 | A9 | 33.1 | 0.2 | 0 | 0 | 99.8 | 100 | 0.2 | 35.8 | 24 | 0 | ○ | 0.18 | 0.11 |
| T18 | S01 | AH9 | 32.0 | 0.9 | 0 | 0 | 99.1 | 100 | 0.9 | 37.7 | 54 | 0 | Δ | 0.17 | 0.11 |
| T19 | S01 | AH10 | 32.1 | 0.8 | 0 | 0 | 99.2 | 100 | 0.8 | 37.5 | 36 | 0 | Δ | 0.17 | 0.11 |
| T20 | S01 | AH11 | 30.9 | 1.1 | 0 | 0 | 98.9 | 100 | 1.1 | 37.2 | 42 | 0 | X | 0.17 | 0.11 |
| T21 | S01 | A10 | 34.8 | 0.1 | 0 | 0 | 99.9 | 100 | 0.1 | 36.7 | 8 | 0 | ○ | 0.18 | 0.11 |
| T22 | S01 | A11 | 34.9 | 0 | 0 | 0 | 100 | 100 | 0 | 34.9 | 0 | 0 | ○ | 0.18 | 0.11 |

TABLE 22

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T01 | S01 | AH1 | 120 | ○ | Δ | ○ | 104 | 70 | ○ |
| T02 | S01 | AH2 | 121 | ○ | X | ○ | 110 | 74 | ○ |
| T03 | S01 | A1 | 125 | ○ | ○ | — | 26 | 16 | ○ |
| T04 | S01 | A2 | 127 | ○ | ○ | — | 16 | 12 | — |
| T05 | S01 | A3 | 125 | ○ | ○ | — | 32 | 22 | — |
| T06 | S01 | A4 | 123 | ○ | ○ | — | 48 | 32 | — |
| T07 | S01 | AH3 | 124 | ○ | Δ | — | 72 | 50 | ○ |
| T08 | S01 | AH4 | 126 | ○ | X | — | 90 | 56 | ○ |
| T09 | S01 | A5 | 123 | ○ | ○ | — | 52 | 32 | ○ |
| T10 | S01 | A6 | 126 | ○ | ○ | — | 48 | 30 | — |
| T11 | S01 | AH5 | 129 | X | Δ | — | 88 | 58 | ○ |
| T12 | S01 | AH6 | 125 | ○ | X | — | 106 | 70 | ○ |
| T13 | S01 | AH7 | 126 | Δ | ○ | — | 76 | 46 | — |
| T14 | S01 | A7 | 126 | ○ | ○ | — | 48 | 30 | — |
| T15 | S01 | A8 | 123 | ○ | ○ | — | 40 | 26 | — |
| T16 | S01 | AH8 | 123 | ○ | X | — | 82 | 50 | — |
| T17 | S01 | A9 | 125 | ○ | ○ | — | 36 | 28 | — |
| T18 | S01 | AH9 | 126 | ○ | Δ | — | 78 | 56 | — |
| T19 | S01 | AH10 | 126 | ○ | ○ | — | 68 | 42 | ○ |
| T20 | S01 | AH11 | 129 | Δ | ○ | — | 74 | 48 | — |
| T21 | S01 | A10 | 125 | ○ | ○ | — | 20 | 14 | — |
| T22 | S01 | A11 | 126 | ○ | ○ | — | 18 | 12 | ○ |

TABLE 23

| Test No. | Alloy No. | Step No. | Tensile Strength (N/mm$^2$) | Elongation (%) | Impact Value (J/cm$^2$) | Strength Balance Index f8 | Strength Balance Index f9 | 150° C. Creep Strain (%) |
|---|---|---|---|---|---|---|---|---|
| T01 | S01 | AH1 | 543 | 28.4 | 27.9 | 615 | 643 | 0.41 |
| T02 | S01 | AH2 | 580 | 24.8 | 23.5 | 648 | 671 | 0.37 |
| T03 | S01 | A1 | 602 | 37.8 | 34.2 | 707 | 741 | 0.10 |
| T04 | S01 | A2 | 604 | 37.6 | 33.6 | 709 | 742 | 0.08 |
| T05 | S01 | A3 | 600 | 37.0 | 32.5 | 702 | 735 | 0.12 |
| T06 | S01 | A4 | 598 | 34.6 | 31.3 | 694 | 726 | 0.20 |
| T07 | S01 | AH3 | 579 | 29.0 | 27.9 | 658 | 686 | 0.33 |
| T08 | S01 | AH4 | 565 | 25.2 | 23.5 | 632 | 656 | 0.49 |
| T09 | S01 | A5 | 619 | 31.4 | 29.8 | 710 | 739 | 0.20 |
| T10 | S01 | A6 | 600 | 34.4 | 33.0 | 696 | 729 | 0.15 |
| T11 | S01 | AH5 | 557 | 31.8 | 32.5 | 639 | 672 | 0.30 |
| T12 | S01 | AH6 | 591 | 21.6 | 24.8 | 652 | 677 | 0.40 |

TABLE 23-continued

| Test No. | Alloy No. | Step No. | Tensile Strength (N/mm$^2$) | Elongation (%) | Impact Value (J/cm$^2$) | Strength Balance Index f8 | Strength Balance Index f9 | 150° C. Creep Strain (%) |
|---|---|---|---|---|---|---|---|---|
| T13 | S01 | AH7 | 570 | 30.6 | 29.7 | 651 | 681 | 0.33 |
| T14 | S01 | A7 | 588 | 34.0 | 32.7 | 681 | 713 | 0.16 |
| T15 | S01 | A8 | 590 | 34.6 | 33.4 | 685 | 718 | 0.15 |
| T16 | S01 | AH8 | 573 | 30.2 | 25.1 | 654 | 679 | — |
| T17 | S01 | A9 | 604 | 36.4 | 32.4 | 706 | 738 | 0.25 |
| T18 | S01 | AH9 | 588 | 25.0 | 26.6 | 657 | 684 | — |
| T19 | S01 | AH10 | 578 | 28.2 | 27.8 | 654 | 682 | — |
| T20 | S01 | AH11 | 566 | 28.6 | 28.4 | 642 | 670 | 0.26 |
| T21 | S01 | A10 | 623 | 30.6 | 26.5 | 712 | 738 | 0.12 |
| T22 | S01 | A11 | 664 | 22.6 | 22.3 | 735 | 758 | 0.09 |

TABLE 24

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T23 | S01 | A12 | 33.7 | 0.1 | 0 | 0 | 99.9 | 100 | 0.1 | 35.6 | 12 | 0 | ○ | 0.18 | 0.11 |
| T24 | S01 | AH12 | Extruded, but unable to extrude through to the end. | | | | | | | | | | | | |
| T25 | S01 | A13 | 32.5 | 0.9 | 0 | 0 | 99.1 | 100 | 0.9 | 38.2 | 34 | 0 | Δ | 0.17 | 0.11 |
| T26 | S01 | A14 | 33.1 | 0.5 | 0 | 0 | 99.5 | 100 | 0.5 | 37.3 | 24 | 0 | ○ | 0.18 | 0.11 |
| T27 | S01 | AH13 | 30.3 | 1.8 | 0 | 0 | 98.2 | 100 | 1.8 | 38.3 | 52 | 0 | x | 0.16 | 0.11 |
| T28 | S01 | AH14 | 31.4 | 0.8 | 0 | 2.7 | 96.5 | 100 | 3.5 | 38.1 | 28 | 40 | Δ | 0.18 | 0.12 |
| T29 | S01 | B1 | 33.8 | 0.1 | 0 | 0 | 99.9 | 100 | 0.1 | 35.7 | 12 | 2 | ○ | 0.18 | 0.11 |
| T30 | S01 | B2 | 34.8 | 0.1 | 0 | 0 | 99.9 | 100 | 0.1 | 36.7 | 8 | 3 | ○ | 0.18 | 0.11 |
| T31 | S01 | B3 | 33.5 | 0.1 | 0 | 0 | 99.9 | 100 | 0.1 | 35.4 | 12 | 2 | ○ | 0.18 | 0.11 |
| T32 | S01 | BH1 | 34.9 | 0 | 0 | 0 | 100 | 100 | 0 | 34.9 | 0 | 0 | ○ | 0.18 | 0.11 |
| T33 | S01 | BH2 | 32.5 | 0.1 | 0 | 2.6 | 97.3 | 100 | 2.7 | 35.7 | 10 | 38 | ○ | 0.19 | 0.12 |
| T34 | S01 | BH3 | 32.0 | 0.1 | 0 | 2.9 | 97.0 | 100 | 3.0 | 35.3 | 12 | 40 | ○ | 0.19 | 0.12 |
| T35 | S01 | C0 | 27.8 | 3.3 | 0 | 0 | 96.7 | 100 | 3.3 | 38.7 | 65 | 0 | X | 0.14 | 0.11 |
| T36 | S01 | C1 | 33.6 | 0.2 | 0 | 0 | 99.8 | 100 | 0.2 | 36.3 | 18 | 0 | ○ | 0.18 | 0.11 |
| T37 | S01 | DH1 | 28.2 | 2.5 | 0 | 0 | 97.5 | 100 | 2.5 | 37.7 | 53 | 0 | X | 0.15 | 0.11 |
| T38 | S01 | D1 | 33.8 | 0.1 | 0 | 0 | 99.9 | 100 | 0.1 | 35.7 | 12 | 0 | ○ | 0.18 | 0.11 |
| T39 | S01 | D2 | 34.0 | 0 | 0 | 0 | 100 | 100 | 0 | 34.0 | 0 | 2 | ○ | 0.18 | 0.11 |
| T40 | S01 | D3 | 33.2 | 0.1 | 0 | 0.4 | 99.5 | 100 | 0.5 | 35.3 | 18 | 12 | ○ | 0.18 | 0.11 |
| T41 | S01 | DH2 | 32.8 | 0 | 0 | 1.6 | 98.4 | 100 | 1.6 | 33.6 | 0 | 28 | ○ | 0.19 | 0.12 |
| T42 | S01 | D4 | 33.0 | 0.2 | 0 | 0 | 99.8 | 100 | 0.2 | 35.7 | 28 | 0 | ○ | 0.18 | 0.11 |

TABLE 24-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T43 | S01 | D5 | 33.3 | 0.3 | 0 | 0 | 99.7 | 100 | 0.3 | 36.6 | 22 | 0 | Δ | 0.18 | 0.11 |
| T44 | S01 | DH3 | 33.1 | 0.2 | 0 | 2.0 | 97.8 | 100 | 2.2 | 36.8 | 12 | 28 | Δ | 0.18 | 0.12 |

TABLE 25

| Test No. | Alloy No. | Step No. | Cutting Resistance (N) | Chip Shape | Bending Work-ability | Hot Work-ability | Corrosion Test 1 (μm) | Corrosion Test 2 (μm) | Corrosion Test 3 (ISO 6509) |
|---|---|---|---|---|---|---|---|---|---|
| T23 | S01 | A12 | 126 | ○ | ○ | — | 28 | 18 | — |
| T24 | S01 | AH12 | Extruded, but unable to extrude through to the end. | | | | | | |
| T25 | S01 | A13 | 124 | ○ | ○ | — | 64 | 36 | ○ |
| T26 | S01 | A14 | 125 | ○ | ○ | — | 48 | 30 | — |
| T27 | S01 | AH13 | 124 | ○ | Δ | — | 86 | 56 | ○ |
| T28 | S01 | AH14 | 125 | ○ | X | — | 90 | 60 | — |
| T29 | S01 | B1 | 127 | ○ | ○ | — | 28 | 16 | — |
| T30 | S01 | B2 | 126 | ○ | ○ | — | 28 | 12 | — |
| T31 | S01 | B3 | 128 | ○ | ○ | — | 30 | 18 | ○ |
| T32 | S01 | BH1 | — | — | — | — | — | — | — |
| T33 | S01 | BH2 | 126 | ○ | Δ | — | 75 | 50 | — |
| T34 | S01 | BH3 | 126 | ○ | X | — | 78 | 50 | ○ |
| T35 | S01 | C0 | 119 | ○ | — | ○ | 104 | 80 | ○ |
| T36 | S01 | C1 | 124 | ○ | ○ | — | 36 | 20 | — |
| T37 | S01 | DH1 | 121 | ○ | Δ | — | 90 | 64 | ○ |
| T38 | S01 | D1 | 125 | ○ | ○ | — | 22 | 14 | ○ |
| T39 | S01 | D2 | 127 | ○ | ○ | — | 18 | 10 | — |
| T40 | S01 | D3 | 125 | ○ | ○ | — | 48 | 34 | — |
| T41 | S01 | DH2 | 127 | ○ | ○ | — | 72 | 42 | — |
| T42 | S01 | D4 | 126 | ○ | ○ | — | 48 | 26 | — |
| T43 | S01 | D5 | 127 | ○ | ○ | — | 46 | 26 | ○ |
| T44 | S01 | DH3 | 125 | ○ | Δ | — | 80 | 52 | ○ |

TABLE 26

| Test No. | Al-loy No. | Step No. | Tensile Strength (N/mm$^2$) | E-longa-tion (%) | Impact Value (J/cm$^2$) | Strength Balance Index f8 | Strength Balance Index f9 | 150° C. Creep Strain (%) |
|---|---|---|---|---|---|---|---|---|
| T23 | S01 | A12 | 620 | 33.2 | 31.6 | 716 | 747 | 0.11 |
| T24 | S01 | AH12 | Extruded, but unable to extrude through to the end. | | | | | |
| T25 | S01 | A13 | 558 | 39.8 | 33.3 | 660 | 693 | — |
| T26 | S01 | A14 | 564 | 41.4 | 35.8 | 671 | 706 | 0.16 |
| T27 | S01 | AH13 | 552 | 32.4 | 28.4 | 635 | 664 | 0.36 |
| T28 | S01 | AH14 | 547 | 27.6 | 27.2 | 618 | 645 | — |
| T29 | S01 | B1 | 625 | 30.0 | 27.3 | 713 | 740 | 0.13 |
| T30 | S01 | B2 | 618 | 29.2 | 26.2 | 702 | 729 | 0.12 |
| T31 | S01 | B3 | 630 | 30.4 | 27.7 | 719 | 747 | — |
| T32 | S01 | BH1 | — | — | — | — | — | — |
| T33 | S01 | BH2 | 591 | 22.6 | 22.6 | 654 | 677 | 0.40 |
| T34 | S01 | BH3 | 593 | 22.2 | 21.8 | 656 | 677 | 0.42 |

TABLE 26-continued

| Test No. | Al-loy No. | Step No. | Tensile Strength (N/mm$^2$) | E-longa-tion (%) | Impact Value (J/cm$^2$) | Strength Balance Index f8 | Strength Balance Index f9 | 150° C. Creep Strain (%) |
|---|---|---|---|---|---|---|---|---|
| T35 | S01 | C0 | 544 | 29.6 | 27.8 | 619 | 647 | — |
| T36 | S01 | C0 | 573 | 42.6 | 35.5 | 684 | 720 | 0.11 |
| T37 | S01 | DH1 | 548 | 30.0 | 29.5 | 625 | 654 | 0.36 |
| T38 | S01 | D1 | 579 | 43.6 | 36.6 | 694 | 730 | 0.12 |
| T39 | S01 | D2 | 573 | 44.0 | 34.2 | 688 | 722 | 0.09 |
| T40 | S01 | D3 | 564 | 41.6 | 33.5 | 671 | 705 | — |
| T41 | S01 | DH2 | 555 | 36.4 | 29.7 | 648 | 678 | 0.31 |
| T42 | S01 | D4 | 593 | 39.0 | 33.2 | 699 | 732 | — |
| T43 | S01 | D5 | 560 | 43.8 | 34.9 | 672 | 706 | 0.14 |
| T44 | S01 | DH3 | 552 | 36.2 | 28.8 | 644 | 673 | 0.34 |

TABLE 27

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T45 | S01 | DH4 | 31.5 | 1.1 | 0 | 0 | 98.9 | 100 | 1.1 | 37.8 | 44 | 0 | Δ | 0.17 | 0.11 |
| T46 | S01 | D6 | 32.0 | 0.5 | 0 | 0 | 99.5 | 100 | 0.5 | 36.2 | 24 | 0 | Δ | 0.18 | 0.11 |
| T47 | S01 | DH5 | 29.8 | 1.4 | 0 | 0 | 98.6 | 100 | 1.4 | 36.9 | 52 | 0 | X | 0.17 | 0.11 |
| T48 | S01 | D7 | 33.5 | 0.1 | 0 | 0 | 99.9 | 100 | 0.1 | 35.4 | 18 | 0 | ○ | 0.18 | 0.11 |
| T49 | S01 | D8 | 33.0 | 0.1 | 0 | 0 | 99.9 | 100 | 0.1 | 34.9 | 14 | 0 | ○ | 0.18 | 0.11 |
| T50 | S01 | DH6 | 32.5 | 1.0 | 0 | 0 | 99.0 | 100 | 1.0 | 38.5 | 36 | 0 | Δ | 0.17 | 0.11 |
| T51 | S01 | EH1 | 27.9 | 3.2 | 0 | 0 | 96.8 | 100 | 3.2 | 38.6 | 54 | 0 | X | 0.15 | 0.11 |

TABLE 27-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T52 | S01 | E1 | 33.3 | 0.3 | 0 | 0 | 99.7 | 100 | 0.3 | 36.6 | 22 | 0 | ○ | 0.18 | 0.11 |
| T53 | S01 | FH1 | 34.2 | 2.6 | 0 | 0 | 97.4 | 100 | 2.6 | 43.9 | 50 | 0 | X | 0.15 | 0.11 |
| T54 | S01 | F1 | 34.0 | 0.1 | 0 | 0 | 99.9 | 100 | 0.1 | 35.9 | 10 | 0 | ○ | 0.18 | 0.11 |
| T55 | S01 | F2 | 34.7 | 0.4 | 0 | 0 | 99.6 | 100 | 0.4 | 38.5 | 20 | 0 | Δ | 0.18 | 0.11 |
| T56 | S01 | FH2 | 32.1 | 0.3 | 0 | 2.7 | 97.0 | 100 | 3.0 | 36.7 | 14 | 30 | Δ | 0.18 | 0.12 |
| T57 | S01 | F3 | 34.8 | 0.1 | 0 | 0 | 99.9 | 100 | 0.1 | 36.7 | 12 | 0 | ○ | 0.18 | 0.11 |
| T58 | S01 | F4 | 34.0 | 0 | 0 | 0 | 100 | 100 | 0 | 34.0 | 0 | 0 | ○ | 0.18 | 0.11 |
| T59 | S01 | F5 | 34.8 | 0.3 | 0 | 0 | 99.7 | 100 | 0.3 | 38.0 | 20 | 0 | ○ | 0.18 | 0.11 |
| T60 | S01 | PH1 | 28.1 | 3.3 | 0 | 0 | 96.7 | 100 | 3.3 | 39.0 | 60 | 0 | X | 0.14 | 0.11 |
| T61 | S01 | P1 | 34.0 | 0.2 | 0 | 0 | 99.8 | 100 | 0.2 | 36.7 | 16 | 0 | ○ | 0.18 | 0.11 |
| T62 | S01 | P2 | 34.8 | 0.3 | 0 | 0 | 99.7 | 100 | 0.3 | 38.0 | 22 | 0 | ○ | 0.18 | 0.11 |
| T63 | S01 | PH2 | 31.3 | 0.2 | 0 | 3.6 | 96.2 | 100 | 3.8 | 35.8 | 18 | 35 | ○ | 0.19 | 0.12 |
| T64 | S01 | P3 | 34.8 | 0.2 | 0 | 0 | 99.8 | 100 | 0.2 | 37.5 | 16 | 0 | Δ | 0.18 | 0.11 |
| T65 | S01 | PH3 | 32.0 | 1.1 | 0 | 0 | 98.9 | 100 | 1.1 | 38.3 | 46 | 0 | ○ | 0.17 | 0.11 |
| T66 | S01 | R1 | 34.0 | 0 | 0 | 0 | 100 | 100 | 0 | 34.0 | 0 | 0 | ○ | 0.18 | 0.11 |

TABLE 28

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T45 | S01 | DH4 | 126 | ○ | ○ | — | 70 | 48 | — |
| T46 | S01 | D6 | 125 | ○ | ○ | — | 58 | 30 | — |
| T47 | S01 | DH5 | 124 | ○ | Δ | — | 88 | 58 | — |
| T48 | S01 | D7 | 125 | ○ | ○ | — | 32 | 22 | — |
| T49 | S01 | D8 | 127 | ○ | ○ | — | 28 | 20 | — |
| T50 | S01 | DH6 | 124 | ○ | Δ | — | 70 | 42 | — |
| T51 | S01 | EH1 | 118 | ○ | X | ○ | 98 | 68 | — |
| T52 | S01 | E1 | 123 | ○ | ○ | — | 42 | 26 | ○ |
| T53 | S01 | FH1 | 120 | ○ | Δ | — | 103 | 62 | ○ |
| T54 | S01 | F1 | 125 | ○ | ○ | — | 22 | 14 | — |
| T55 | S01 | F2 | 124 | ○ | ○ | — | 40 | 26 | — |
| T56 | S01 | FH2 | 126 | ○ | ○ | — | 74 | 48 | — |
| T57 | S01 | F3 | 123 | ○ | — | — | 28 | 16 | — |
| T58 | S01 | F4 | 127 | ○ | ○ | — | 20 | 10 | ○ |
| T59 | S01 | F5 | 124 | ○ | ○ | — | 40 | 24 | ○ |
| T60 | S01 | PH1 | 118 | ○ | — | ○ | 112 | 68 | ○ |
| T61 | S01 | P1 | 122 | ○ | — | — | 34 | 20 | ○ |
| T62 | S01 | P2 | 121 | ○ | — | — | 42 | 26 | — |
| T63 | S01 | PH2 | 119 | ○ | — | — | 80 | 52 | — |
| T64 | S01 | P3 | 120 | ○ | — | — | 40 | 24 | — |
| T65 | S01 | PH3 | 119 | ○ | — | — | 82 | 56 | ○ |
| T66 | S01 | R1 | — | — | — | — | 18 | 12 | ○ |

TABLE 29

| Test No. | Alloy No. | Step No. | Tensile Strength ($N/mm^2$) | E-longation (%) | Impact Value ($J/cm^2$) | Strength Balance Index f8 | Strength Balance Index f9 | 150° C. Creep Strain (%) |
|---|---|---|---|---|---|---|---|---|
| T45 | S01 | DH4 | 556 | 37.4 | 31.3 | 652 | 683 | — |
| T46 | S01 | D6 | 567 | 38.4 | 34.3 | 667 | 701 | 0.22 |
| T47 | S01 | DH5 | 558 | 33.8 | 30.7 | 645 | 676 | 0.36 |
| T48 | S01 | D7 | 567 | 43.0 | 34.5 | 678 | 713 | — |
| T49 | S01 | D8 | 593 | 40.8 | 34.7 | 704 | 738 | 0.12 |
| T50 | S01 | DH6 | 575 | 31.4 | 28.7 | 659 | 688 | 0.21 |
| T51 | S01 | EH1 | 541 | 28.8 | 28.7 | 614 | 643 | 0.47 |
| T52 | S01 | E1 | 569 | 42.4 | 36.3 | 679 | 715 | 0.14 |
| T53 | S01 | FH1 | 545 | 30.2 | 28.9 | 622 | 651 | 0.41 |
| T54 | S01 | F1 | 574 | 43.8 | 38.0 | 688 | 726 | 0.12 |
| T55 | S01 | F2 | 563 | 41.0 | 34.5 | 669 | 703 | — |
| T56 | S01 | FH2 | 550 | 36.4 | 27.5 | 642 | 670 | 0.39 |
| T57 | S01 | F3 | 561 | 44.6 | 35.7 | 675 | 710 | 0.12 |
| T58 | S01 | F4 | 569 | 43.4 | 36.5 | 681 | 718 | 0.11 |

TABLE 29-continued

| Test No. | Alloy No. | Step No. | Tensile Strength ($N/mm^2$) | E-longation (%) | Impact Value ($J/cm^2$) | Strength Balance Index f8 | Strength Balance Index f9 | 150° C. Creep Strain (%) |
|---|---|---|---|---|---|---|---|---|
| T59 | S01 | F5 | 558 | 42.6 | 34.0 | 666 | 700 | 0.17 |
| T60 | S01 | PH1 | — | — | 32.6 | — | — | 0.44 |
| T61 | S01 | P1 | — | — | 42.3 | — | — | 0.13 |
| T62 | S01 | P2 | — | — | 41.1 | — | — | — |
| T63 | S01 | PH2 | — | — | 33.3 | — | — | 0.40 |
| T64 | S01 | P3 | — | — | 40.8 | — | — | 0.13 |
| T65 | S01 | PH3 | — | — | 37.5 | — | — | — |
| T66 | S01 | R1 | — | — | — | — | — | — |

TABLE 30

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T71 | S02 | AH1 | 42.4 | 2.5 | 0 | 0 | 97.5 | 100 | 2.5 | 51.9 | 62 | 0 | X | 0.22 | 0.13 |
| T72 | S02 | AH2 | 44.0 | 2.2 | 0 | 0 | 97.8 | 100 | 2.2 | 52.9 | 66 | 0 | X | 0.23 | 0.13 |
| T73 | S02 | A1 | 51.5 | 0.1 | 0 | 0 | 99.9 | 100 | 0.1 | 53.4 | 10 | 0 | ○ | 0.27 | 0.13 |
| T74 | S02 | A2 | 50.3 | 0.2 | 0 | 0 | 99.8 | 100 | 0.2 | 53.0 | 18 | 0 | ○ | 0.27 | 0.13 |
| T75 | S02 | A3 | 52.2 | 0.1 | 0 | 0 | 99.9 | 100 | 0.1 | 54.1 | 12 | 2 | ○ | 0.27 | 0.12 |
| T76 | S02 | A4 | 50.8 | 0.2 | 0 | 0.5 | 99.3 | 100 | 0.7 | 53.7 | 10 | 12 | ○ | 0.27 | 0.13 |
| T77 | S02 | AH3 | 49.7 | 0.1 | 0 | 1.9 | 98.0 | 100 | 2.0 | 52.5 | 16 | 26 | ○ | 0.28 | 0.13 |
| T78 | S02 | AH4 | 47.3 | 0.2 | 0 | 4.7 | 95.1 | 100 | 4.9 | 52.3 | 16 | 42 | ○ | 0.28 | 0.13 |
| T79 | S02 | A5 | 50.9 | 0.4 | 0 | 0 | 99.6 | 100 | 0.4 | 54.7 | 24 | 0 | ○ | 0.27 | 0.13 |
| T80 | S02 | A6 | 52.4 | 0.9 | 0 | 0 | 99.1 | 100 | 0.9 | 58.1 | 36 | 0 | ○ | 0.25 | 0.12 |
| T81 | S02 | AH5 | 49.2 | 1.6 | 0 | 0 | 98.4 | 100 | 1.6 | 56.8 | 54 | 0 | X | 0.24 | 0.12 |
| T82 | S02 | AH6 | 48.3 | 1.6 | 0 | 0 | 98.4 | 100 | 1.6 | 55.9 | 66 | 0 | Δ | 0.24 | 0.13 |
| T83 | S02 | AH7 | 49.7 | 1.0 | 0 | 0 | 99.0 | 100 | 1.0 | 55.7 | 38 | 0 | Δ | 0.26 | 0.13 |
| T84 | S02 | A7 | 50.0 | 0.6 | 0 | 0 | 99.4 | 100 | 0.6 | 54.6 | 32 | 0 | ○ | 0.26 | 0.13 |
| T85 | S02 | A8 | 51.0 | 0.3 | 0 | 0 | 99.7 | 100 | 0.3 | 54.3 | 22 | 0 | ○ | 0.27 | 0.13 |
| T86 | S02 | AH8 | 49.2 | 0.4 | 0 | 2.3 | 97.3 | 100 | 2.7 | 54.1 | 24 | 32 | ○ | 0.27 | 0.13 |
| T87 | S02 | A9 | 52.2 | 0.3 | 0 | 0 | 99.7 | 100 | 0.3 | 55.5 | 16 | 0 | ○ | 0.27 | 0.12 |

TABLE 31

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T71 | S02 | AH1 | 112 | ○ | X | ○ | 102 | 62 | ○ |
| T72 | S02 | AH2 | 113 | ○ | X | — | 106 | — | — |
| T73 | S02 | A1 | 116 | ○ | ○ | — | 18 | 10 | — |
| T74 | S02 | A2 | 116 | ○ | ○ | — | 24 | 18 | — |
| T75 | S02 | A3 | 116 | ○ | — | — | 30 | 16 | — |
| T76 | S02 | A4 | 115 | ○ | ○ | — | 44 | 30 | — |
| T77 | S02 | AH3 | 115 | ○ | Δ | — | 72 | 48 | — |
| T78 | S02 | AH4 | 117 | ○ | X | — | 96 | 66 | ○ |
| T79 | S02 | A5 | 116 | ○ | ○ | — | 44 | 28 | — |
| T80 | S02 | A6 | 115 | ○ | ○ | — | 66 | 38 | ○ |
| T81 | S02 | AH5 | 120 | ○ | Δ | — | 86 | 56 | ○ |
| T82 | S02 | AH6 | 117 | ○ | X | — | 98 | 64 | ○ |
| T83 | S02 | AH7 | 116 | ○ | Δ | — | 68 | 40 | — |
| T84 | S02 | A7 | 115 | ○ | ○ | — | 56 | 32 | — |
| T85 | S02 | A8 | 115 | ○ | — | — | 42 | 24 | — |
| T86 | S02 | AH8 | 114 | ○ | X | — | 86 | 58 | — |
| T87 | S02 | A9 | 115 | ○ | — | — | 27 | 22 | — |

TABLE 32

| Test No. | Alloy No. | Step No. | Tensile Strength ($N/mm^2$) | Elon-gation (%) | Impact Value ($J/cm^2$) | Strength Balance Index f8 | Strength Balance Index f9 | 150° C. Creep Strain (%) |
|---|---|---|---|---|---|---|---|---|
| T71 | S02 | AH1 | 566 | 23.8 | 19.9 | 630 | 650 | 0.43 |
| T72 | S02 | AH2 | 595 | 20.4 | 16.6 | 653 | 669 | — |
| T73 | S02 | A1 | 622 | 26.0 | 22.1 | 698 | 720 | 0.08 |
| T74 | S02 | A2 | 621 | 25.8 | 22.3 | 697 | 719 | — |
| T75 | S02 | A3 | 622 | 25.0 | 21.8 | 695 | 717 | — |
| T76 | S02 | A4 | 614 | 24.6 | 21.3 | 686 | 707 | — |
| T77 | S02 | AH3 | 603 | 22.6 | 19.8 | 667 | 687 | 0.39 |
| T78 | S02 | AH4 | 589 | 18.8 | 15.3 | 642 | 647 | 0.59 |
| T79 | S02 | A5 | 639 | 22.8 | 20.8 | 708 | 729 | 0.26 |
| T80 | S02 | A6 | 616 | 22.8 | 19.6 | 682 | 702 | — |
| T81 | S02 | AH5 | 582 | 23.8 | 18.7 | 648 | 666 | — |
| T82 | S02 | AH6 | 604 | 18.2 | 15.9 | 657 | 673 | — |
| T83 | S02 | AH7 | 589 | 23.2 | 19.7 | 654 | 674 | — |
| T84 | S02 | A7 | 608 | 24.4 | 21.2 | 679 | 700 | — |
| T85 | S02 | A8 | 611 | 25.0 | 21.7 | 683 | 704 | — |
| T86 | S02 | AH8 | 591 | 21.6 | 18.7 | 652 | 671 | — |
| T87 | S02 | A9 | 617 | 25.4 | 21.3 | 691 | 712 | — |

TABLE 33

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f 6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T88 | S02 | AH9 | 50.8 | 1.1 | 0 | 0 | 98.9 | 100 | 1.1 | 57.1 | 54 | 0 | ○ | 0.25 | 0.12 |
| T89 | S02 | AH10 | 49.3 | 1.3 | 0 | 0 | 98.7 | 100 | 1.3 | 56.1 | 40 | 0 | ○ | 0.25 | 0.13 |
| T90 | S02 | AH11 | 48.7 | 1.1 | 0 | 0 | 98.9 | 100 | 1.1 | 55.0 | 36 | 0 | Δ | 0.25 | 0.13 |
| T91 | S02 | AH12 | Extruded, but unable to extrude through to the end. | | | | | | | | | | | | |
| T92 | S02 | A10 | 51.0 | 0.1 | 0 | 0 | 99.9 | 100 | 0.1 | 52.9 | 12 | 0 | ○ | 0.27 | 0.13 |
| T93 | S02 | B1 | 51.4 | 0.1 | 0 | 0 | 99.9 | 100 | 0.1 | 53.3 | 10 | 2 | ○ | 0.27 | 0.13 |
| T94 | S02 | B2 | 50.2 | 0.1 | 0 | 0 | 99.9 | 100 | 0.1 | 52.1 | 14 | 3 | ○ | 0.27 | 0.13 |
| T95 | S02 | B3 | 51.7 | 0.2 | 0 | 0 | 99.8 | 100 | 0.2 | 54.4 | 20 | 1 | ○ | 0.27 | 0.12 |
| T96 | S02 | BH1 | 51.0 | 0.2 | 0 | 0 | 99.8 | 100 | 0.2 | 53.7 | 14 | 0 | ○ | 0.27 | 0.13 |
| T97 | S02 | BH2 | 49.6 | 0.1 | 0 | 2.4 | 97.5 | 100 | 2.5 | 52.7 | 8 | 36 | ○ | 0.28 | 0.13 |
| T98 | S02 | BH3 | 48.8 | 0.1 | 0 | 2.8 | 97.1 | 100 | 2.9 | 52.1 | 12 | 40 | ○ | 0.28 | 0.13 |
| T99 | S02 | C0 | 43.3 | 3.0 | 0 | 0 | 97.0 | 100 | 3.0 | 53.7 | 62 | 0 | X | 0.21 | 0.13 |
| T100 | S02 | C1 | 50.7 | 0.3 | 0 | 0 | 99.7 | 100 | 0.3 | 54.0 | 22 | 0 | ○ | 0.27 | 0.13 |
| T101 | S02 | DH1 | 42.9 | 2.3 | 0 | 0 | 97.7 | 100 | 2.3 | 52.0 | 54 | 0 | X | 0.22 | 0.13 |
| T102 | S02 | D1 | 51.2 | 0 | 0 | 0 | 100 | 100 | 0 | 51.2 | 0 | 0 | ○ | 0.27 | 0.13 |
| T103 | S02 | D2 | 50.6 | 0.1 | 0 | 0 | 99.9 | 100 | 0.1 | 52.5 | 14 | 2 | ○ | 0.27 | 0.13 |

TABLE 34

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T88 | S02 | AH9 | 114 | ○ | Δ | — | 86 | 56 | — |
| T89 | S02 | AH10 | 113 | ○ | ○ | — | 70 | 48 | — |
| T90 | S02 | AH11 | 117 | ○ | Δ | — | 64 | 46 | — |
| T91 | S02 | AH12 | Extruded, but unable to extrude through to the end. | | | | | | |
| T92 | S02 | A10 | 117 | ○ | ○ | — | 18 | 12 | — |
| T93 | S02 | B1 | 117 | ○ | — | — | 22 | 12 | ○ |
| T94 | S02 | B2 | 118 | ○ | ○ | — | — | — | — |
| T95 | S02 | B3 | 117 | ○ | ○ | — | 30 | 20 | — |
| T96 | S02 | BH1 | — | — | — | — | — | — | — |
| T97 | S02 | BH2 | 115 | ○ | X | — | 72 | 40 | — |
| T98 | S02 | BH3 | 117 | ○ | X | — | 80 | 46 | ○ |
| T99 | S02 | C0 | 110 | ○ | — | ○ | 96 | 68 | — |
| T100 | S02 | C1 | 114 | ○ | ○ | — | 36 | 22 | — |
| T101 | S02 | DH1 | 112 | ○ | X | — | 86 | 58 | — |
| T102 | S02 | D1 | 116 | ○ | ○ | — | 24 | 12 | ○ |
| T103 | S02 | D2 | 115 | ○ | — | — | 22 | 14 | — |

TABLE 35

| Test No. | Alloy No. | Step No. | Tensile Strength ($N/mm^2$) | Elon-gation (%) | Impact Value ($J/cm^2$) | Strength Balance Index f8 | Strength Balance Index f9 | 150° C. Creep Strain (%) |
|---|---|---|---|---|---|---|---|---|
| T88 | S02 | AH9 | 595 | 20.6 | 18.5 | 653 | 672 | — |
| T89 | S02 | AH10 | 593 | 22.0 | 19.0 | 656 | 675 | — |
| T90 | S02 | AH11 | 595 | 22.4 | 19.9 | 658 | 678 | — |
| T91 | S02 | AH12 | Extruded, but unable to extrude through to the end. | | | | | |
| T92 | S02 | A10 | 647 | 22.6 | 16.9 | 716 | 733 | 0.12 |
| T93 | S02 | B1 | 650 | 23.0 | 17.3 | 721 | 738 | — |
| T94 | S02 | B2 | 650 | 23.4 | 17.7 | 722 | 740 | 0.13 |
| T95 | S02 | B3 | 649 | 22.8 | 17.0 | 719 | 736 | — |
| T96 | S02 | BH1 | 649 | 22.4 | 17.2 | 718 | 735 | — |
| T97 | S02 | BH2 | 605 | 18.2 | 14.1 | 658 | 672 | 0.42 |
| T98 | S02 | BH3 | 604 | 17.4 | 13.9 | 654 | 668 | — |
| T99 | S02 | C0 | 564 | 25.4 | 19.7 | 632 | 651 | — |
| T100 | S02 | C1 | 592 | 30.6 | 22.0 | 677 | 699 | — |
| T101 | S02 | DH1 | 568 | 25.0 | 20.2 | 635 | 655 | 0.41 |
| T102 | S02 | D1 | 609 | 34.2 | 22.5 | 706 | 728 | 0.09 |
| T103 | S02 | D2 | 602 | 33.4 | 22.4 | 696 | 718 | — |

TABLE 36

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T104 | S02 | D3 | 51.1 | 0 | 0 | 0.5 | 99.5 | 100 | 0.5 | 51.4 | 0 | 14 | ○ | 0.28 | 0.13 |
| T105 | S02 | DH2 | 49.7 | 0.1 | 0 | 1.0 | 98.9 | 100 | 1.1 | 52.1 | 10 | 26 | ○ | 0.28 | 0.13 |
| T106 | S02 | D4 | 51.9 | 0.6 | 0 | 0 | 99.4 | 100 | 0.6 | 56.5 | 32 | 0 | ○ | 0.26 | 0.12 |
| T107 | S02 | D5 | 50.2 | 0.3 | 0 | 0 | 99.7 | 100 | 0.3 | 53.5 | 14 | 0 | ○ | 0.27 | 0.13 |
| T108 | S02 | DH3 | 49.8 | 0.2 | 0 | 1.7 | 98.1 | 100 | 1.9 | 53.3 | 20 | 32 | ○ | 0.28 | 0.13 |
| T109 | S02 | DH4 | 48.5 | 1.1 | 0 | 0 | 98.9 | 100 | 1.1 | 54.8 | 40 | 0 | ○ | 0.25 | 0.13 |
| T110 | S02 | D6 | 49.0 | 0.6 | 0 | 0 | 99.4 | 100 | 0.6 | 53.6 | 32 | 0 | ○ | 0.26 | 0.13 |
| T111 | S02 | DH5 | 46.2 | 2.0 | 0 | 0 | 98.0 | 100 | 2.0 | 54.7 | 46 | 0 | X | 0.23 | 0.13 |
| T112 | S02 | D7 | 51.3 | 0.2 | 0 | 0 | 99.8 | 100 | 0.2 | 54.0 | 18 | 0 | ○ | 0.27 | 0.13 |
| T113 | S02 | D8 | 51.1 | 0 | 0 | 0 | 100 | 100 | 0 | 51.1 | 0 | 0 | ○ | 0.27 | 0.13 |
| T114 | S02 | EH1 | 43.8 | 2.8 | 0 | 0 | 97.2 | 100 | 2.8 | 53.8 | 56 | 0 | X | 0.21 | 0.13 |
| T115 | S02 | E1 | 51.4 | 0.4 | 0 | 0 | 99.6 | 100 | 0.4 | 55.2 | 24 | 0 | ○ | 0.27 | 0.12 |
| T116 | S02 | FH1 | 44.3 | 2.5 | 0 | 0 | 97.5 | 100 | 2.5 | 53.8 | 44 | 0 | X | 0.22 | 0.13 |
| T117 | S02 | F1 | 50.3 | 0.1 | 0 | 0 | 99.9 | 100 | 0.1 | 52.2 | 14 | 0 | ○ | 0.27 | 0.13 |
| T118 | S02 | F2 | 50.9 | 0.5 | 0 | 0 | 99.5 | 100 | 0.5 | 55.1 | 22 | 0 | ○ | 0.26 | 0.13 |
| T119 | S02 | R1 | 51.6 | 0.1 | 0 | 0 | 99.9 | 100 | 0.1 | 53.5 | 10 | 0 | ○ | 0.27 | 0.13 |

TABLE 37

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T104 | S02 | D3 | 115 | ○ | ○ | — | 30 | 20 | — |
| T105 | S02 | DH2 | 114 | ○ | Δ | — | 62 | 34 | ○ |
| T106 | S02 | D4 | 116 | ○ | ○ | — | 60 | 36 | — |
| T107 | S02 | D5 | 115 | ○ | — | — | 38 | 26 | — |
| T108 | S02 | DH3 | 113 | ○ | Δ | — | 76 | 44 | — |
| T109 | S02 | DH4 | 113 | ○ | Δ | — | 70 | 44 | — |
| T110 | S02 | D6 | 114 | ○ | ○ | — | 56 | 36 | — |
| Till | S02 | DH5 | 114 | ○ | X | — | 79 | 57 | — |
| T112 | S02 | D7 | 115 | ○ | ○ | — | 34 | 20 | — |
| T113 | S02 | D8 | 116 | ○ | ○ | — | 20 | 12 | — |
| T114 | S02 | EH1 | 110 | ○ | — | ○ | 94 | 66 | — |
| T115 | S02 | E1 | 114 | ○ | ○ | — | 44 | 24 | — |
| T116 | S02 | FH1 | 111 | ○ | X | — | 104 | 54 | ○ |
| T117 | S02 | F1 | 115 | ○ | ○ | — | 30 | 12 | ○ |
| T118 | S02 | F2 | 114 | ○ | — | — | 44 | 22 | — |
| T119 | S02 | R1 | — | — | — | — | 26 | 14 | — |

TABLE 38

| Test No. | Alloy No. | Step No. | Tensile Strength ($N/mm^2$) | Elon-gation (%) | Impact Value ($J/cm^2$) | Strength Balance Index f8 | Strength Balance Index f9 | 150° C. Creep Strain (%) |
|---|---|---|---|---|---|---|---|---|
| T104 | S02 | D3 | 600 | 32.0 | 21.7 | 689 | 711 | 0.16 |
| T105 | S02 | DH2 | 587 | 29.2 | 21.3 | 667 | 689 | — |
| T106 | S02 | D4 | 625 | 30.8 | 20.4 | 715 | 735 | — |
| T107 | S02 | D5 | 598 | 32.4 | 22.0 | 688 | 710 | — |
| T108 | S02 | DH3 | 570 | 29.6 | 20.6 | 649 | 670 | — |
| T109 | S02 | DH4 | 576 | 28.8 | 20.3 | 654 | 674 | — |
| T110 | S02 | D6 | 596 | 31.4 | 21.6 | 683 | 704 | 0.27 |
| Till | S02 | DH5 | 579 | 27.6 | 20.0 | 654 | 674 | — |
| T112 | S02 | D7 | 602 | 33.6 | 21.9 | 696 | 717 | — |
| T113 | S02 | D8 | 618 | 32.8 | 22.1 | 712 | 734 | — |
| T114 | S02 | EH1 | 561 | 26.2 | 19.7 | 630 | 650 | 0.42 |
| T115 | S02 | E1 | 587 | 31.4 | 22.3 | 673 | 695 | 0.18 |
| T116 | S02 | FH1 | 568 | 27.4 | 20.6 | 641 | 662 | — |
| T117 | S02 | F1 | 602 | 34.0 | 22.5 | 697 | 720 | 0.15 |
| T118 | S02 | F2 | 596 | 32.8 | 21.2 | 687 | 709 | — |
| T119 | S02 | R1 | — | — | 22.1 | — | — | — |

TABLE 39

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T121 | S03 | AH1 | 34.3 | 3.6 | 0 | 0 | 96.4 | 100 | 3.6 | 45.7 | 60 | 0 | X | 0.15 | 0.12 |
| T122 | S03 | AH2 | 33.8 | 3.5 | 0 | 0 | 96.5 | 100 | 3.5 | 45.0 | 54 | 0 | X | 0.17 | 0.12 |
| T123 | S03 | A1 | 41.7 | 0.1 | 0 | 0 | 99.9 | 100 | 0.1 | 43.6 | 14 | 0 | ○ | 0.21 | 0.12 |
| T124 | S03 | A2 | 42.4 | 0.2 | 0 | 0 | 99.8 | 100 | 0.2 | 45.1 | 14 | 0 | ○ | 0.21 | 0.12 |
| T125 | S03 | A3 | 42.7 | 0 | 0 | 0 | 100 | 100 | 0 | 42.7 | 0 | 4 | ○ | 0.21 | 0.12 |
| T126 | S03 | A4 | 42.2 | 0.1 | 0 | 0.7 | 99.2 | 100 | 0.8 | 44.4 | 10 | 20 | ○ | 0.21 | 0.12 |
| T127 | S03 | AH3 | 40.3 | 0.1 | 0 | 2.6 | 97.3 | 100 | 2.7 | 43.5 | 16 | 36 | ○ | 0.22 | 0.12 |
| T128 | S03 | AH4 | 35.9 | 0.1 | 0 | 5.3 | 94.6 | 100 | 5.4 | 40.4 | 10 | 44 | ○ | 0.22 | 0.13 |
| T129 | S03 | A5 | 42.6 | 0.4 | 0 | 0 | 99.6 | 100 | 0.4 | 46.3 | 22 | 0 | ○ | 0.21 | 0.12 |
| T130 | S03 | A6 | 41.5 | 0.3 | 0 | 0 | 99.7 | 100 | 0.3 | 44.8 | 18 | 0 | ○ | 0.21 | 0.12 |
| T131 | S03 | AH5 | 40.9 | 1.4 | 0 | 0 | 98.6 | 100 | 1.4 | 48.0 | 42 | 0 | X | 0.19 | 0.12 |
| T132 | S03 | AH6 | 40.4 | 1.3 | 0 | 0 | 98.7 | 100 | 1.3 | 47.2 | 48 | 0 | Δ | 0.19 | 0.12 |
| T133 | S03 | AH7 | 40.0 | 1.1 | 0 | 0 | 98.9 | 100 | 1.1 | 46.3 | 40 | 0 | Δ | 0.20 | 0.12 |
| T134 | S03 | A7 | 40.7 | 0.7 | 0 | 0 | 99.3 | 100 | 0.7 | 45.7 | 30 | 0 | Δ | 0.20 | 0.12 |
| T135 | S03 | A8 | 40.9 | 0.3 | 0 | 0 | 99.7 | 100 | 0.3 | 44.2 | 22 | 0 | ○ | 0.21 | 0.12 |
| T136 | S03 | AH8 | 39.3 | 0.5 | 0 | 2.6 | 96.9 | 100 | 3.1 | 44.8 | 24 | 42 | Δ | 0.21 | 0.12 |
| T137 | S03 | A9 | 41.5 | 0.3 | 0 | 0 | 99.7 | 100 | 0.3 | 44.8 | 16 | 0 | ○ | 0.21 | 0.12 |
| T138 | S03 | AH9 | 39.8 | 1.1 | 0 | 0 | 98.9 | 100 | 1.1 | 46.1 | 48 | 0 | ○ | 0.20 | 0.12 |
| T139 | S03 | AH10 | 40.6 | 1.0 | 0 | 0 | 99.0 | 100 | 1.0 | 46.6 | 38 | 0 | ○ | 0.20 | 0.12 |
| T140 | S03 | AH11 | 39.9 | 1.0 | 0 | 0 | 99.0 | 100 | 1.0 | 45.9 | 40 | 0 | X | 0.20 | 0.12 |

TABLE 40

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T121 | S03 | AH1 | 110 | ○ | X | ○ | 110 | — | ○ |
| T122 | S03 | AH2 | 114 | ○ | X | — | 104 | 66 | — |
| T123 | S03 | A1 | 117 | ○ | ○ | — | 22 | 16 | ○ |
| T124 | S03 | A2 | 116 | ○ | ○ | — | 30 | 18 | — |
| T125 | S03 | A3 | 118 | ○ | — | — | 26 | 16 | — |
| T126 | S03 | A4 | 116 | ○ | ○ | — | 52 | 28 | — |
| T127 | S03 | AH3 | 116 | ○ | X | — | 76 | — | — |
| T128 | S03 | AH4 | 119 | ○ | X | — | 84 | 56 | — |
| T129 | S03 | A5 | 116 | ○ | ○ | — | 42 | 26 | — |
| T130 | S03 | A6 | 116 | ○ | ○ | — | 40 | 24 | — |
| T131 | S03 | AH5 | 120 | Δ | Δ | — | 80 | 48 | — |
| T132 | S03 | AH6 | 115 | ○ | X | — | 82 | 52 | — |
| T133 | S03 | AH7 | 116 | ○ | Δ | — | 74 | 42 | — |
| T134 | S03 | A7 | 115 | ○ | ○ | — | 54 | 34 | — |
| T135 | S03 | A8 | 117 | ○ | — | — | 40 | 26 | — |
| T136 | S03 | AH8 | 115 | ○ | X | — | 82 | 52 | ○ |
| T137 | S03 | A9 | 116 | ○ | ○ | — | 34 | 20 | — |
| T138 | S03 | AH9 | 115 | ○ | Δ | — | 78 | — | — |
| T139 | S03 | AH10 | 113 | ○ | — | — | 66 | — | — |
| T140 | S03 | AH11 | 120 | ○ | Δ | — | 72 | 44 | ○ |

TABLE 41

| Test No. | Alloy No. | Step No. | Tensile Strength ($N/mm^2$) | Elon-gation (%) | Impact Value ($J/cm^2$) | Strength Balance Index f8 | Strength Balance Index f9 | 150° C. Creep Strain (%) |
|---|---|---|---|---|---|---|---|---|
| T121 | S03 | AH1 | 555 | 27.8 | 22.2 | 627 | 650 | — |
| T122 | S03 | AH2 | 590 | 23.6 | 18.7 | 656 | 675 | 0.45 |
| T123 | S03 | A1 | 616 | 28.0 | 26.9 | 697 | 724 | — |
| T124 | S03 | A2 | 615 | 27.2 | 26.2 | 694 | 720 | 0.18 |
| T125 | S03 | A3 | 617 | 26.4 | 26.7 | 694 | 720 | — |
| T126 | S03 | A4 | 607 | 25.8 | 24.8 | 681 | 706 | — |
| T127 | S03 | AH3 | 594 | 22.2 | 21.1 | 657 | 678 | 0.41 |
| T128 | S03 | AH4 | 586 | 19.0 | 17.4 | 639 | 657 | — |
| T129 | S03 | A5 | 627 | 25.8 | 24.7 | 703 | 728 | 0.20 |
| T130 | S03 | A6 | 606 | 26.6 | 26.3 | 682 | 708 | — |
| T131 | S03 | AH5 | 558 | 26.8 | 21.1 | 628 | 649 | — |
| T132 | S03 | AH6 | 597 | 20.6 | 20.9 | 656 | 677 | — |

TABLE 41-continued

| Test No. | Alloy No. | Step No. | Tensile Strength ($N/mm^2$) | Elon-gation (%) | Impact Value ($J/cm^2$) | Strength Balance Index f8 | Strength Balance Index f9 | 150° C. Creep Strain (%) |
|---|---|---|---|---|---|---|---|---|
| T133 | S03 | AH7 | 595 | 23.2 | 22.9 | 660 | 683 | 0.35 |
| T134 | S03 | A7 | 605 | 25.4 | 25.1 | 677 | 703 | 0.23 |
| T135 | S03 | A8 | 613 | 26.4 | 26.6 | 689 | 716 | — |
| T136 | S03 | AH8 | 586 | 21.8 | 21.4 | 647 | 668 | — |
| T137 | S03 | A9 | 615 | 28.2 | 26.3 | 696 | 723 | — |
| T138 | S03 | AH9 | 592 | 22.2 | 22.5 | 654 | 677 | — |
| T139 | S03 | AH10 | 589 | 24.0 | 22.4 | 656 | 678 | — |
| T140 | S03 | AH11 | 573 | 24.8 | 24.0 | 640 | 664 | — |

TABLE 42

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T141 | S03 | A10 | 42.5 | 0.1 | 0 | 0 | 99.9 | 100 | 0.1 | 44.4 | 14 | 0 | ○ | 0.21 | 0.12 |
| T142 | S03 | A11 | 42.1 | 0.1 | 0 | 0 | 99.9 | 100 | 0.1 | 44.0 | 12 | 0 | ○ | 0.21 | 0.12 |
| T143 | S03 | A12 | 43.0 | 0.1 | 0 | 0 | 99.9 | 100 | 0.1 | 44.9 | 8 | 0 | ○ | 0.21 | 0.12 |
| T144 | S03 | A13 | 40.0 | 0.8 | 0 | 0 | 99.2 | 100 | 0.8 | 45.4 | 30 | 0 | Δ | 0.20 | 0.12 |
| T145 | S03 | A14 | 41.2 | 0.4 | 0 | 0 | 99.6 | 100 | 0.4 | 45.0 | 24 | 0 | ○ | 0.21 | 0.12 |
| T146 | S03 | AH13 | 37.1 | 1.8 | 0 | 0 | 98.2 | 100 | 1.8 | 45.1 | 44 | 0 | X | 0.19 | 0.12 |
| T147 | S03 | AH14 | 38.9 | 0.5 | 0 | 2 | 97.5 | 100 | 2.5 | 44.1 | 24 | 38 | ○ | 0.21 | 0.12 |
| T148 | S03 | B1 | 42.3 | 0.2 | 0 | 0 | 99.8 | 100 | 0.2 | 45.0 | 18 | 1 | ○ | 0.21 | 0.12 |
| T149 | S03 | B2 | 43.1 | 0.1 | 0 | 0 | 99.9 | 100 | 0.1 | 45.0 | 10 | 5 | ○ | 0.21 | 0.12 |
| T150 | S03 | BH2 | 39.4 | 0 | 0 | 2.5 | 97.5 | 100 | 2.5 | 40.7 | 0 | 32 | ○ | 0.22 | 0.12 |
| T151 | S03 | BH3 | 38.8 | 0.1 | 0 | 3 | 96.9 | 100 | 3.1 | 42.2 | 10 | 44 | ○ | 0.22 | 0.13 |
| T152 | S03 | C0 | 34.7 | 3.8 | 0 | 0 | 96.2 | 100 | 3.8 | 46.4 | 67 | 0 | X | 0.16 | 0.12 |
| T153 | S03 | C1 | 40.8 | 0.4 | 0 | 0 | 99.6 | 100 | 0.4 | 44.6 | 22 | 0 | ○ | 0.21 | 0.12 |
| T154 | S03 | DH1 | 35.3 | 3.4 | 0 | 0 | 96.6 | 100 | 3.4 | 46.4 | 63 | 0 | X | 0.15 | 0.12 |
| T155 | S03 | D1 | 43.0 | 0.1 | 0 | 0 | 99.9 | 100 | 0.1 | 44.9 | 12 | 0 | ○ | 0.21 | 0.12 |
| T156 | S03 | D2 | 42.2 | 0.2 | 0 | 0 | 99.8 | 100 | 0.2 | 44.9 | 14 | 3 | ○ | 0.21 | 0.12 |
| T157 | S03 | D3 | 41.8 | 0.2 | 0 | 0.7 | 99.1 | 100 | 0.9 | 44.8 | 20 | 18 | ○ | 0.21 | 0.12 |
| T158 | S03 | DH2 | 39.9 | 0.1 | 0 | 1.5 | 98.4 | 100 | 1.6 | 42.5 | 10 | 28 | ○ | 0.22 | 0.12 |
| T159 | S03 | D4 | 42.1 | 0.6 | 0 | 0 | 99.4 | 100 | 0.6 | 46.7 | 34 | 0 | ○ | 0.20 | 0.12 |
| T160 | S03 | D5 | 41.7 | 0.8 | 0 | 0 | 99.2 | 100 | 0.8 | 47.1 | 28 | 0 | ○ | 0.20 | 0.12 |

TABLE 43

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T141 | S03 | A10 | 118 | ○ | ○ | — | 30 | 18 | — |
| T142 | S03 | A11 | 121 | ○ | Δ | — | 32 | — | — |
| T143 | S03 | A12 | 117 | ○ | ○ | — | 28 | — | — |
| T144 | S03 | A13 | 118 | ○ | ○ | — | 60 | — | — |
| T145 | S03 | A14 | 116 | ○ | ○ | — | 44 | 24 | — |
| T146 | S03 | AH13 | 116 | ○ | X | — | 78 | 48 | ○ |
| T147 | S03 | AH14 | 115 | ○ | X | — | 78 | 54 | ○ |
| T148 | S03 | B1 | 118 | ○ | ○ | — | 32 | 22 | — |
| T149 | S03 | B2 | 118 | ○ | ○ | — | 28 | 18 | — |
| T150 | S03 | BH2 | 122 | ○ | X | — | 74 | 38 | — |
| T151 | S03 | BH3 | 119 | ○ | X | — | 86 | 48 | ○ |
| T152 | S03 | C0 | 110 | ○ | — | — | — | — | — |
| T153 | S03 | C1 | 115 | ○ | — | — | 42 | 26 | — |
| T154 | S03 | DH1 | 112 | ○ | — | — | 96 | 78 | ○ |
| T155 | S03 | D1 | 115 | ○ | — | — | 24 | 16 | — |
| T156 | S03 | D2 | 115 | ○ | ○ | — | 30 | 18 | — |
| T157 | S03 | D3 | 115 | ○ | — | — | 56 | 32 | — |
| T158 | S03 | DH2 | 116 | ○ | Δ | — | 64 | 40 | — |
| T159 | S03 | D4 | 114 | ○ | ○ | — | 56 | 36 | — |
| T160 | S03 | D5 | 112 | ○ | ○ | — | 54 | 32 | — |

TABLE 44

| Test No. | Alloy No. | Step No. | Tensile Strength ($N/mm^2$) | Elon-gation (%) | Impact Value ($J/cm^2$) | Strength Balance Index f8 | Strength Balance Index f9 | 150° C. Creep Strain (%) |
|---|---|---|---|---|---|---|---|---|
| T141 | S03 | A10 | 650 | 24.8 | 21.1 | 726 | 747 | 0.17 |
| T142 | S03 | A11 | 688 | 21.4 | 18.3 | 758 | 776 | 0.17 |
| T143 | S03 | A12 | 631 | 26.0 | 24.8 | 708 | 733 | — |
| T144 | S03 | A13 | 575 | 31.8 | 25.1 | 660 | 685 | — |
| T145 | S03 | A14 | 582 | 33.4 | 26.8 | 672 | 699 | — |
| T146 | S03 | AH13 | 573 | 23.2 | 22.8 | 636 | 659 | — |
| T147 | S03 | AH14 | 580 | 21.0 | 22.6 | 638 | 661 | 0.43 |
| T148 | S03 | B1 | 653 | 25.2 | 21.5 | 731 | 752 | — |
| T149 | S03 | B2 | 650 | 25.8 | 21.5 | 729 | 751 | — |
| T150 | S03 | BH2 | 614 | 19.0 | 17.4 | 670 | 687 | 0.41 |
| T151 | S03 | BH3 | 610 | 18.4 | 16.7 | 664 | 680 | — |
| T152 | S03 | C0 | 554 | 28.2 | 23.1 | 627 | 650 | — |
| T153 | S03 | C1 | 577 | 34.2 | 28.2 | 668 | 697 | — |
| T154 | S03 | DH1 | 559 | 26.0 | 20.3 | 627 | 648 | — |
| T155 | S03 | D1 | 595 | 38.2 | 27.6 | 700 | 728 | — |
| T156 | S03 | D2 | 595 | 38.4 | 28.5 | 700 | 728 | 0.24 |
| T157 | S03 | D3 | 587 | 36.2 | 26.5 | 685 | 712 | — |
| T158 | S03 | DH2 | 574 | 32.0 | 24.4 | 659 | 684 | — |
| T159 | S03 | D4 | 601 | 33.2 | 24.0 | 694 | 718 | — |
| T160 | S03 | D5 | 573 | 34.8 | 25.9 | 665 | 691 | — |

TABLE 45

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T161 | S03 | DH3 | 39.4 | 0.5 | 0 | 2.4 | 97.1 | 100 | 2.9 | 44.8 | 24 | 30 | ○ | 0.21 | 0.12 |
| T162 | S03 | DH4 | 40.0 | 1.2 | 0 | 0 | 98.8 | 100 | 1.2 | 46.6 | 40 | 0 | Δ | 0.19 | 0.12 |
| T163 | S03 | D6 | 40.4 | 0.7 | 0 | 0 | 99.3 | 100 | 0.7 | 45.4 | 32 | 0 | Δ | 0.20 | 0.12 |
| T164 | S03 | D7 | 42.5 | 0.4 | 0 | 0 | 99.6 | 100 | 0.4 | 46.3 | 20 | 0 | ○ | 0.21 | 0.12 |
| T165 | S03 | DH6 | 40.3 | 1.1 | 0 | 0 | 98.9 | 100 | 1.1 | 46.6 | 44 | 0 | ○ | 0.20 | 0.12 |
| T166 | S03 | EH1 | 34.7 | 3.9 | 0 | 0 | 96.1 | 100 | 3.9 | 46.5 | 60 | 0 | X | 0.16 | 0.12 |
| T167 | S03 | E1 | 42.0 | 0.3 | 0 | 0 | 99.7 | 100 | 0.3 | 45.3 | 22 | 0 | ○ | 0.21 | 0.12 |
| T168 | S03 | FH1 | 35.6 | 3.4 | 0 | 0 | 96.6 | 100 | 3.4 | 46.7 | 62 | 0 | X | 0.17 | 0.12 |
| T169 | S03 | F1 | 42.6 | 0.2 | 0 | 0 | 99.8 | 100 | 0.2 | 45.3 | 14 | 0 | ○ | 0.21 | 0.12 |
| T170 | S03 | F2 | 41.8 | 0.5 | 0 | 0 | 99.5 | 100 | 0.5 | 46.0 | 26 | 0 | ○ | 0.20 | 0.12 |
| T171 | S03 | FH2 | 39.0 | 0.4 | 0 | 2.2 | 97.4 | 100 | 2.6 | 43.9 | 22 | 36 | ○ | 0.21 | 0.12 |
| T172 | S03 | F3 | 42.6 | 0.3 | 0 | 0 | 99.7 | 100 | 0.3 | 45.9 | 18 | 0 | ○ | 0.21 | 0.12 |
| T173 | S03 | F4 | 42.2 | 0.3 | 0 | 0 | 99.7 | 100 | 0.3 | 45.5 | 14 | 0 | ○ | 0.21 | 0.12 |
| T174 | S03 | F5 | 41.3 | 0.5 | 0 | 0 | 99.5 | 100 | 0.5 | 45.5 | 24 | 0 | ○ | 0.20 | 0.12 |
| T175 | S03 | PH1 | 35.7 | 4.1 | 0 | 0 | 95.9 | 100 | 4.1 | 47.8 | 71 | 0 | X | 0.16 | 0.12 |
| T176 | S03 | P1 | 42.3 | 0.4 | 0 | 0 | 99.6 | 100 | 0.4 | 46.1 | 14 | 0 | ○ | 0.21 | 0.12 |
| T177 | S03 | P2 | 42.0 | 0.5 | 0 | 0 | 99.5 | 100 | 0.5 | 46.2 | 26 | 0 | ○ | 0.20 | 0.12 |
| T178 | S03 | PH2 | 39.4 | 0.7 | 0 | 2.0 | 97.3 | 100 | 2.7 | 45.4 | 30 | 32 | ○ | 0.21 | 0.12 |
| T179 | S03 | P3 | 40.1 | 0.4 | 0 | 0 | 99.6 | 100 | 0.4 | 43.8 | 22 | 0 | Δ | 0.21 | 0.12 |
| T180 | S03 | PH3 | 39.6 | 1.1 | 0 | 0 | 98.9 | 100 | 1.1 | 45.9 | 46 | 0 | ○ | 0.20 | 0.12 |

TABLE 46

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T161 | S03 | DH3 | 114 | ○ | — | — | 80 | — | — |
| T162 | S03 | DH4 | 116 | ○ | — | — | 72 | 40 | — |
| T163 | S03 | D6 | 117 | ○ | — | — | 62 | 34 | — |
| T164 | S03 | D7 | 113 | ○ | ○ | — | 42 | 24 | — |
| T165 | S03 | DH6 | 114 | ○ | Δ | — | 68 | 44 | — |
| T166 | S03 | EH1 | 111 | ○ | — | ○ | 98 | 74 | — |
| T167 | S03 | E1 | 114 | ○ | ○ | — | 40 | 22 | — |
| T168 | S03 | FH1 | 110 | ○ | X | — | 106 | 72 | — |
| T169 | S03 | F1 | 115 | ○ | ○ | — | 30 | 14 | — |
| T170 | S03 | F2 | 114 | ○ | — | — | 48 | 28 | — |
| T171 | S03 | FH2 | 115 | ○ | — | — | 78 | 44 | — |
| T172 | S03 | F3 | 114 | ○ | — | — | 38 | 18 | — |

TABLE 46-continued

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T173 | S03 | F4 | 114 | ○ | ○ | — | 34 | 20 | — |
| T174 | S03 | F5 | 114 | ○ | ○ | — | 46 | 28 | ○ |
| T175 | S03 | PH1 | 109 | ○ | — | ○ | 110 | 82 | — |
| T176 | S03 | P1 | 113 | ○ | — | — | 34 | 18 | — |
| T177 | S03 | P2 | 112 | ○ | — | — | 48 | 30 | ○ |
| T178 | S03 | PH2 | 111 | ○ | — | — | 86 | 52 | ○ |
| T179 | S03 | P3 | 114 | ○ | — | — | 42 | 26 | — |
| T180 | S03 | PH3 | 112 | ○ | — | — | 84 | 48 | ○ |

TABLE 47

| Test No. | Alloy No. | Step No. | Tensile Strength ($N/mm^2$) | Elon-gation (%) | Impact Value ($J/cm^2$) | Strength Balance Index f8 | Strength Balance Index f9 | 150° C. Creep Strain (%) |
|---|---|---|---|---|---|---|---|---|
| T161 | S03 | DH3 | 567 | 30.6 | 23.8 | 648 | 672 | — |
| T162 | S03 | DH4 | 576 | 31.6 | 24.7 | 661 | 685 | — |
| T163 | S03 | D6 | 579 | 33.8 | 25.3 | 670 | 696 | — |
| T164 | S03 | D7 | 579 | 36.4 | 25.5 | 676 | 701 | — |
| T165 | S03 | DH6 | 585 | 30.2 | 24.1 | 668 | 692 | — |
| T166 | S03 | EH1 | 550 | 28.8 | 23.4 | 624 | 648 | — |
| T167 | S03 | E1 | 574 | 35.0 | 27.7 | 667 | 694 | — |
| T168 | S03 | FH1 | 556 | 26.6 | 22.3 | 626 | 648 | — |
| T169 | S03 | F1 | 586 | 38.8 | 27.4 | 690 | 718 | 0.19 |
| T170 | S03 | F2 | 584 | 36.4 | 26.0 | 682 | 708 | — |
| T171 | S03 | FH2 | 566 | 29.8 | 23.7 | 645 | 669 | — |
| T172 | S03 | F3 | 588 | 37.2 | 26.3 | 689 | 715 | — |
| T173 | S03 | F4 | 577 | 35.8 | 26.5 | 672 | 699 | — |
| T174 | S03 | F5 | 574 | 34.4 | 26.2 | 665 | 692 | 0.21 |
| T175 | S03 | PH1 | — | — | 24.4 | — | — | — |
| T176 | S03 | P1 | — | — | 31.5 | — | — | 0.20 |
| T177 | S03 | P2 | — | — | 29.6 | — | — | — |
| T178 | S03 | PH2 | — | — | — | — | — | — |
| T179 | S03 | P3 | — | — | — | — | — | — |
| T180 | S03 | PH3 | — | — | — | — | — | — |

TABLE 48

| Test No. | Alloy No. | Step No. | Wear Resistance: Amsler Abrasion Test | Wear Resistance: Ball-On-Disk Abrasion Test |
|---|---|---|---|---|
| T35 | S01 | C0 | Δ | ○ |
| T36 | S01 | C1 | ◎ | ○ |
| T51 | S01 | EH1 | Δ | ○ |
| T52 | S01 | E1 | ◎ | ○ |
| T114 | S02 | EH1 | ○ | ○ |

TABLE 48-continued

| Test No. | Alloy No. | Step No. | Wear Resistance: Amsler Abrasion Test | Wear Resistance: Ball-On-Disk Abrasion Test |
|---|---|---|---|---|
| T115 | S02 | E1 | ◎ | ◎ |
| T166 | S03 | EH1 | Δ | ○ |
| T167 | S03 | E1 | ◎ | ○ |

TABLE 49

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T201 | S11 | EH1 | 40.1 | 2.2 | 0 | 0 | 97.8 | 100 | 2.2 | 49.0 | 60 | 0 | X | 0.21 | 0.11 |
| T202 | S11 | E1 | 47.3 | 0.2 | 0 | 0 | 99.8 | 100 | 0.2 | 50.0 | 16 | 0 | ○ | 0.26 | 0.10 |
| T203 | S11 | FH1 | 40.5 | 1.9 | 0 | 0 | 98.1 | 100 | 1.9 | 48.8 | 52 | 0 | X | 0.22 | 0.11 |
| T204 | S11 | F1 | 48.3 | 0 | 0 | 0 | 100 | 100 | 0 | 48.3 | 0 | 0 | ○ | 0.26 | 0.10 |
| T205 | S11 | F4 | 46.2 | 0.3 | 0 | 0 | 99.7 | 100 | 0.3 | 49.5 | 16 | 0 | ○ | 0.26 | 0.10 |
| T206 | S11 | PH1 | 39.8 | 2.6 | 0 | 0 | 97.4 | 100 | 2.6 | 49.5 | 62 | 0 | X | 0.20 | 0.10 |
| T207 | S11 | P1 | 48.6 | 0.4 | 0 | 0 | 99.6 | 100 | 0.4 | 52.4 | 20 | 0 | ○ | 0.25 | 0.10 |
| T208 | S12 | EH1 | 30.4 | 5.4 | 0 | 0 | 94.6 | 100 | 5.4 | 44.3 | 90 | 0 | X | 0.18 | 0.09 |
| T209 | S12 | E1 | 36.6 | 0.9 | 0 | 0 | 99.1 | 100 | 0.9 | 42.3 | 38 | 0 | ○ | 0.29 | 0.10 |
| T210 | S13 | EH1 | 31.7 | 3.4 | 0 | 0 | 96.6 | 100 | 3.4 | 42.8 | 64 | 0 | X | 0.17 | 0.10 |
| T211 | S13 | E1 | 38.0 | 0.3 | 0 | 0 | 99.7 | 100 | 0.3 | 41.3 | 18 | 0 | ○ | 0.21 | 0.10 |
| T212 | S13 | FH1 | 32.2 | 3.1 | 0 | 0 | 96.9 | 100 | 3.1 | 42.8 | 54 | 0 | X | 0.15 | 0.10 |

TABLE 49-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T213 | S13 | F1 | 38.4 | 0.1 | 0 | 0 | 99.9 | 100 | 0.1 | 40.3 | 14 | 0 | ○ | 0.21 | 0.10 |
| T214 | S13 | F4 | 37.2 | 0.4 | 0 | 0 | 99.6 | 100 | 0.4 | 41.0 | 28 | 0 | ○ | 0.20 | 0.10 |
| T215 | S13 | FH2 | 35.8 | 0.3 | 0 | 2.3 | 97.4 | 100 | 2.6 | 40.2 | 22 | 30 | ○ | 0.21 | 0.10 |
| T216 | S14 | EH1 | 53.3 | 0.6 | 0 | 0 | 99.4 | 100 | 0.6 | 57.9 | 44 | 0 | X | 0.15 | 0.11 |
| T217 | S14 | E1 | 63.1 | 0 | 0 | 0 | 100 | 100 | 0 | 63.1 | 0 | 0 | ○ | 0.16 | 0.10 |
| T218 | S15 | E1 | 59.3 | 0 | 0 | 0 | 100 | 100 | 0 | 59.3 | 0 | 0 | ○ | 0.22 | 0.12 |
| T219 | S16 | EH1 | 44.7 | 1.3 | 0 | 0 | 98.7 | 100 | 1.3 | 51.5 | 44 | 0 | X | 0.19 | 0.12 |
| T220 | S16 | E1 | 53.4 | 0 | 0 | 0 | 100 | 100 | 0 | 53.4 | 0 | 0 | ○ | 0.21 | 0.11 |
| T221 | S17 | EH1 | 28.0 | 5.6 | 0 | 0 | 94.4 | 100 | 5.6 | 42.2 | 116 | 0 | X | 0.11 | 0.19 |

TABLE 50

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T201 | S11 | EH1 | 112 | ○ | X | ○ | 96 | 58 | — |
| T202 | S11 | E1 | 115 | ○ | ○ | — | 28 | 16 | — |
| T203 | S11 | FH1 | 113 | ○ | X | — | 92 | 50 | — |
| T204 | S11 | F1 | 116 | ○ | ○ | — | 26 | 12 | — |
| T205 | S11 | F4 | 115 | ○ | ○ | — | 32 | 16 | — |
| T206 | S11 | PH1 | 110 | ○ | — | ○ | 100 | 64 | ○ |
| T207 | S11 | P1 | 113 | ○ | — | — | 36 | 20 | — |
| T208 | S12 | EH1 | 110 | ○ | X | ○ | 112 | 64 | ○ |
| T209 | S12 | E1 | 117 | ○ | Δ | — | 62 | 36 | — |
| T210 | S13 | EH1 | 116 | ○ | X | ○ | 110 | 72 | — |
| T211 | S13 | E1 | 121 | ○ | ○ | — | 32 | 20 | — |
| T212 | S13 | FH1 | 117 | ○ | X | — | 100 | 62 | — |
| T213 | S13 | F1 | 122 | ○ | ○ | — | 26 | 16 | — |
| T214 | S13 | F4 | 121 | ○ | ○ | — | 44 | 28 | — |
| T215 | S13 | FH2 | 121 | ○ | Δ | — | 76 | 54 | — |
| T216 | S14 | EH1 | 120 | ○ | X | ○ | 50 | 42 | ○ |
| T217 | S14 | E1 | 126 | ○ | Δ | — | 30 | 26 | — |
| T218 | S15 | E1 | 127 | Δ | ○ | ○ | 22 | 28 | — |
| T219 | S16 | EH1 | 115 | ○ | X | — | 72 | 48 | — |
| T220 | S16 | E1 | 118 | ○ | ○ | — | 38 | 32 | — |
| T221 | S17 | EH1 | 114 | ○ | X | ○ | 124 | 92 | Δ |

TABLE 51

| Test No. | Alloy No. | Step No. | Tensile Strength ($N/mm^2$) | Elon-gation (%) | Impact Value ($J/cm^2$) | Strength Balance Index f8 | Strength Balance Index f9 | 150° C. Creep Strain (%) |
|---|---|---|---|---|---|---|---|---|
| T201 | S11 | EH1 | 561 | 25.4 | 22.4 | 628 | 651 | 0.47 |
| T202 | S11 | E1 | 590 | 30.8 | 24.1 | 675 | 699 | 0.15 |
| T203 | S11 | FH1 | 565 | 26.2 | 22.8 | 635 | 658 | — |
| T204 | S11 | F1 | 596 | 33.8 | 24.8 | 690 | 715 | 0.08 |
| T205 | S11 | F4 | 588 | 33.4 | 24.0 | 679 | 703 | 0.14 |
| T206 | S11 | PH1 | — | — | — | — | — | — |
| T207 | S11 | P1 | — | — | — | — | — | 0.16 |
| T208 | S12 | EH1 | 538 | 22.2 | 19.0 | 595 | 614 | 0.63 |
| T209 | S12 | E1 | 576 | 37.0 | 32.7 | 674 | 707 | 0.24 |
| T210 | S13 | EH1 | 551 | 27.0 | 24.5 | 621 | 645 | — |
| T211 | S13 | E1 | 587 | 38.0 | 31.7 | 690 | 721 | — |
| T212 | S13 | FH1 | 554 | 27.4 | 23.8 | 625 | 649 | 0.42 |
| T213 | S13 | F1 | 584 | 41.8 | 33.7 | 695 | 729 | 0.12 |
| T214 | S13 | F4 | 579 | 42.4 | 33.2 | 691 | 724 | 0.18 |
| T215 | S13 | FH2 | 564 | 33.6 | 29.7 | 652 | 682 | 0.33 |
| T216 | S14 | EH1 | 587 | 20.2 | 14.8 | 644 | 660 | — |
| T217 | S14 | E1 | 618 | 20.6 | 15.9 | 679 | 695 | 0.08 |
| T218 | S15 | E1 | 610 | 23.8 | 18.4 | 679 | 697 | 0.11 |
| T219 | S16 | EH1 | 576 | 24.0 | 18.2 | 641 | 641 | — |
| T220 | S16 | E1 | 605 | 27.2 | 21.7 | 682 | 704 | 0.07 |
| T221 | S17 | EH1 | 533 | 21.4 | 18.8 | 587 | 606 | 0.47 |

TABLE 52

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T222 | S17 | E1 | 32.8 | 0.8 | 0 | 0 | 99.2 | 100 | 0.8 | 38.2 | 36 | 0 | ○ | 0.19 | 0.20 |
| T223 | S18 | EH1 | 27.5 | 2.2 | 0 | 0 | 97.8 | 100 | 2.2 | 36.4 | 52 | 0 | X | 0.12 | 0.13 |
| T224 | S18 | E1 | 30.8 | 0.2 | 0 | 0 | 99.8 | 100 | 0.2 | 33.5 | 32 | 0 | Δ | 0.14 | 0.13 |
| T225 | S19 | EH1 | 34.3 | 4.3 | 0 | 0 | 95.7 | 100 | 4.3 | 46.7 | 90 | 0 | X | 0.13 | 0.17 |
| T226 | S19 | E1 | 42.0 | 0.5 | 0 | 0 | 99.5 | 100 | 0.5 | 46.2 | 30 | 0 | ○ | 0.16 | 0.17 |
| T227 | S20 | FH1 | 40.5 | 2.7 | 0 | 0 | 97.3 | 100 | 2.7 | 50.4 | 62 | 0 | X | 0.18 | 0.13 |
| T228 | S20 | F1 | 47.0 | 0.1 | 0 | 0 | 99.9 | 100 | 0.1 | 48.9 | 12 | 0 | ○ | 0.24 | 0.13 |
| T229 | S20 | F4 | 46.5 | 0.3 | 0 | 0 | 99.7 | 100 | 0.3 | 49.8 | 22 | 0 | ○ | 0.23 | 0.13 |
| T230 | S21 | EH1 | 34.9 | 2.3 | 0 | 0 | 97.7 | 100 | 2.3 | 44.0 | 72 | 0 | X | 0.24 | 0.10 |
| T231 | S21 | E1 | 41.8 | 0.2 | 0 | 0 | 99.8 | 100 | 0.2 | 44.5 | 24 | 0 | ○ | 0.28 | 0.09 |
| T232 | S22 | EH1 | 24.9 | 5.5 | 0 | 0 | 94.5 | 100 | 5.5 | 39.0 | 136 | 0 | X | 0.12 | 0.15 |
| T233 | S22 | E1 | 28.8 | 0.9 | 0 | 0 | 99.1 | 100 | 0.9 | 34.5 | 34 | 0 | Δ | 0.20 | 0.16 |
| T234 | S22 | F1 | 28.7 | 1.0 | 0 | 0 | 99.0 | 100 | 1.0 | 34.7 | 36 | 0 | Δ | 0.20 | 0.16 |
| T235 | S23 | F1 | 40.7 | 0.2 | 0 | 0 | 99.8 | 100 | 0.2 | 43.4 | 26 | 0 | ○ | 0.27 | 0.15 |
| T236 | S24 | E1 | 48.9 | 0.3 | 0 | 0 | 99.7 | 100 | 0.3 | 52.2 | 32 | 0 | ○ | 0.16 | 0.08 |
| T240 | S30 | EH1 | 34.9 | 1.6 | 0 | 0 | 98.4 | 100 | 1.6 | 42.5 | 54 | 0 | X | 0.16 | 0.12 |
| T241 | S30 | E1 | 39.3 | 0 | 0 | 0 | 100 | 100 | 0 | 39.3 | 0 | 0 | ○ | 0.18 | 0.12 |
| T242 | S31 | FH1 | 38.0 | 1.1 | 0 | 0 | 98.9 | 100 | 1.1 | 44.3 | 42 | 0 | X | 0.12 | 0.12 |
| T243 | S31 | F1 | 45.1 | 0.1 | 0 | 0 | 99.9 | 100 | 0.1 | 47.0 | 12 | 0 | ○ | 0.13 | 0.12 |
| T244 | S32 | EH1 | 29.5 | 3.3 | 0 | 0 | 96.7 | 100 | 3.3 | 40.4 | 66 | 0 | X | 0.22 | 0.17 |
| T245 | S32 | E1 | 35.2 | 0.3 | 0 | 0 | 99.7 | 100 | 0.3 | 38.3 | 16 | 0 | ○ | 0.27 | 0.17 |

TABLE 53

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T222 | S17 | E1 | 127 | ○ | Δ | — | 64 | 38 | — |
| T223 | S18 | EH1 | 126 | ○ | Δ | ○ | 90 | 56 | — |
| T224 | S18 | E1 | 130 | Δ | ○ | — | 64 | 38 | — |
| T225 | S19 | EH1 | 110 | ○ | X | ○ | 118 | 86 | — |
| T226 | S19 | E1 | 115 | ○ | Δ | — | 66 | 36 | — |
| T227 | S20 | FH1 | 112 | ○ | X | ○ | 98 | 70 | — |
| T228 | S20 | F1 | 116 | ○ | ○ | — | 28 | 16 | — |
| T229 | S20 | F4 | 116 | ○ | ○ | — | 34 | 22 | — |
| T230 | S21 | EH1 | 116 | ○ | X | ○ | 114 | 98 | — |
| T231 | S21 | E1 | 119 | ○ | ○ | — | 34 | 18 | — |
| T232 | S22 | EH1 | 117 | ○ | X | — | 132 | 92 | — |
| T233 | S22 | E1 | 126 | ○ | ○ | — | 66 | 40 | — |
| T234 | S22 | F1 | 126 | ○ | ○ | — | 68 | 38 | — |
| T235 | S23 | F1 | 124 | ○ | ○ | — | 48 | 28 | — |
| T236 | S24 | E1 | 117 | ○ | Δ | — | 56 | 34 | — |
| T240 | S30 | EH1 | 119 | ○ | Δ | ○ | 78 | 52 | — |
| T241 | S30 | E1 | 125 | ○ | ○ | — | 20 | 8 | — |
| T242 | S31 | FH1 | 121 | ○ | ○ | ○ | 74 | 44 | ○ |
| T243 | S31 | F1 | 120 | ○ | ○ | — | 26 | 12 | — |
| T244 | S32 | EH1 | 116 | ○ | — | — | 84 | 58 | — |
| T245 | S32 | E1 | 122 | ○ | — | — | 28 | 16 | — |

TABLE 54

| Test No. | Alloy No. | Step No. | Tensile Strength ($N/mm^2$) | Elon-gation (%) | Impact Value ($J/cm^2$) | Strength Balance Index f8 | Strength Balance Index f9 | 150° C. Creep Strain (%) |
|---|---|---|---|---|---|---|---|---|
| T222 | S17 | E1 | 571 | 34.8 | 28.9 | 663 | 692 | 0.32 |
| T223 | S18 | EH1 | 524 | 32.0 | 31.2 | 602 | 633 | — |
| T224 | S18 | E1 | 551 | 43.6 | 43.2 | 660 | 703 | 0.19 |
| T225 | S19 | EH1 | 550 | 23.2 | 20.5 | 610 | 631 | — |
| T226 | S19 | E1 | 582 | 32.4 | 23.8 | 670 | 693 | 0.24 |
| T227 | S20 | FH1 | 566 | 25.6 | 21.3 | 634 | 656 | — |
| T228 | S20 | F1 | 594 | 35.0 | 25.6 | 690 | 716 | — |
| T229 | S20 | F4 | 593 | 33.8 | 24.5 | 686 | 710 | — |
| T230 | S21 | EH1 | 555 | 26.0 | 22.6 | 623 | 646 | — |
| T231 | S21 | E1 | 588 | 33.2 | 26.1 | 679 | 705 | — |

TABLE 54-continued

| Test No. | Alloy No. | Step No. | Tensile Strength (N/mm$^2$) | Elon-gation (%) | Impact Value (J/cm$^2$) | Strength Balance Index f8 | Strength Balance Index f9 | 150° C. Creep Strain (%) |
|---|---|---|---|---|---|---|---|---|
| T232 | S22 | EH1 | 534 | 27.8 | 25.7 | 604 | 629 | — |
| T233 | S22 | E1 | 560 | 41.4 | 39.2 | 666 | 705 | — |
| T234 | S22 | F1 | 562 | 40.2 | 38.7 | 665 | 704 | — |
| T235 | S23 | F1 | 573 | 37.0 | 29.1 | 671 | 700 | — |
| T236 | S24 | E1 | 594 | 32.0 | 23.5 | 682 | 706 | — |
| T240 | S30 | EH1 | 552 | 28.8 | 25.3 | 626 | 652 | — |
| T241 | S30 | E1 | 579 | 38.2 | 33.3 | 681 | 714 | — |
| T242 | S31 | FH1 | 566 | 28.0 | 26.7 | 640 | 667 | — |
| T243 | S31 | F1 | 586 | 33.4 | 27.2 | 677 | 704 | — |
| T244 | S32 | EH1 | 541 | 26.8 | 24.4 | 609 | 634 | — |
| T245 | S32 | E1 | 570 | 38.4 | 36.5 | 671 | 707 | — |

TABLE 55

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T501 | S101 | EH1 | 20.7 | 5.6 | 0 | 0 | 94.4 | 100 | 5.6 | 34.9 | 110 | 0 | X | 0.11 | 0.12 |
| T502 | S101 | E1 | 23.6 | 1.4 | 0 | 0 | 98.6 | 100 | 1.4 | 30.7 | 50 | 0 | X | 0.19 | 0.12 |
| T503 | S101 | FH1 | 21.0 | 5.2 | 0 | 0 | 94.8 | 100 | 5.2 | 34.7 | 94 | 0 | X | 0.12 | 0.12 |
| T504 | S101 | F1 | 23.8 | 1.0 | 0 | 0 | 99.0 | 100 | 1.0 | 29.8 | 44 | 0 | X | 0.19 | 0.12 |
| T505 | S102 | FH1 | 23.3 | 6.4 | 0 | 0 | 93.6 | 100 | 6.4 | 38.5 | 130 | 0 | X | 0.16 | 0.11 |
| T506 | S102 | F1 | 29.0 | 1.3 | 0 | 0 | 98.7 | 100 | 1.3 | 35.8 | 40 | 0 | Δ | 0.29 | 0.12 |
| T507 | S103 | F1 | 3.0 | 13.2 | 1.5 | 0 | 85.3 | 98.5 | 13.2 | 24.8 | 150 | 0 | X | 0.15 | 0.10 |
| T508 | S104 | EH1 | 0 | 25.8 | 6.5 | 0 | 67.7 | 93.5 | 25.8 | 30.5 | 150 | 0 | X | 0.04 | 0.13 |
| T509 | S104 | E1 | 10.6 | 14.5 | 1.0 | 0 | 84.5 | 99.0 | 14.5 | 33.4 | 150 | 0 | X | 0.06 | 0.14 |
| T510 | S105 | E1 | 69.8 | 0 | 0 | 0.5 | 99.5 | 100 | 0.5 | 70.1 | 0 | 0 | ○ | 0.18 | 0.13 |
| T511 | S106 | FH1 | 33.4 | 5.5 | 0 | 0 | 94.5 | 100 | 5.5 | 47.5 | 120 | 0 | X | 0.18 | 0.08 |
| T512 | S106 | F1 | 41.1 | 0.8 | 0 | 0 | 99.2 | 100 | 0.8 | 46.5 | 38 | 0 | ○ | 0.30 | 0.08 |
| T513 | S107 | EH1 | 26.4 | 2.6 | 0 | 0 | 97.4 | 100 | 2.6 | 36.1 | 108 | 0 | X | 0.13 | 0.13 |
| T514 | S107 | E1 | 28.7 | 0.1 | 0 | 0 | 99.9 | 100 | 0.1 | 30.6 | 32 | 0 | X | 0.18 | 0.13 |
| T515 | S108 | EH1 | 39.0 | 1.3 | 0 | 0 | 98.7 | 100 | 1.3 | 45.8 | 68 | 0 | X | 0.15 | 0.04 |
| T516 | S108 | E1 | 44.8 | 0 | 0 | 0 | 100 | 100 | 0 | 44.8 | 0 | 0 | ○ | 0.18 | 0.04 |
| T517 | S109 | F1 | 57.0 | 0 | 0 | 0 | 100 | 100 | 0 | 57.0 | 0 | 0 | ○ | 0.13 | 0.17 |

TABLE 56

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T501 | S101 | EH1 | 117 | ○ | X | ○ | 124 | 92 | Δ |
| T502 | S101 | E1 | 130 | ○ | ○ | — | 86 | 58 | ○ |
| T503 | S101 | FH1 | 117 | ○ | X | — | 118 | 94 | — |
| T504 | S101 | F1 | 132 | Δ | ○ | — | 76 | 52 | — |
| T505 | S102 | FH1 | 114 | ○ | — | — | 130 | 100 | Δ |
| T506 | S102 | F1 | 122 | ○ | Δ | — | 80 | 52 | ○ |
| T507 | S103 | F1 | 124 | Δ | X | Δ | 160 | 110 | X |
| T508 | S104 | EH1 | 121 | Δ | X | Δ | 180 | 136 | — |
| T509 | S104 | E1 | 113 | ○ | X | — | 162 | 130 | X |
| T510 | S105 | E1 | 134 | Δ | X | — | 44 | 34 | — |
| T511 | S106 | FH1 | 112 | ○ | — | ○ | 116 | 72 | — |
| T512 | S106 | F1 | 119 | ○ | — | — | 74 | 48 | ○ |
| T513 | S107 | EH1 | 125 | ○ | X | ▲ | 140 | 102 | — |
| T514 | S107 | E1 | 135 | X | ○ | — | 52 | 40 | — |
| T515 | S108 | EH1 | 122 | ○ | — | ○ | 96 | 72 | ○ |
| T516 | S108 | E1 | 128 | ○ | ○ | — | 78 | 56 | — |
| T517 | S109 | F1 | 120 | ○ | Δ | ○ | 60 | 34 | — |

TABLE 57

| Test No. | Alloy No. | Step No. | Tensile Strength ($N/mm^2$) | Elon-gation (%) | Impact Value ($J/cm^2$) | Strength Balance Index f8 | Strength Balance Index f9 | 150° C. Creep Strain (%) |
|---|---|---|---|---|---|---|---|---|
| T501 | S101 | EH1 | 505 | 28.4 | 26.8 | 572 | 598 | 0.87 |
| T502 | S101 | E1 | 524 | 40.6 | 37.4 | 621 | 658 | 0.41 |
| T503 | S101 | FH1 | 507 | 29.6 | 28.1 | 578 | 606 | — |
| T504 | S101 | F1 | 529 | 40.8 | 38.0 | 627 | 665 | — |
| T505 | S102 | FH1 | 527 | 26.8 | 21.1 | 594 | 615 | 1.02 |
| T506 | S102 | F1 | 541 | 37.4 | 34.1 | 634 | 668 | 0.41 |
| T507 | S103 | F1 | 453 | 9.6 | 7.6 | 474 | 482 | 3.00 |
| T508 | S104 | EH1 | — | — | — | — | — | — |
| T509 | S104 | E1 | 551 | 6.8 | 4.4 | 570 | 574 | 2.20 |
| T510 | S105 | E1 | 611 | 15.8 | 13.2 | 657 | 671 | — |
| T511 | S106 | FH1 | 543 | 25.6 | 22.5 | 609 | 631 | — |
| T512 | S106 | F1 | 570 | 32.8 | 27.7 | 657 | 685 | 0.38 |
| T513 | S107 | EH1 | 523 | 31.2 | 32.3 | 599 | 631 | 0.45 |
| T514 | S107 | E1 | 539 | 45.8 | 51.0 | 651 | 702 | — |
| T515 | S108 | EH1 | 571 | 30.0 | 23.9 | 651 | 675 | 0.36 |
| T516 | S108 | E1 | 584 | 32.4 | 27.6 | 672 | 700 | 0.17 |
| T517 | S109 | F1 | 602 | 18.8 | 14.3 | 656 | 670 | — |

TABLE 58

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T518 | S110 | EH1 | 28.0 | 1.9 | 0 | 0 | 98.1 | 100 | 1.9 | 36.3 | 66 | 0 | X | 0.12 | 0.10 |
| T519 | S110 | E1 | 31.4 | 0.1 | 0 | 0 | 99.9 | 100 | 0.1 | 33.3 | 28 | 0 | Δ | 0.14 | 0.10 |
| T520 | S111 | E1 | 50.9 | 0.2 | 0 | 0 | 99.8 | 100 | 0.2 | 53.6 | 34 | 0 | ○ | 0.26 | 0.24 |
| T521 | S112 | E1 | 34.7 | 1.5 | 0 | 0 | 98.5 | 100 | 1.5 | 42.0 | 58 | 0 | ○ | 0.38 | 0.17 |
| T522 | S113 | E1 | 35.9 | 0.1 | 0 | 0 | 99.9 | 100 | 0.1 | 37.8 | 28 | 0 | Δ | 0.19 | 0.10 |
| T523 | S114 | E1 | 64.7 | 0 | 0 | 0 | 100 | 100 | 0 | 65.3 | 0 | 0 | ○ | 0.13 | 0.13 |
| T524 | S115 | EH1 | 28.3 | 0.9 | 0 | 0 | 99.1 | 100 | 0.9 | 34.0 | 68 | 0 | X | 0.05 | 0.03 |
| T525 | S115 | E1 | 30.2 | 0.1 | 0 | 0 | 99.9 | 100 | 0.1 | 32.1 | 12 | 0 | X | 0.05 | 0.03 |
| T526 | S116 | E1 | 67.2 | 0 | 0 | 0.2 | 99.8 | 100 | 0.2 | 67.9 | 0 | 0 | ○ | 0.25 | 0.13 |
| T527 | S117 | E1 | 41.9 | 0.1 | 0 | 0 | 99.9 | 100 | 0.1 | 43.8 | 32 | 0 | ○ | 0.22 | 0.12 |
| T528 | S118 | EH1 | 28.0 | 16.7 | 2.5 | 0 | 80.8 | 97.5 | 16.7 | 52.5 | 150 | 0 | X | 0.06 | 0.12 |
| T529 | S118 | E1 | 42.5 | 4.8 | 0.3 | 0 | 94.9 | 99.7 | 4.8 | 55.6 | 130 | 0 | ○ | 0.11 | 0.13 |
| T530 | S119 | EH1 | 24.9 | 3.2 | 0 | 0 | 96.8 | 100 | 3.2 | 35.6 | 64 | 0 | X | 0.13 | 0.12 |
| T531 | S119 | E1 | 29.0 | 0.5 | 0 | 0 | 99.5 | 100 | 0.5 | 33.2 | 36 | 0 | Δ | 0.16 | 0.12 |
| T532 | S120 | EH1 | 23.8 | 3.1 | 0 | 0 | 96.9 | 100 | 3.1 | 34.4 | 60 | 0 | X | 0.08 | 0.10 |
| T533 | S120 | E1 | 26.7 | 0.4 | 0 | 0 | 99.6 | 100 | 0.4 | 30.5 | 32 | 0 | X | 0.10 | 0.10 |
| T534 | S121 | E1 | 34.1 | 0.4 | 0 | 0 | 99.6 | 100 | 0.4 | 37.9 | 26 | 0 | ○ | 0.19 | 0.13 |

TABLE 59

| Test No. | Alloy No. | Step No. | Cutting Resistance (N) | Chip Shape | Bending Workability | Hot Workability | Corrosion Test 1 (μm) | Corrosion Test 2 (μm) | Corrosion Test 3 (ISO 6509) |
|---|---|---|---|---|---|---|---|---|---|
| T518 | S110 | EH1 | 127 | Δ | Δ | — | 90 | 60 | — |
| T519 | S110 | E1 | 134 | Δ | — | — | 58 | 36 | — |
| T520 | S111 | E1 | 120 | ○ | X | — | 40 | 38 | — |
| T521 | S112 | E1 | 116 | ○ | — | — | 94 | 60 | — |
| T522 | S113 | E1 | 126 | ○ | — | ○ | 62 | 36 | ○ |
| T523 | S114 | E1 | 129 | Δ | Δ | ▲ | 46 | 36 | — |
| T524 | S115 | EH1 | 129 | ○ | ○ | ○ | 96 | 72 | — |
| T525 | S115 | E1 | 133 | Δ | ○ | — | 82 | 64 | Δ |
| T526 | S116 | E1 | 131 | Δ | X | ▲ | 34 | 38 | — |
| T527 | S117 | E1 | 130 | Δ | ○ | ▲ | 52 | 40 | — |
| T528 | S118 | EH1 | 121 | ○ | X | Δ | 160 | 124 | X |
| T529 | S118 | E1 | 112 | ○ | X | — | 134 | 100 | — |
| T530 | S119 | EH1 | 128 | ○ | — | — | 110 | 82 | — |
| T531 | S119 | E1 | 132 | Δ | — | — | 76 | 54 | — |
| T532 | S120 | EH1 | 129 | ○ | X | — | 122 | 80 | ○ |
| T533 | S120 | E1 | 136 | X | Δ | — | 84 | 56 | ○ |
| T534 | S121 | E1 | 118 | ○ | Δ | — | — | — | — |

TABLE 60

| Test No. | Alloy No. | Step No. | Tensile Strength (N/mm$^2$) | Elon-gation (%) | Impact Value (J/cm$^2$) | Strength Balance Index f8 | Strength Balance Index f9 | 150° C. Creep Strain (%) |
|---|---|---|---|---|---|---|---|---|
| T518 | S110 | EH1 | 529 | 34.2 | 36.8 | 613 | 650 | — |
| T519 | S110 | E1 | 545 | 45.2 | 50.8 | 657 | 708 | — |
| T520 | S111 | E1 | 581 | 23.4 | 15.7 | 645 | 661 | 0.35 |
| T521 | S112 | E1 | 554 | 33.6 | 26.7 | 641 | 667 | 0.46 |
| T522 | S113 | E1 | 569 | 35.6 | 23.6 | 663 | 686 | — |
| T523 | S114 | E1 | 609 | 17.2 | 13.6 | 659 | 673 | — |
| T524 | S115 | EH1 | 531 | 33.4 | 35.2 | 613 | 648 | 0.24 |
| T525 | S115 | E1 | 550 | 42.0 | 48.4 | 655 | 703 | — |
| T526 | S116 | E1 | 613 | 15.0 | 12.9 | 657 | 670 | — |
| T527 | S117 | E1 | 567 | 34.2 | 31.8 | 657 | 689 | — |
| T528 | S118 | EH1 | — | — | — | — | — | — |
| T529 | S118 | E1 | 540 | 7.8 | 6.4 | 561 | 568 | 1.20 |
| T530 | S119 | EH1 | 520 | 29.0 | 22.7 | 590 | 613 | 0.60 |
| T531 | S119 | E1 | 542 | 38.2 | 31.2 | 637 | 668 | 0.22 |
| T532 | S120 | EH1 | 515 | 29.6 | 25.5 | 586 | 612 | — |
| T533 | S120 | E1 | 536 | 40.0 | 35.1 | 635 | 670 | — |
| T534 | S121 | E1 | 551 | 37.0 | 29.8 | 645 | 675 | 0.26 |

TABLE 61

| | | | Wear Resistance | |
|---|---|---|---|---|
| Test No. | Alloy No. | Step No. | Amsler Abrasion Test | Ball-On-Disk Abrasion Test |
| T201 | S11 | EH1 | ○ | ○ |
| T202 | S11 | E1 | ◎ | ○ |
| T206 | S11 | PH1 | ○ | ○ |
| T207 | S11 | P1 | ◎ | ◎ |
| T212 | S13 | FH1 | ○ | ○ |
| T213 | S13 | F1 | ◎ | ○ |
| T216 | S14 | EH1 | ○ | ○ |
| T217 | S14 | E1 | ○ | ◎ |
| T221 | S17 | EH1 | Δ | ○ |
| T222 | S17 | E1 | ◎ | ○ |
| T223 | S18 | EH1 | Δ | Δ |
| T224 | S18 | E1 | ○ | ○ |
| T227 | S20 | FH1 | ○ | ○ |
| T230 | S21 | EH1 | ○ | ○ |
| T231 | S21 | E1 | ◎ | ◎ |
| T236 | S24 | E1 | ◎ | ◎ |
| T509 | S104 | E1 | Δ | Δ |
| T510 | S105 | E1 | ◎ | Δ |
| T514 | S107 | E1 | ○ | Δ |
| T519 | S110 | E1 | ○ | Δ |
| T523 | S114 | E1 | ◎ | Δ |
| T527 | S117 | E1 | Δ | ○ |
| T529 | S118 | E1 | Δ | Δ |
| T531 | S119 | E1 | Δ | Δ |

The above-described experiment results are summarized as follows.

1) It was able to be verified that, by satisfying the composition according to the embodiment, the composition relational expressions f1, f2, and f7, the requirements of the metallographic structure, and the metallographic structure relational expressions f3, f4, f5, and f6, excellent machinability can be obtained with addition of a small amount of Pb, and a hot extruded material, a hot forged material, or a hot rolled material having excellent hot workability and excellent corrosion resistance in a harsh environment and having high strength and excellent ductility, impact resistance, bending workability, wear resistance, and high temperature properties can be obtained (for example, Alloy Nos. S01, S02, and S13 and Step Nos. A1, C1, D1, E1, F1, F4, and R1).

2) It was able to be verified that addition of Sb and As improves corrosion resistance under harsher conditions (Alloy Nos. S30 to S32).

3) It was able to be verified that the cutting resistance further lowers by containing Bi (Alloy No. S32).

4) It was able to be verified that corrosion resistance, machinability, and strength are improved when 0.11 mass % or higher of Sn and 0.07 mass % or higher of P are contained in κ phase (for example, Alloy Nos. S01, S02, and S13).

5) It was able to be verified that, due to the presence of elongated acicular κ phase, that is, κ1 phase in α phase, strength increases, the balance between strength and ductility which is represented by f8 and the balance between strength, ductility, and impact resistance which is represented by f9 increase, excellent machinability is maintained, and corrosion resistance, wear resistance, and high temperature properties improve (for example, Alloy Nos. S01, S02, and S03).

6) When the Cu content was low, the amount of γ phase increased, and machinability was excellent. However, corrosion resistance, ductility, impact resistance, bending workability, and high temperature properties deteriorated. Conversely, when the Cu content was high, machinability deteriorated. In addition, ductility, impact resistance, and bending workability also deteriorated (Alloy Nos. 5103, S104, and S116).

7) When the Sn content was higher than 0.28 mass %, the area ratio of γ phase was higher than 1.0%. Therefore, machinability was excellent, but corrosion resistance, ductility, impact resistance, bending workability and high temperature properties deteriorated (Alloy No. S112). On the other hand, when the Sn content was lower than 0.10 mass %, the dezincification corrosion depth in a harsh environment was large (Alloy No. S115). When the Sn content was 0.12 mass % or higher, the properties were further improved (Alloy Nos. S01 to S114).

8) When the P content was high, impact resistance, ductility, and bending workability deteriorated. In addition, cutting resistance was slightly high. On the other hand, when the P content was low, the dezincification corrosion depth in a harsh environment was large (Alloy Nos. 5108, 5111, and S115).

9) It was able to be verified that, even if inevitable impurities are contained to the extent contained in alloys manufactured in the actual production, there is not much influence on the properties (Alloy Nos. S01, S02, and S03). With respect to alloys containing inevitable impurities in the amount close to the boundary value of the alloys according to the embodiments, it is presumed that, when Fe is contained in the amount exceeding the preferable range of the inevitable impurities, an intermetallic compound of Fe and Si or an intermetallic compound of Fe and P is formed. As a result, the effective range of concentration of Si and P decreased, corrosion resistance slightly deteriorated, tensile strength slightly decreased, and machinability slightly deteriorated due to the formation of the intermetallic compound (Alloy Nos. 5113, 5119, and S120).

10) When the Pb content was low, machinability deteriorated. When the Pb content was high, high temperature properties, tensile strength, elongation, impact resistance, and bending workability slightly deteriorated (Alloy Nos. S110 and S121).

11) When the value of the composition relational expression f1 was low, even if the contents of Cu, Si, Sn, and P were in the composition ranges, the dezincification corrosion depth in a harsh environment was large (Alloy No. S102).

When the value of the composition relational expression f1 was low, the amount of γ phase increased, and machinability was excellent. However, corrosion resistance, ductility, impact resistance, and high temperature properties deteriorated. When the value of the composition relational expression f1 was high, the amount of κ phase increased, μ phase occasionally appeared, and machinability, hot workability, ductility, and impact resistance deteriorated (Alloy Nos. S104, S112, S114, and S116).

12) When the value of the composition relational expression f2 was low, β sometimes appeared depending on the composition, and machinability was excellent. However, hot workability, corrosion resistance, ductility, impact resistance, and high temperature properties deteriorated. When the value of the composition relational expression f2 was high, hot workability deteriorated. In addition, even if a predetermined amount of Si was contained, the amount of κ1 phase was sometimes small, or not present. Therefore, tensile strength was low, and machinability deteriorated. When the value of f2 was high, coarse α phase appeared. Therefore, it is presumed that machinability, tensile strength, and hot workability deteriorated (Alloy Nos. 5104, S118, and S107).

13) When the proportion of γ phase in the metallographic structure was higher than 1.0%, or when the length of the long side of γ phase was longer than 40 μm, machinability was excellent, but strength was low and corrosion resistance, ductility, impact resistance, and high temperature properties deteriorated. In particular, when the proportion of γ phase was high, the selective corrosion of γ phase in the dezincification corrosion test in a harsh environment occurred (Alloy Nos. 5101 and S102). When the proportion of γ phase was 0.5% or lower and the length of the long side of γ phase was 30 μm or less, corrosion resistance, impact resistance, and normal-temperature and high-temperature strength were excellent (Alloy Nos. S01 and S11).

When the area ratio of μ phase was higher than 2%, or when the length of the long side of μ phase was longer than 25 μm, corrosion resistance, ductility, impact resistance, and high temperature properties deteriorated. In the dezincification corrosion test in a harsh environment, grain boundary corrosion or selective corrosion of μ phase occurred (Alloy No. S01 and Step Nos. AH4, BH3, and DH2). When the proportion of μ phase was 1% or lower and the length of the long side of μ phase was 15 μm or less, corrosion resistance, ductility, impact resistance, and normal temperature and high temperature properties were excellent (Alloy Nos. S01 and S11).

When the area ratio of κ phase was higher than 67%, machinability, ductility, bending workability, and impact resistance deteriorated. On the other hand, when the area ratio of κ phase was lower than 28%, machinability deteriorated. When the area ratio of κ phase exceeded about 50%, machinability started to deteriorate (Alloy Nos. 5116 and S101).

14) When the value of the metallographic structure relational expression $f5=(\gamma)+(\mu)$ exceeded 2.0%, or when the value of $f3=(\alpha)+(\kappa)$ was lower than 97.4%, corrosion resistance, ductility, impact resistance, bending workability, and normal temperature and high temperature properties deteriorated. When the metallographic structure relational expression f5 was 1.2% or lower, corrosion resistance, ductility, impact resistance, and normal temperature and high temperature properties were improved (Alloy No. S01 and Step Nos. AH2, FH1, A1, and F1).

When the value of the metallographic structure relational expression $f6=(\kappa)+6\times(\gamma)^{1/2}+0.5\times(\mu)$ was higher than 70 or was lower than 30, machinability was poor (Alloy Nos. 5101 and S105). When the value of f6 was 30 to 58, machinability was further improved (Alloy Nos. S01 and S11). In an alloy having the same composition but was manufactured through a different process, a large amount of γ phase was present, and the value of f6 was high. However, if κ1 phase was not present or the amount of κ1 phase was small, the cutting resistance was substantially the same (Alloy No. S01 and Step Nos. A1, AH5 to AH7, and AH9 to AH11).

When the area ratio of γ phase exceeded 1.0%, cutting resistance was low and chip shape was largely excellent irrespective of the value of the metallographic structure relational expression f6 (for example, Alloy Nos. 5106 and S118).

15) When the amount of Sn in κ phase was lower than 0.11 mass %, the dezincification corrosion depth in a harsh environment was large, and the corrosion of κ phase occurred.

In addition, cutting resistance was slightly high, and chip partibility deteriorated (Alloy Nos. S115 and S120). When the amount of Sn in κ phase was higher than 0.14 mass %, corrosion resistance and machinability were excellent (Alloy Nos. S20 and S21).

16) When the amount of P in κ phase was lower than 0.07 mass %, the dezincification corrosion depth in a harsh environment was large, and the corrosion of κ phase occurred (Alloy Nos. 5108 and S115).

17) When the area ratio of γ phase was 1.0% or lower, the Sn concentration and the P concentration in κ phase were higher than the amount of Sn and the amount of P in the alloy. Conversely, when the area ratio of γ phase was high, the Sn concentration in κ phase was lower than the amount of Sn in the alloy. In particular, when the area ratio of γ phase was about 10%, the Sn concentration in κ phase was about half of the amount of Sn in the alloy (Alloy Nos. S02, S14, 5104, and S118). In addition, for example, in Alloy No. S13 and Step Nos. FH1 and F1, when the area ratio of γ phase decreased from 3.1% to 0.1%, the Sn concentration in α phase increased from 0.12 mass % to 0.15 mass % by 0.03 mass %, and the Sn concentration in κ phase increased from 0.15 mass % to 0.21 mass % by 0.06 mass %. This way, an increase in the Sn concentration in κ phase was more than an increase in the Sn concentration in α phase. Due to a decrease in the amount of γ phase, an increase in the amount of Sn distributed in κ phase, and the presence of a large amount of acicular κ phase in α phase, the cutting resistance increased by 5 N, but excellent machinability was maintained, the dezincification corrosion depth decreased to about ¼ due to the strengthening of corrosion resistance in κ phase, the impact value increased about 1.4 times, the high temperature creep decreased to ⅓, the tensile strength was improved by about 30 N/mm$^2$, and the strength balance indices f8 and f9 increased by 70 and 80, respectively.

18) When all the requirements regarding composition and metallographic structure were satisfied, the tensile strength was 540 N/mm$^2$ or higher, and the creep strain after holding the material at 150° C. for 100 hours in a state where a load corresponding to 0.2% proof stress at room temperature was applied was 0.3% or lower (for example, Alloy No. S03).

Regarding a relation between the tensile strength and the hardness, in the alloys prepared in Step No. F1 using Alloy Nos. S01, S02, S03, S22, and 5101, the values of tensile strength were 574 N/mm$^2$, 602 N/mm$^2$, 586 N/mm$^2$, 562 N/mm$^2$, and 523 N/mm$^2$, respectively, whereas the values of hardness HRB were 77, 84, 80, 74, and 66, respectively.

19) As long as the requirements of the composition and the requirements of the metallographic structure were satisfied, the Charpy impact test value when a U-notched specimen was used was 12 J/cm$^2$ or higher. In the hot extruded material or the forged material on which cold working was not performed, the Charpy impact test value when a U-notched specimen was used was 14 J/cm$^2$ or higher. The value of f8 exceeded 660, and the value of f9 exceeded 685 (Alloy Nos. S01, s02, and S03).

When the amount of Si was about 3.05% or higher, acicular κ1 phase started to be clearly present in α phase, and when the amount of Si was about 3.12%, the amount of κ1 phase significantly increased. The relational expression f2 affected the amount of κ1 phase (for example, Alloy Nos. S22, S12, S107, and S115).

When the amount of κ1 phase increased, even if the amount of γ phase was 1.0% or lower and the Pb content was lower than 0.020, excellent machinability was secured, and tensile strength, high temperature properties, and wear resistance were excellent. It is also presumed that an increase in the amount of κ1 phase leads to strengthening of α phase and improvement of chip partibility (for example, Alloy Nos. S02, S03, S11, and S16).

In the test method according to ISO 6509, an alloy including about 1% or higher of β phase, an alloy including about 5% or higher of γ phase, or an alloy not including P or including 0.02% of P were evaluated as fail (evaluation: Δ, X). However, an alloy including 3% to 5% of γ phase and an alloy including about 3% of μ phase were evaluated as pass (evaluation: ○). This shows that the corrosion environment adopted in the embodiment simulated a harsh environment (Alloy Nos. 5103, 5104, and S120).

The wear resistance of an alloy including a large amount of κ1 phase, Sn, and about 0.1% to about 0.7% of γ phase was excellent irrespective of whether or not the alloy was lubricated (for example Alloy Nos. S14 and S18).

20) In the evaluation of the materials prepared using the mass-production facility and the materials prepared in the laboratory, substantially the same results were obtained (Alloy Nos. S01 and S02 and Step Nos. C1, E1, and F1).

21) Regarding Manufacturing Conditions:

When the hot extruded material, the extruded and drawn material, the hot forged product, or the hot rolled material was held in a temperature range of 525° C. to 575° C. for 20 minutes or longer, was held in a temperature range of 505° C. or higher and lower than 525° C. for 100 minutes or longer, or was cooled in a temperature range of 525° C. to 575° C. at a cooling rate of 2.5° C./min or lower and subsequently was cooled in a temperature range from 460° C. to 400° C. at a cooling rate of 2.5° C./min or higher in the continuous furnace, a material was obtained in which κ1 phase was present, the amount of γ phase significantly decreased, μ phase was scarcely present, and corrosion resistance, ductility, high temperature properties, impact resistance, cold workability, and mechanical strength were excellent.

When the heat treatment temperature was low in the step of performing the heat treatment on the hot worked material or the cold worked material, a decrease in the amount of γ phase was small, and corrosion resistance, impact resistance, ductility, cold workability, high temperature properties, strength-ductility-impact balance were poor. When the heat treatment temperature was high, crystal grains of α phase were coarsened, the amount of κ1 phase was small, and a decrease in the amount of γ phase was small. Therefore, corrosion resistance and impact resistance were poor, machinability was also poor, and tensile strength was also low (Alloy Nos. S01, S02, and S03 and Step Nos. A1, AH5, and AH6). In addition, when the heat treatment temperature was 505° C. to 525° C., if the holding time was short, a decrease in the amount of γ phase was small (Step Nos. A5, AH9, D4, DH6, and PH3).

When the cooling rate in a temperature range from 460° C. to 400° C. in the process of cooling after the heat treatment was low, μ phase was present, corrosion resistance, ductility, impact resistance, and high temperature properties were poor, and also, tensile strength was low (Step Nos. A1 to A4, AH8, DH2, and DH3).

Regarding heat treatment method, by increasing the temperature to a temperature between 525° C. and 620° C. once and lowering the cooling rate in a temperature range from 575° C. to 525° C. in the process of cooling, excellent corrosion resistance, impact resistance, and high temperature properties were obtained. It was able to be verified that the properties were improved even when continuous heat treatment method was used. The amount of γ phase and the amount of κ1 phase were affected by the cooling rate (Step Nos. A7 to A9, D5, and D7)

By controlling the cooling rate in a temperature range from 575° C. to 525° C. to be 1.6° C./min in the process of cooling after hot forging or hot extrusion, a forged product in which the proportion of γ phase after hot forging was low was obtained (Step No. D6).

Even when the casting was used as a material for hot forging, excellent properties were obtained like in the case an extruded material was used. When an appropriate heat treatment was performed on the casting, corrosion resistance was excellent (Alloy Nos. S01, S02, and S03 and Step Nos. F4, F5, and P1 to P3).

Due to the appropriate heat treatment and the appropriate cooling conditions after hot forging, the amount of Sn and the amount of P in κ phase increased (Alloy Nos. S01, S02, and S03 and Step Nos. A1, AH1, C0, C1, and D6).

It was verified that, when the amount of Sn in κ phase increased, the amount of γ phase significantly decreased, but excellent machinability was able to be secured (Alloy Nos. S01 and S02 and Step Nos. AH1, A1, D7, C0, C1, EH1, E1, FH1, and F1).

It is presumed that, when acicular κ phase was present in α phase, tensile strength and wear resistance were improved, machinability was also excellent, which supplemented the significant decrease in the amount of γ phase (Alloy Nos. S01, S02, and S03 and Step Nos. AH1, A1, D7, C0, C1, EH1, E1, FH1, and F1).

When cold working was performed on the extruded material at a working ratio of about 5% or about 8% and then a predetermined heat treatment was performed, as compared to the simply hot extruded material, corrosion resistance, impact resistance, cold workability, high temperature properties, and tensile strength were improved, in particular, the tensile strength was improved by about 60 N/mm$^2$ or about 80 N/mm$^2$. The strength-ductility-impact balance index was also improved by about 70 to about 100 (Alloy Nos. S01 and S03 and Step Nos. AH1, A1, and A12).

When cold working was performed on the heat treated material at a cold working ratio of 5%, as compared to the extruded material, the tensile strength was improved by about 90 N/mm$^2$, the strength-ductility balance index was also improved by about 100, and corrosion resistance and high temperature properties were improved. When the cold working ratio was about 8%, the tensile strength was improved by about 120 N/mm$^2$, and the strength-ductility-impact balance index was also improved by about 120 (Alloy Nos. S01 and S03 and Step Nos. AH1, A10, and A11).

It was able to be verified that, when low-temperature annealing is performed after cold working or hot working, if a heat treatment is performed by heating the material to 240° C. to 350° C. for 10 minutes to 300 minutes in a manner that satisfies $150 \leq (T-220) \times (t)^{1/2} \leq 1200$ wherein the heating temperature is represented by T° C. and the heating time is represented by t min, a cold worked material or a hot worked material having excellent corrosion resistance in a harsh environment and having excellent impact resistance and high temperature properties can be obtained (Alloy No. S01 and Step Nos. B1 to B3).

Regarding the samples obtained by performing Step No. AH12 on Alloy Nos. S01 to S03, extrusion was not able to be finished due to their high deformation resistance. Therefore, the subsequent evaluation was discontinued.

In Step No. BH1, straightness was not corrected sufficiently, and low-temperature annealing was not performed appropriately. As a result, a problem in quality occurred.

As described above, in the alloy according to the embodiment in which the contents of the respective additive elements, the respective composition relational expressions, the metallographic structure, and the respective metallographic structure relational expressions are in the appropriate ranges, hot workability (hot extrusion, hot forging) is excellent, and corrosion resistance and machinability are also excellent. In addition, the alloy according to the embodiment can obtain excellent properties by adjusting the manufacturing conditions in hot extrusion and hot forging and the conditions in the heat treatment so that they fall in the appropriate ranges.

Example 2

Regarding an alloy according to Comparative Example of the embodiment, a Cu—Zn—Si copper alloy casting (Test No. T601/Alloy No. S201) which had been used in a harsh water environment for 8 years was prepared. There was no detailed data on the water quality of the environment where the casting had been used and the like. Using the same method as in Example 1, the composition and the metallographic structure of Test No. T601 were analyzed. In addition, a corroded state of a cross-section was observed using the metallographic microscope. Specifically, the sample was embedded in a phenol resin material such that the exposed surface was maintained to be perpendicular to the longitudinal direction. Next, the sample was cut such that a cross-section of a corroded portion was obtained as the longest cut portion. Next, the sample was polished. The cross-section was observed using the metallographic microscope. In addition, the maximum corrosion depth was measured.

Next, a similar alloy casting was prepared with the same composition and under the same preparation conditions of Test No. T601 (Test No. T602/Alloy No. S202). Regarding the similar alloy casting (Test No. T602), the analysis of the composition and the metallographic structure, the evaluation (measurement) of the mechanical properties and the like, and the dezincification corrosion tests 1 to 3 were performed as described in Example 1. By comparing the corrosion of Test No. T601 which developed in actual water environment and that of Test No. T602 in the accelerated tests of the dezincification corrosion tests 1 to 3 to each other, the appropriateness of the accelerated tests of the dezincification corrosion tests 1 to 3 was verified.

In addition, by comparing the evaluation result (corroded state) of the dezincification corrosion test 1 of the alloy according to the embodiment described in Example 1 (Test No. T10/Alloy No. S01/Step No. A6) and the corroded state of Test No. T601 or the evaluation result (corroded state) of the dezincification corrosion test 1 of Test No. T602 to each other, the corrosion resistance of Test No. T10 was examined.

Test No. T602 was prepared using the following method. Raw materials were dissolved to obtain substantially the same composition as that of Test No. T601 (Alloy No. S201), and the melt was cast into a mold having an inner diameterϕ of 40 mm at a casting temperature of 1000° C. to prepare a casting. Next, the casting was cooled in the temperature range of 575° C. to 525° C. at a cooling rate of about 20° C./min, and subsequently was cooled in the temperature range from 460° C. to 400° C. at an average cooling rate of about 15° C./min. As a result, a sample of Test No. T602 was prepared.

The analysis method of the composition and the metallographic structure, the measurement method of the mechanical properties and the like, and the methods of the dezincification corrosion tests 1 to 3 were as described in Example 1.

Figure 4:
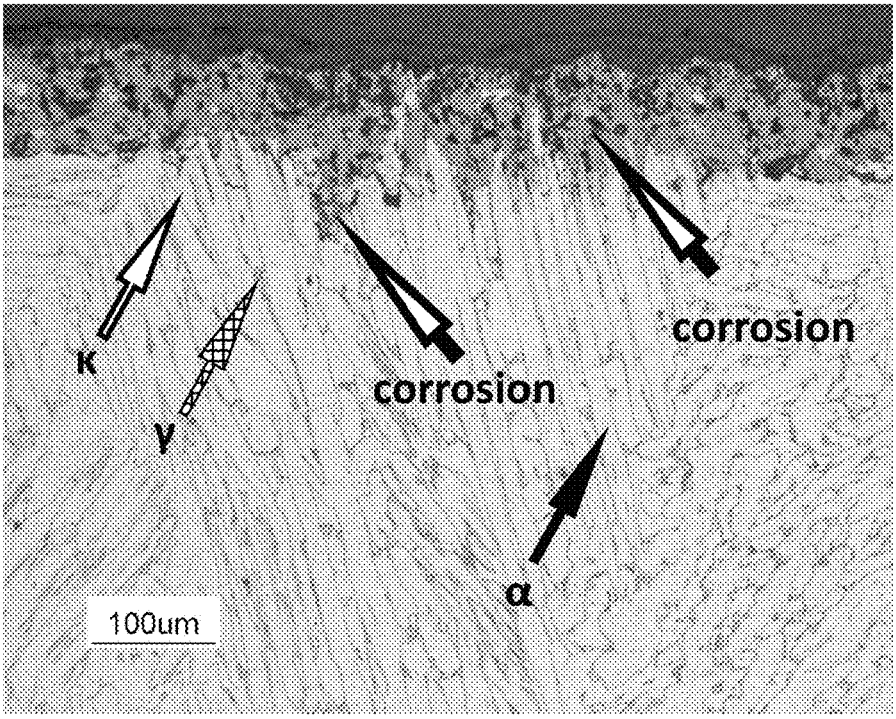
FIG. 4 is a metallographic micrograph of a cross-section of the alloy of Test No. T601 according to Example 2 after use in a harsh water environment for 8 years.
Figure 5:
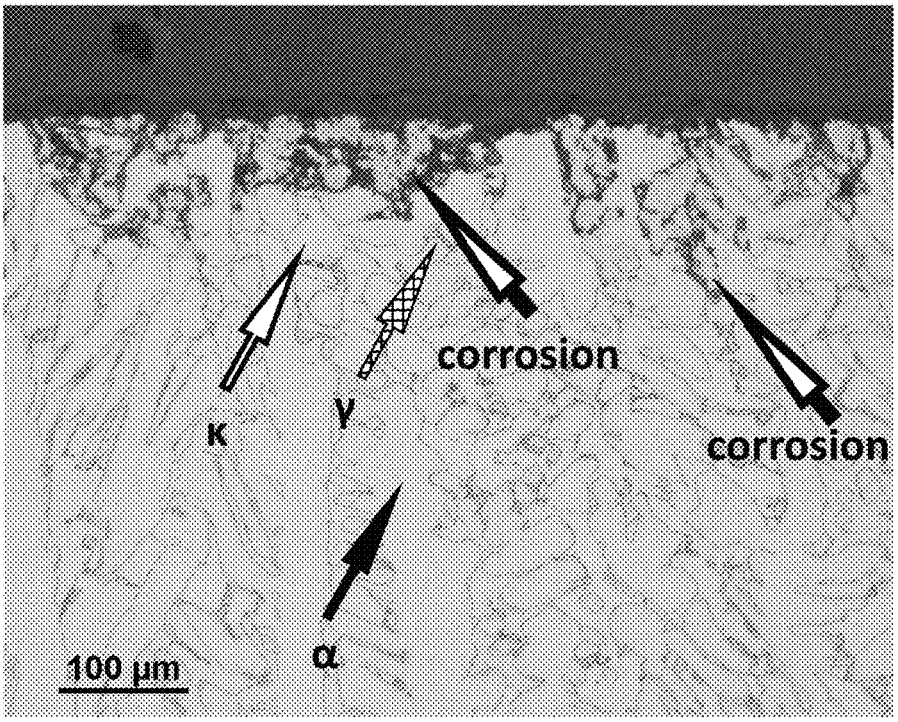
FIG. 5 is a metallographic micrograph of a cross-section of the alloy of Test No. T602 according to Example 2 after dezincification corrosion test 1.
Figure 6:
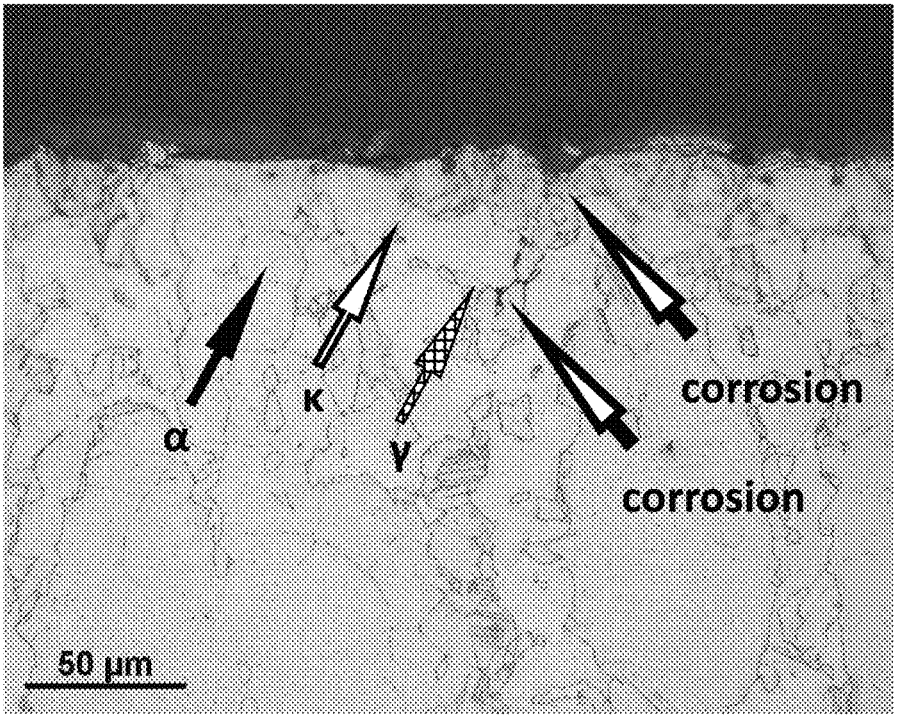
FIG. 6 is a metallographic micrograph of a cross-section of the alloy of Test No. T10 according to Example 2 after dezincification corrosion test 1.

The obtained results are shown in Tables 62 to 64 and FIGS. 4 to 6.

TABLE 62

| Alloy No. | Cu | Si | Pb | Sn | P | Others | Zn | f1 | f2 | f7 |
|---|---|---|---|---|---|---|---|---|---|---|
| S201 | 75.4 | 3.01 | 0.037 | 0.01 | 0.04 | Fe: 0.02, Ni: 0.01, Ag: 0.02 | Balance | 77.8 | 61.5 | 4.00 |
| S202 | 75.4 | 3.01 | 0.033 | 0.01 | 0.04 | Fe: 0.02, Ni: 0.02, Ag: 0.02 | Balance | 77.8 | 61.5 | 4.00 |

TABLE 63

| Test No. | Alloy No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|
| T601 | S201 | 27.4 | 3.9 | 0 | 0 | 96.1 | 100 | 3.9 | 39.2 | 110 | 0 | X | 0.01 | 0.06 |
| T602 | S202 | 28.0 | 3.8 | 0 | 0 | 96.2 | 100 | 3.8 | 39.7 | 120 | 0 | X | 0.01 | 0.06 |

TABLE 64

| Test No. | Alloy No. | Maximum Corrosion Depth (μm) | Corrosion Test 1 (μm) | Corrosion Test 2 (μm) | Corrosion Test 3 (ISO 6509) |
|---|---|---|---|---|---|
| T601 | S201 | 138 | — | — | — |
| T602 | S202 | — | 143 | 102 | ○ |

In the copper alloy casting used in a harsh water environment for 8 years (Test No. T601), at least the contents of Sn and P were out of the ranges of the embodiment.

FIG. 4 shows a metallographic micrograph of the cross-section of Test No. T601.

Test No. T601 was used in a harsh water environment for 8 years, and the maximum corrosion depth of corrosion caused by the use environment was 138 μm.

In a surface of a corroded portion, dezincification corrosion occurred irrespective of whether it was α phase or κ phase (average depth of about 100 μm from the surface).

In the corroded portion where α phase and κ phase were corroded, more solid α phase was present at deeper locations.

The corrosion depth of α phase and κ phase was uneven without being uniform. Roughly, selective corrosion occurred in γ phase from a boundary portion of α phase and κ phase to the inside (a depth of about 40 μm from the corroded boundary between α phase and κ phase towards the inside: local corrosion which occurs to γ phase selectively).

FIG. 5 shows a metallographic micrograph of a cross-section of Test No. T602 after the dezincification corrosion test 1.

The maximum corrosion depth was 143 μm.

In a surface of a corroded portion, dezincification corrosion occurred irrespective of whether it was α phase or κ phase (average depth of about 100 μm from the surface).

In the corroded portion, more solid α phase was present at deeper locations.

The corrosion depth of α phase and κ phase was not uniform, but varied instead. Roughly, corrosion occurred selectively in γ phase from a boundary portion of α phase and κ phase to the inside (the length of the local corrosion that selectively occurred to γ phase from the corroded boundary between α phase and κ phase was about 45 μm).

It was found that the corrosion shown in FIG. 4 occurred in the harsh water environment for 8 years and the corrosion shown in FIG. 5 occurred in the dezincification corrosion test 1 were substantially the same in terms of corrosion form. In addition, because the amount of Sn and the amount of P did not fall within the ranges of the embodiment, both α phase and κ phase were corroded in a portion in contact with water or the test solution, and γ phase was selectively corroded here and there at deepest point of the corroded portion. The Sn concentration and the P concentration in κ phase were low.

The maximum corrosion depth of Test No. T601 was slightly less than the maximum corrosion depth of Test No. T602 in the dezincification corrosion test 1. However, the maximum corrosion depth of Test No. T601 was slightly more than the maximum corrosion depth of Test No. T602 in the dezincification corrosion test 2. Although the degree of corrosion in the actual water environment is affected by the water quality, the results of the dezincification corrosion tests 1 and 2 substantially matched the corrosion result in the actual water environment regarding both corrosion form and corrosion depth. Accordingly, it was found that the conditions of the dezincification corrosion tests 1 and 2 are appropriate and the evaluation results obtained in the dezincification corrosion tests 1 and 2 are substantially the same as the corrosion result in the actual water environment.

In addition, the acceleration rates of the accelerated tests of the dezincification corrosion tests 1 and 2 substantially matched that of the corrosion in the actual harsh water environment. This presumably shows that the dezincification corrosion tests 1 and 2 simulated a harsh environment.

The result of Test No. T602 in the dezincification corrosion test 3 (the dezincification corrosion test according to ISO6509) was "○" (good). Therefore, the result of the dezincification corrosion test 3 did not match the corrosion result in the actual water environment.

The test time of the dezincification corrosion test 1 was 2 months, and the dezincification corrosion test 1 was an about 75 to 100 times accelerated test. The test time of the dezincification corrosion test 2 was 3 months, and the dezincification corrosion test 2 was an about 30 to 50 times accelerated test. On the other hand, the test time of the dezincification corrosion test 3 (dezincification corrosion test according to ISO 6509) was 24 hours, and the dezincification corrosion test 3 was an about 1000 times or more accelerated test.

It is presumed that, by performing the test for a long period of time of 2 or 3 months using the test solution close to the actual water environment as in the dezincification corrosion tests 1 and 2, substantially the same evaluation results as the corrosion result in the actual water environment were obtained.

In particular, in the corrosion result of Test No. T601 in the harsh water environment for 8 years, or in the corrosion results of Test No. T602 in the dezincification corrosion tests 1 and 2, not only α phase and κ phase on the surface but also γ phase were corroded. However, in the corrosion result of the dezincification corrosion test 3 (dezincification corrosion test according to ISO 6509), substantially no γ phase was corroded. Therefore, it is presumed that, in the dezincification corrosion test 3 (dezincification corrosion test according to ISO 6509), the corrosion of α phase and κ phase on the surface and the corrosion of γ phase were not able to be appropriately evaluated, and the evaluation result did not match the corrosion result in the actual water environment.

FIG. 6 shows a metallographic micrograph of a cross-section of Test No. T10 (Alloy No. S01/Step No. A6) after the dezincification corrosion test 1.

In the vicinity of the surface, about 30% of κ phase exposed to the surface was corroded. However, the remaining κ phase and α phase were solid (were not corroded). The maximum corrosion depth was about 25 μm. Further, about 20 μm-deep selective corrosion of γ phase or μ phase occurred toward the inside. It is presumed that the length of the long side of γ phase or μ phase is one of the large factors that determine the corrosion depth.

It can be seen that, in the Test No. T10 of the embodiment shown in FIG. 6, the corrosion of α phase and κ phase in the vicinity of the surface was significantly suppressed as compared to Tests No. T601 and T602 shown in FIGS. 4 and 5. It is presumed that the progress of the corrosion was delayed by the aforementioned suppression. From the observation result of the corrosion form, the main reason why the corrosion of α phase and κ phase in the vicinity of the surface was significantly suppressed is presumed to be improved κ phase' corrosion resistance by Sn that is contained in κ phase.

INDUSTRIAL APPLICABILITY

The free-cutting copper alloy according to the present invention has excellent hot workability (hot extrudability and hot forgeability) and excellent corrosion resistance and machinability. Therefore, the free-cutting copper alloy according to the present invention is suitable for devices used for drinking water consumed by a person or an animal every day such as faucets, valves, or fittings, members for electrical uses, automobiles, machines and industrial plumbing such as valves or fittings, devices and components that come in contact with liquid, and for valves, fittings, devices, or components that come in contact with hydrogen.

Specifically, the free-cutting copper alloy according to the present invention is suitable to be applied as a material that composes faucet fittings, water mixing faucet fittings, drainage fittings, faucet bodies, water heater components, EcoCute components, hose fittings, sprinklers, water meters, water shut-off valves, fire hydrants, hose nipples, water supply and drainage cocks, pumps, headers, pressure reducing valves, valve seats, gate valves, valves, valve stems, unions, flanges, branch faucets, water faucet valves, ball valves, various other valves, and fittings for plumbing, through which drinking water, drained water, or industrial water flows, for example, components called elbows, sockets, bends, connectors, adaptors, tees, or joints.

In addition, the free-cutting copper alloy according to the present invention is suitable for solenoid valves, control valves, various valves, radiator components, oil cooler components, and cylinders used as automobile components, and is suitable for pipe fittings, valves, valve stems, heat exchanger components, water supply and drainage cocks, cylinders, or pumps used as mechanical members, and is suitable for pipe fittings, valves, or valve stems used as industrial plumbing members.

The invention claimed is:

1. A free-cutting copper alloy comprising:

75.4 mass % to 78.7 mass % of Cu;

3.05 mass % to 3.65 mass % of Si;

0.10 mass % to 0.28 mass % of Sn;

0.05 mass % to 0.14 mass % of P;

0.005 mass % or higher and lower than 0.020 mass % of Pb; and a balance including Zn and inevitable impurities, wherein when a Cu content is represented by [Cu] mass %, a Si content is represented by [Si] mass %, a Sn content is represented by [Sn] mass %, and a P content is represented by [P] mass %, the relations of $$76.5 \le f1 = [Cu] + 0.8 \times [Si] - 8.5 \times [Sn] + [P] \le 80.3,$$

$$60.7 \le f2 = [Cu] - 4.6 \times [Si] - 0.7 \times [Sn] - [P] \le 62.1, \text{ and}$$

$$0.25 \le f7 = [P]/[Sn] \le 1.0$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$28 \le (\kappa) \le 67,$$

$$0 \le (\gamma) \le 1.0,$$

$$0 \le (\beta) \le 0.2,$$

$$0 \le (\mu) \le 1.5,$$

$$97.4 \le f3 = (\alpha) + (\kappa),$$

$$99.4 \le f4 = (\alpha) + (\kappa) + (\gamma) + (\mu),$$

$$0 \le f5 = (\gamma) + (\mu) \le 2.0, \text{ and}$$

$$30 \le f6 = (\kappa) + 6 \times (\gamma)^{1/2} + 0.5 \times (\mu) \le 70$$

are satisfied, the length of the long side of γ phase is 40 μm or less, the length of the long side of μ phase is 25 μm or less, and κ phase is present in α phase.

2. The free-cutting copper alloy according to claim 1, further comprising:

one or more element(s) selected from the group consisting of 0.01 mass % to 0.08 mass % of Sb, 0.02 mass % to 0.08 mass % of As, and 0.005 mass % to 0.20 mass % of Bi.

3. A free-cutting copper alloy comprising:

75.6 mass % to 77.9 mass % of Cu;

3.12 mass % to 3.45 mass % of Si;

0.12 mass % to 0.27 mass % of Sn;

0.06 mass % to 0.13 mass % of P;

0.006 mass % to 0.018 mass % of Pb; and a balance including Zn and inevitable impurities, wherein when a Cu content is represented by [Cu] mass %, a Si content is represented by [Si] mass %, a Sn content is represented by [Sn] mass %, and a P content is represented by [P] mass %, the relations of $$76.8 \le f1 = [Cu] + 0.8 \times [Si] - 8.5 \times [Sn] + [P] \le 79.3,$$

$$60.8 \le f2 = [Cu] - 4.6 \times [Si] - 0.7 \times [Sn] - [P] \le 61.9, \text{ and}$$

$$0.28 \le f7 = [P]/[Sn] \le 0.84$$

are satisfied, in constituent phases of metallographic structure, when an area ratio of α phase is represented by (α)%, an area ratio of phase is represented by (β) %, an area ratio of γ phase is represented by (γ)%, an area ratio of κ phase is represented by (κ)%, and an area ratio of μ phase is represented by (μ)%, the relations of $$30 \le (\kappa) \le 56,$$

$$0 \le (\gamma) \le 0.5,$$

$(\beta)=0$, $0 \leq (\mu) \leq 1.0$, $98.5 \leq f3=(\alpha)+(\kappa)$, $99.6 \leq f4=(\alpha)+(\kappa)+(\gamma)+(\mu)$, $0 \leq f5=(\gamma)+(\mu) \leq 1.2$, and $30 \leq f6=(\kappa)+6\times(\gamma)^{1/2}+0.5\times(\mu) \leq 58$ are satisfied, the length of the long side of γ phase is 25 μm or less, the length of the long side of μ phase is 15 μm or less, and κ phase is present in α phase.

4. The free-cutting copper alloy according to claim 3, further comprising:

one or more element(s) selected from the group consisting of 0.012 mass % to 0.07 mass % of Sb, 0.025 mass % to 0.07 mass % of As, and 0.006 mass % to 0.10 mass % of Bi.

5. The free-cutting copper alloy according to claim 1, wherein a total amount of Fe, Mn, Co, and Cr as the inevitable impurities is lower than 0.08 mass %.

6. The free-cutting copper alloy according to claim 1, wherein an amount of Sn in κ phase is 0.11 mass % to 0.40 mass %, and an amount of P in κ phase is 0.07 mass % to 0.22 mass %.

7. The free-cutting copper alloy according to claim 1, wherein a Charpy impact test value when a U-notched specimen is used is 12 J/cm$^2$ or higher and lower than 50 J/cm$^2$, and a creep strain after holding the copper alloy at 150° C. for 100 hours in a state where a load corresponding to 0.2% proof stress at room temperature is applied is 0.4% or lower.

8. The free-cutting copper alloy according to claim 1, wherein the free-cutting copper alloy is a hot worked material, a tensile strength S (N/mm$^2$) is 540 N/mm$^2$ or higher, an elongation E (%) is 12% or higher, a Charpy impact test value I (J/cm$^2$) when a U-notched specimen is used is 12 J/cm$^2$ or higher, and $660 \leq f8=S\times\{(E+100)/100\}^{1/2}$ or $685 \leq f9=S\times\{(E+100)/100\}^{1/2}+I$ is satisfied.

9. The free-cutting copper alloy according to claim 1, that is for use in a water supply device, an industrial plumbing component, a device that comes in contact with liquid, a pressure vessel, a fitting, an automobile component, or an electric appliance component.

10. A method of manufacturing the free-cutting copper alloy according to claim 1, the method comprising:

any one or both of a cold working step and a hot working step; and an annealing step that is performed after the cold working step or the hot working step, wherein in the annealing step, the copper alloy is heated or cooled under any one of the following conditions (1) to (4):

(1) the copper alloy is held at a temperature of 525° C. to 575° C. for 20 minutes to 8 hours;

(2) the copper alloy is held at a temperature of 505° C. or higher and lower than 525° C. for 100 minutes to 8 hours;

(3) the maximum reaching temperature is 525° C. to 620° C. and the copper alloy is held in a temperature range from 575° C. to 525° C. for 20 minutes or longer; or (4) the copper alloy is cooled in a temperature range from 575° C. to 525° C. at an average cooling rate of 0.1° C./min to 2.5° C./min, and Subsequently, the copper alloy is cooled in a temperature range from 460° C. to 400° C. at an average cooling rate of 2.5° C./min to 500° C./min.

11. A method of manufacturing the free-cutting copper alloy according to claim 1, the method comprising:

a casting step; and an annealing step that is performed after the casting step, wherein in the annealing step, the copper alloy is heated or cooled under any one of the following conditions (1) to (4):

(1) the copper alloy is held at a temperature of 525° C. to 575° C. for 20 minutes to 8 hours;

(2) the copper alloy is held at a temperature of 505° C. or higher and lower than 525° C. for 100 minutes to 8 hours;

(3) the maximum reaching temperature is 525° C. to 620° C. and the copper alloy is held in a temperature range from 575° C. to 525° C. for 20 minutes or longer; or (4) the copper alloy is cooled in a temperature range from 575° C. to 525° C. at an average cooling rate of 0.1° C./min to 2.5° C./min, and Subsequently, the copper alloy is cooled in a temperature range from 460° C. to 400° C. at an average cooling rate of 2.5° C./min to 500° C./min.

12. A method of manufacturing the free-cutting copper alloy according to claim 1, the method comprising:

a hot working step, wherein the material's temperature during hot working is 600° C. to 740° C., and in the process of cooling after hot plastic working, the material is cooled in a temperature range from 575° C. to 525° C. at an average cooling rate of 0.1° C./min to 2.5° C./min and subsequently is cooled in a temperature range from 460° C. to 400° C. at an average cooling rate of 2.5° C./min to 500° C./min.

13. A method of manufacturing the free-cutting copper alloy according to claim 1, the method comprising:

any one or both of a cold working step and a hot working step; and a low-temperature annealing step that is performed after the cold working step or the hot working step, wherein in the low-temperature annealing step, conditions are as follows:

the material's temperature is in a range of 240° C. to 350° C.;

the heating time is in a range of 10 minutes to 300 minutes; and when the material's temperature is represented by T° C. and the heating time is represented by t min, $150 \leq T-220)\times(t)^{1/2} \leq 1200$ is satisfied.

* * * * *